US011234549B2

(12) United States Patent
Mullet et al.

(10) Patent No.: US 11,234,549 B2
(45) Date of Patent: Feb. 1, 2022

(54) GROMMET DRAPERY SYSTEM

(71) Applicant: Current Products Corp., Pensacola, FL (US)

(72) Inventors: Willis J. Mullet, Gulf Breeze, FL (US); Darrin W. Brunk, Pensacola, FL (US); Samuel D. Schemmer, Pensacola, FL (US); Scott Hand, Milton, FL (US); Phillip Dugger, Pensacola, FL (US)

(73) Assignee: CURRENT PRODUCTS CORP., Pensacola, FL (US)

( * ) Notice: Subject to any disclaimer, the term of this patent is extended or adjusted under 35 U.S.C. 154(b) by 272 days.

(21) Appl. No.: 16/256,662

(22) Filed: Jan. 24, 2019

(65) Prior Publication Data

US 2019/0231109 A1 Aug. 1, 2019

Related U.S. Application Data

(60) Provisional application No. 62/622,202, filed on Jan. 26, 2018.

(51) Int. Cl.

| | |
|---|---|
| ***A47H 5/06*** | (2006.01) |
| ***A47H 1/02*** | (2006.01) |
| ***A47H 1/142*** | (2006.01) |
| ***A47H 13/02*** | (2006.01) |

(Continued)

(52) U.S. Cl.

CPC ..... *A47H 5/06* (2013.01); *A47H 1/02* (2013.01); *A47H 1/142* (2013.01); *A47H 13/02* (2013.01); *A47H 13/16* (2013.01); *A47H 2005/025* (2013.01)

(58) Field of Classification Search

CPC ... A47H 5/06; A47H 1/00; A47H 1/02; A47H 1/142; A47H 5/00; A47H 13/00; A47H 13/02; A47H 13/16; A47H 2005/025

See application file for complete search history.

(56) References Cited

U.S. PATENT DOCUMENTS

| | | | | |
|---|---|---|---|---|
| 1,465,938 A * | 8/1923 | Guider | ..... | A47H 13/02 160/344 |
| 4,339,487 A | 7/1982 | Mullet | | |
| 4,463,533 A | 8/1984 | Mullet | | |

(Continued)

FOREIGN PATENT DOCUMENTS

| | | |
|---|---|---|
| AU | 696675 B2 | 9/1998 |
| AU | 741583 B2 | 12/2001 |

(Continued)

*Primary Examiner* — Jerry E Redman
*Assistant Examiner* — Jeremy C Ramsey
(74) *Attorney, Agent, or Firm* — Christopher A. Proskey; BrownWinick Law Firm

(57) ABSTRACT

A wirelessly controllable, motorized and battery powered drapery apparatus is presented having a rotatable drive element having a guide structure in its surface. The rotatable drive is inserted through the open interior of a plurality of grommets in the shade material. A grommet driver is positioned over the rotatable drive element and connected to one of the plurality of grommets. The grommet driver has at least one tooth that is in communication with the guide structure in the rotatable drive element. As the rotatable drive element is rotated, the grommet drive is driven along the length of the rotatable drive element thereby moving the shade material between an open position and a closed position.

40 Claims, 58 Drawing Sheets

(51) Int. Cl.
*A47H 13/16* (2006.01)
*A47H 5/02* (2006.01)

(56) References Cited

U.S. PATENT DOCUMENTS 4,635,400 A 1/1987 Mullet
4,779,325 A 10/1988 Mullet
5,036,899 A 8/1991 Mullet
5,409,051 A 4/1995 Mullet et al.
5,419,010 A 5/1995 Mullet
5,481,076 A 1/1996 Mullet et al.
5,718,533 A 2/1998 Mullet et al.
5,902,011 A 5/1999 Hand et al.
5,929,580 A 7/1999 Mullet et al.
D413,055 S 8/1999 Mullet et al.
D413,579 S 9/1999 Mullet et al.
D413,867 S 9/1999 Mullet et al.
D421,031 S 2/2000 Mullet et al.
6,019,269 A 2/2000 Mullet et al.
6,041,843 A 3/2000 Mullet
6,058,667 A 5/2000 MacDonald et al.
6,089,304 A 7/2000 Mullet et al.
6,101,773 A 8/2000 Chau et al.
6,111,195 A 8/2000 Hand et al.
6,145,570 A 11/2000 Mullet et al.
6,161,438 A 12/2000 Mullet et al.
6,164,014 A 12/2000 McDowell et al.
6,178,702 B1 1/2001 Hand et al.
6,230,459 B1 5/2001 Jeffers et al.
6,253,824 B1 7/2001 Mullet et al.
6,257,305 B1 7/2001 Mullet et al.
6,263,947 B1 7/2001 Mullet
6,325,134 B1 12/2001 Mullet
6,326,751 B1 12/2001 Mullet et al.
6,326,754 B1 12/2001 Mullet et al.
6,374,567 B1 4/2002 Mullet
6,378,593 B1 4/2002 Mullet et al.
D458,230 S 6/2002 Hand et al.
6,401,792 B1 6/2002 Mullet et al.
6,431,250 B2 8/2002 Mullet et al.
6,442,897 B1 9/2002 Mullet
6,463,988 B1 10/2002 Mullet et al.
6,471,312 B1 10/2002 Coffey et al.
6,513,288 B1 2/2003 MacDonald et al.
6,546,684 B2 4/2003 Waalkes et al.
D474,215 S 5/2003 Mullet et al.
D475,146 S 5/2003 Mullet
6,561,256 B2 5/2003 Mullet
6,588,156 B2 7/2003 Mullet
6,604,593 B1 8/2003 Mullet
6,605,910 B2 8/2003 Mullet et al.
6,640,872 B1 11/2003 Mullet
6,655,440 B2 12/2003 Brunk
6,667,591 B2 12/2003 Mullet et al.
6,715,236 B2 4/2004 Mullet
6,725,898 B2 4/2004 Mullet et al.
6,824,637 B2 11/2004 Mullet et al.
6,843,300 B2 1/2005 Mullet et al.
D505,393 S 5/2005 Mullet et al.
6,899,157 B2 5/2005 Mullet
6,915,573 B2 7/2005 Mullet
6,955,206 B2 10/2005 Mullet et al.
D517,580 S 3/2006 Mullet et al.
7,014,386 B1 3/2006 Mullet et al.
7,038,409 B1 5/2006 Mullet
7,059,380 B2 6/2006 Bennett, III et al.
7,121,317 B2 10/2006 Mullet
7,123,128 B2 10/2006 Mullet et al.
7,128,123 B2 10/2006 Mullet et al.
7,173,514 B2 2/2007 Mullet et al.
7,190,266 B2 3/2007 Mullet et al.
7,207,142 B2 4/2007 Mullet
7,219,392 B2 5/2007 Mullet et al.
7,246,647 B2 7/2007 Mullet et al.
7,254,868 B2 8/2007 Mullet et al.
7,289,014 B2 10/2007 Mullet et al.
7,315,143 B2 1/2008 Mullet et al.
7,343,958 B1 3/2008 East et al.
7,358,480 B2 4/2008 Mullet et al.
7,382,063 B2 6/2008 Mullet et al.
7,397,342 B2 7/2008 Mullet et al.
7,461,484 B2 12/2008 Battey et al.
7,469,737 B2 12/2008 Mullet et al.
7,484,705 B2 2/2009 Hand et al.
7,565,772 B2 7/2009 Waalkes et al.
7,576,504 B2 8/2009 Mullet et al.
7,607,263 B2 10/2009 Mullet et al.
7,686,061 B2 3/2010 Mullet et al.
7,717,155 B2 5/2010 Mullet
7,721,387 B1 5/2010 Mullet et al.
7,784,521 B2 8/2010 Mullet et al.
7,874,342 B2 1/2011 Mullet et al.
7,908,207 B2 3/2011 Boyle et al.
7,950,436 B1 5/2011 Mullet et al.
8,065,039 B2 11/2011 Mullet et al.
8,069,898 B1 12/2011 Mullet et al.
8,085,129 B2 12/2011 Mullet et al.
8,125,167 B1 2/2012 Mullet et al.
8,179,229 B2 5/2012 Mullet
8,220,519 B2 7/2012 Bennett, III et al.
8,299,734 B2 10/2012 Mullet et al.
8,299,893 B2 10/2012 Mullet
8,371,358 B1 2/2013 Mullet et al.
8,400,264 B2 3/2013 Mullet et al.
8,403,023 B1 3/2013 Mullet et al.
8,575,872 B2 11/2013 Mullet et al.
8,723,455 B2 5/2014 Mullet et al.
8,739,854 B2 6/2014 Mullet et al.
8,800,633 B2 8/2014 Mullet et al.
8,807,196 B2 8/2014 Mullet et al.
8,820,386 B2 9/2014 Mullet et al.
8,820,388 B2 9/2014 Mullet et al.
8,854,798 B1 10/2014 Mullet et al.
8,892,262 B2 11/2014 Mullet et al.
8,919,419 B2 12/2014 Mullet et al.
8,939,190 B2 1/2015 Mullet et al.
D724,614 S 3/2015 Mullet et al.
8,968,900 B2 3/2015 Mullet et al.
9,091,115 B2 7/2015 Mullet et al.
9,194,179 B2 11/2015 Mullet et al.
9,249,623 B2 2/2016 Mullet et al.
9,279,286 B2 3/2016 Higgins et al.
9,384,657 B2 7/2016 Mullet et al.
9,609,114 B2 3/2017 Mullet et al.
9,663,986 B2 5/2017 Mullet et al.
9,771,755 B2 9/2017 Mullet et al.
9,801,486 B2 10/2017 Mullet et al.
9,822,584 B2 11/2017 Mullet et al.
9,890,585 B2 2/2018 Mullet et al.
9,896,882 B2 2/2018 Mullet et al.
10,119,330 B2 11/2018 Brunk et al.
10,183,416 B2 1/2019 Hand et al.
10,246,938 B2 4/2019 Mullet et al.
10,285,527 B2 5/2019 Mullet et al.
10,357,087 B2 7/2019 Mullet et al.
10,405,684 B2 9/2019 Mullet et al.
10,577,858 B2 3/2020 Mullet et al.
10,694,880 B2 6/2020 Mullet et al.
D893,213 S 8/2020 Mullet
D897,727 S 10/2020 Mullet
10,864,653 B2 12/2020 Hand
10,874,242 B2 12/2020 Mullet et al.
2006/0101724 A1 5/2006 Hoekstra et al.
2006/0137835 A1 6/2006 Mullet et al.
2006/0191205 A1 8/2006 Mullet et al.
2006/0289129 A1 12/2006 Mullet et al.
2007/0056694 A1 3/2007 Mullet
2007/0181267 A1 8/2007 Mullet
2007/0246174 A1* 10/2007 Barrese ..... A47H 1/02 160/330
2007/0284053 A1 12/2007 Mullet et al.
2008/0041537 A1 2/2008 Mullet et al.
2008/0115878 A1 5/2008 Mullet et al.
2008/0169070 A1 7/2008 Mullet et al.

(56) References Cited

U.S. PATENT DOCUMENTS

| | | | | |
|---|---|---|---|---|
| 2008/0178423 | A1* | 7/2008 | Patel | A47H 13/14 16/87.2 |
| 2008/0271394 | A1 | 11/2008 | Hand et al. | |
| 2009/0127369 | A1 | 5/2009 | Mullet et al. | |
| 2009/0229767 | A1 | 9/2009 | Mullet et al. | |
| 2010/0019902 | A1 | 1/2010 | Mullet | |
| 2013/0087296 | A1 | 4/2013 | Mullet et al. | |
| 2013/0098561 | A1 | 4/2013 | Mullet et al. | |
| 2013/0180666 | A1 | 7/2013 | Mullet et al. | |
| 2013/0220560 | A1 | 8/2013 | Mullet et al. | |
| 2013/0276995 | A1 | 10/2013 | Mullet et al. | |
| 2013/0333848 | A1 | 12/2013 | Mullet et al. | |
| 2014/0014281 | A1 | 1/2014 | Mullet et al. | |
| 2014/0262076 | A1 | 9/2014 | Mullet et al. | |
| 2014/0352897 | A1 | 12/2014 | Mullet et al. | |
| 2014/0376747 | A1 | 12/2014 | Mullet et al. | |
| 2015/0013920 | A1 | 1/2015 | Mullet et al. | |
| 2015/0083352 | A1* | 3/2015 | Buxkemper-Odenkirk | A47H 23/10 160/348 |
| 2015/0107788 | A1 | 4/2015 | Mullet et al. | |
| 2015/0327705 | A1* | 11/2015 | Mullet | A47H 23/01 160/331 |
| 2016/0143470 | A1* | 5/2016 | Mullet | A47H 5/02 160/331 |
| 2016/0374497 | A1 | 12/2016 | McCarthy et al. | |
| 2017/0174836 | A1 | 6/2017 | Hampson et al. | |
| 2019/0061325 | A1 | 2/2019 | Hand | |
| 2019/0100961 | A1 | 4/2019 | Kutell et al. | |
| 2019/0119446 | A1 | 4/2019 | Hampson et al. | |
| 2019/0231109 | A1 | 8/2019 | Mullet et al. | |
| 2019/0231110 | A1 | 8/2019 | Mullet et al. | |
| 2020/0069100 | A1 | 3/2020 | Mullet et al. | |
| 2020/0077829 | A1 | 3/2020 | Mullet et al. | |
| 2020/0138226 | A1 | 5/2020 | Mullet et al. | |
| 2020/0229630 | A1 | 7/2020 | Mullet et al. | |
| 2020/0232599 | A1 | 7/2020 | Mullet et al. | |
| 2021/0101309 | A1 | 4/2021 | Hand et al. | |

FOREIGN PATENT DOCUMENTS

| | | | |
|---|---|---|---|
| AU | 2016202932 | B2 | 3/2018 |
| CA | 2174580 | C | 4/2006 |
| CA | 2530881 | C | 2/2007 |
| CA | 2530701 | C | 6/2009 |
| JP | 2004324408 | A | 11/2004 |
| JP | 2004324409 | A | 11/2004 |
| JP | 2006177152 | A | 7/2006 |
| TH | 1801002150 | A | 4/2019 |
| WO | 96/36784 | A1 | 11/1996 |
| WO | 01/65984 | A1 | 9/2001 |
| WO | 02/16125 | A1 | 2/2002 |
| WO | 2004/060659 | A1 | 7/2004 |
| WO | 02/90696 | A3 | 10/2004 |
| WO | 2014/062504 | A1 | 4/2014 |
| WO | 2014/165470 | A1 | 10/2014 |
| WO | 2014/169173 | A1 | 10/2014 |
| WO | 2015/006270 | A1 | 1/2015 |
| WO | 2021/050714 | A1 | 3/2021 |

* cited by examiner

GROMMET DRAPERY SYSTEM

CROSS REFERENCE TO RELATED APPLICATIONS

This patent application claims priority to provisional patent application Ser. No. 62/622,202 filed on Jan. 26, 2018 entitled "Motorized Tabbed or Pocket Drapery Apparatus, System and Method of Use," which is fully incorporated by reference herein.

FIELD OF THE DISCLOSURE

This disclosure relates to an architectural covering. More specifically, and without limitation, this disclosure relates to a motorized grommet drapery apparatus, system and method of use.

BACKGROUND OF DISCLOSURE

Architectural coverings, such as curtains, shades, draperies and the like are old and well known in the art and are frequently used to provide privacy and to limit the amount of light that is permitted to pass through a window and into a room or building. There are countless types, forms and designs of architectural coverings known in the art. The term architectural covering is used to describe any and all of these types, forms and designs including blinds, shades, draperies, and the like.

One form of architectural covering of particular interest in this application is commonly referred to as draperies. Common components of draperies include a support rod connected to brackets positioned above or adjacent to a window or door. In one arrangement of a drapery, the support rod rotates and drives the shade material across the length of the support rod. This arrangement is more fully described in Applicant's related U.S. Pat. No. 9,095,908 entitled "Rotatable Drive Element For Moving A Window Covering," issued on Aug. 4, 2015 which is fully incorporated by reference herein, including any related applications; and Applicant's related U.S. Pat. No. 9,999,313 granted on entitled "Motorized Drapery Apparatus, System and Method of Use," which is also fully incorporated by reference herein, including any related applications.

In these related patent applications, a motorized drapery apparatus is presented having drive attachment elements and idler attachment elements positioned around or looped over the support rod (also referred to as the rotatable drive element). Shade material is attached to these drive attachment elements and idler attachment elements by way of pins or hooks or any other arrangement.

While this arrangement is satisfactory in many applications, a popular form of shade material for draperies is commonly referred to as grommet draperies or grommet curtains (hereinafter "grommet draperies"). Conventionally, grommet draperies include shade material with a series of grommets attached to openings in the shade material adjacent its upper end. These grommets are then slid over the support rod, one after the other in a zigzag formation. This arrangement allows for the grommet draperies to hang from the support rod with a relatively clean and pleasing appearance.

Once installed, the grommet draperies are then manually opened by grabbing the shade material and pulling it in a lateral direction. This causes the grommets to slide along the length of the support rod.

One problem associated with grommet draperies is that opening grommet draperies is inherently a manual task as there is nothing presently available that facilitates the motorized opening and closing of grommet draperies. This is because the grommets tend to tilt, cant or angle during opening and closing which causes opposing sides of the grommet to bind on the support rod. This resistance increases as the grommets stack up on one another during opening and closing. This causes increased and sometimes excessive resistance. In extreme cases the grommet draperies can be impossible to open without the user reaching up and manually sliding individual grommets along the length of the support rod which is inconvenient, time consuming and frustrating.

Another problem in the art is that there is a lack of convenient and aesthetically pleasing systems for motorized opening and closing of grommet draperies. Therefore there is a need in the art for a motorized grommet drapery apparatus that functions well and is aesthetically pleasing.

Thus it is a primary object of the disclosure to provide a motorized grommet drapery apparatus that improves upon the state of the art.

Another object of the disclosure is to provide a motorized grommet drapery apparatus that is easy to use.

Yet another object of the disclosure is to provide a motorized grommet drapery apparatus that is efficient.

Another object of the disclosure is to provide a motorized grommet drapery apparatus that is simple in design.

Yet another object of the disclosure is to provide a motorized grommet drapery apparatus that is relatively inexpensive or affordable.

Another object of the disclosure is to provide a motorized grommet drapery apparatus that has a minimum number of parts.

Yet another object of the disclosure is to provide a motorized grommet drapery apparatus that has an intuitive design.

Another object of the disclosure is to provide a motorized grommet drapery apparatus that is motorized.

Yet another object of the disclosure is to provide a motorized grommet drapery apparatus wherein the grommets are positioned over the support rod and driven along the length of the support rod.

Another object of the disclosure is to provide a motorized grommet drapery apparatus that is wirelessly controllable.

These and other objects, features, or advantages of the present disclosure will become apparent from the specification and claims.

SUMMARY OF THE DISCLOSURE

A wirelessly controllable, motorized and battery powered drapery apparatus is presented having a rotatable drive element having a guide structure in its surface. The rotatable drive is inserted through the open interior of a plurality of tabs in the shade material. A grommet driver is positioned over the rotatable drive element and connected to one of the plurality of tabs. The grommet driver has at least one tooth that is in communication with the guide structure in the rotatable drive element. As the rotatable drive element is rotated, the grommet drive is driven along the length of the rotatable drive element thereby moving the shade material between an open position and a closed position.

DETAILED DESCRIPTION OF THE DISCLOSURE

In the following detailed description, reference is made to the accompanying drawings which form a part hereof, and in which is shown by way of illustration specific embodiments in which the disclosure may be practiced. These embodiments are described in sufficient detail to enable those skilled in the art to practice the disclosure, and it is to be understood that other embodiments may be utilized and that mechanical, procedural, and other changes may be made without departing from the spirit and scope of the present disclosures. The following detailed description is, therefore, not to be taken in a limiting sense, and the scope of the present disclosure is defined only by the appended claims, along with the full scope of equivalents to which such claims are entitled.

As used herein, the terminology such as vertical, horizontal, top, bottom, front, back, end and sides are referenced according to the views presented. It should be understood, however, that the terms are used only for purposes of description, and are not intended to be used as limitations. Accordingly, orientation of an object or a combination of objects may change without departing from the scope of the disclosure.

As used herein, the disclosure is shown and described as being used in association with an architectural covering however the disclosure is not so limiting. Instead, one of ordinary skill in the art will appreciate that the system and method presented herein can be applied to any mechanical device, without limitation. The system and method is merely shown and described as being used in association with an architectural covering for ease of description and as one of countless examples.

As used herein, the term architectural covering refers to any covering such as a blind, drapery, roller shade, venetian blind, or the like, used especially in association with windows. This term is in no way meant to be limiting. Instead, one of ordinary skill in the art will appreciate that the system and method presented herein can be applied to any architectural covering, without limitation.

Figure 1:
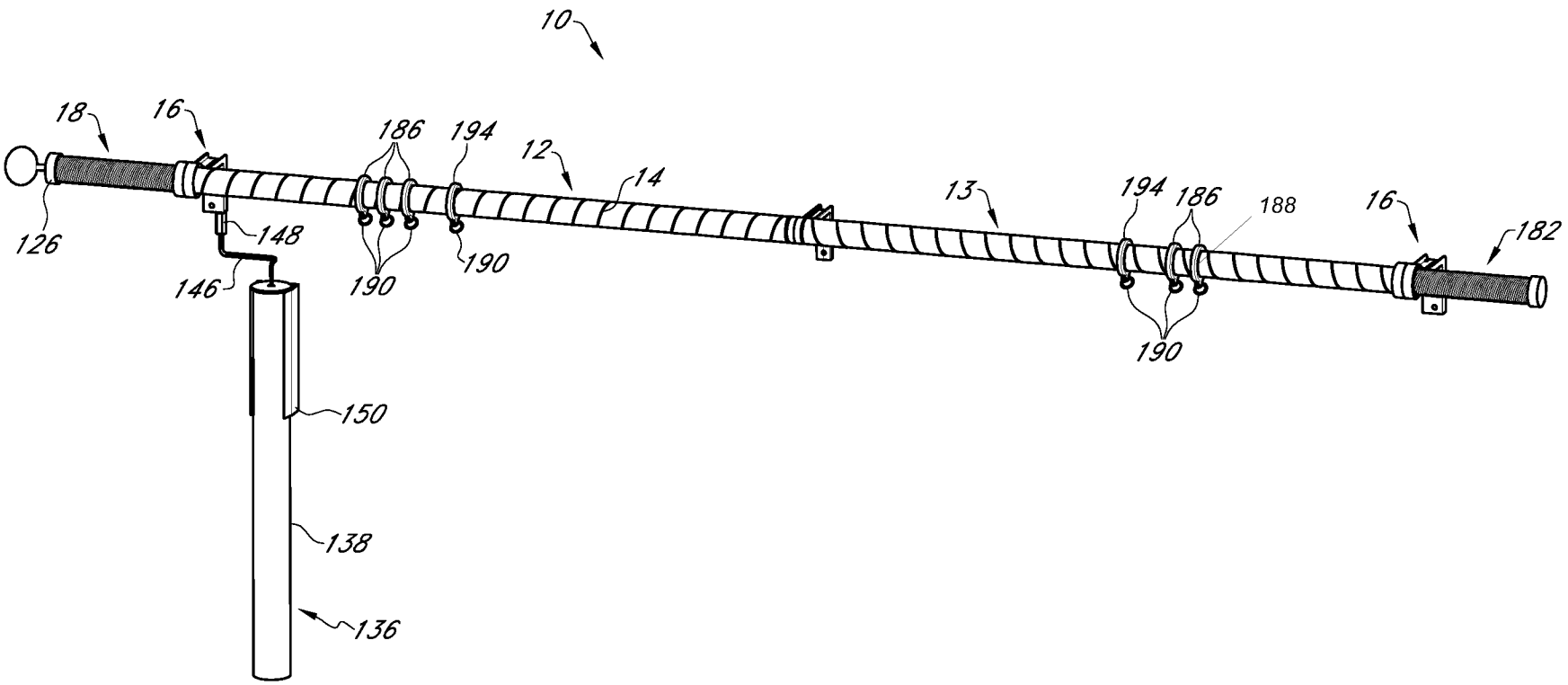
FIG. 1 is a perspective view of an architectural covering having two rotatable drive elements having a helical guide structure therein; the rotatable drive elements are connected at their inward ends by a center coupler; the rotatable drive elements are connected to a bracket at their outward ends, a motor housing with a finial is connected to one end of the rotatable drive element with a battery assembly electrically connected to the bracket adjacent the motor housing which supplies power to the motor housing; a dummy rotatable drive element extension is connected to the bracket on the opposite; driver attachment elements for driving shade material open and closed are shown on the rotatable drive element.

With reference to FIG. 1, an architectural covering 10 is presented. Architectural covering 10 is formed of any suitable size, shape and design. As one example, as is shown, architectural covering 10 includes a first rotatable drive element 12 connected to a second rotatable drive element 13. The first and second rotatable drive elements 12, 13 are any form of a rotating member such as a rod, tube, threaded bar, or the like, whether round or non-round in cross section. In one arrangement, rotatable drive elements 12 and 13 are practically identical if not identical and therefore for simplicity reference to one shall be reference to the other, unless specified otherwise.

In one arrangement, as is shown, rotatable drive element 12 is an elongated hollow tube, having a helical guide structure 14 positioned in its surface. The helical guide structure 14 can be a left-hand guide structure, a right-hand guide structure, or both, or a plurality or combination of left-hand guide structures and/or right-hand guide structures. Guide structure 14 can either be grooves, indentations, protrusions, threads or any other feature or the like, as is described herein. Guide structure 14 can be either ground or machined into the surface or rotatable drive element 12, knurled into the surface of rotatable drive element 12 (as is described further herein), cast or formed into the surface of rotatable drive element 12, extruded into the exterior surface of rotatable drive element 12, or created by any other means or methods known in the art.

In this arrangement, four leads or four grooves are presented as guide structure 14. These leads are broken into two pairs, a first pair having a right hand twist, and a second pair having a left hand twist. The two grooves of both the first pair and the second pair are positioned opposite to one another on drive element 12, or said another way, the two grooves are diametrically opposed to one another and remain this way throughout their length. The two pairs, the left hand twist pair and the right hand twist pair are equally spaced to one another. As is shown, the two pairs of grooves cross one another perpendicularly, or at a 90 degree angle, intermittently along the length of drive element 12. As is shown, the two pairs of grooves begin and/or end at the same position on rotatable drive element 12 and twist opposite one another. When the two pairs of grooves cross or intersect one another, both grooves cross one another at the same position, opposite one another on the rotatable drive element. This is accomplished by having a consistent angle of rotation throughout the length of the grooves, and maintaining the position of the grooves within close tolerances throughout the length of the rotatable drive element 12. However, a varying pitch or angle of rotation is also hereby contemplated for use.

Wall brackets 16 support rotatable drive element 12. Wall brackets 16 are any form of a connecting device which supports and connects rotatable drive element 12 to any structural element such as a wall adjacent a window, a ceiling, a frame structure or the like. As one example, in the arrangement shown, rotatable drive element 12 connects on one side to wall bracket 16 and a motor housing 18 connects on the opposite side.

In the arrangement shown, wall brackets 16 include a mounting plate 20 which connects to the wall, an extension arm 22, which extends between mounting plate 20 and a mounting member 24. Mounting member 24 is formed of any suitable size and shape and serves to connect to rotatable drive element 12 while allowing for functional movement, such as rotation, of the necessary parts. In one arrangement, as is shown, mounting member 24 is a generally circular collar which is sized and shaped to receive rotatable drive element 12 therein as is described further herein.

Mounting member 24 has an exterior side 26 and an interior side 28. In the arrangement shown, rotatable drive element 12 connects to the interior side 28 and motor housing 18 connects to the exterior side 26. A collar 30 extends inwardly from the mounting member 24 thereby separating the interior side 28 from the exterior side 26. In the arrangement shown, collar 30 has a flat and flush interior side 32 which extends into the open interior of mounting member 24 perpendicularly to the interior surface of mounting member 24. The exterior side of collar 30 has a protrusion 34 that extends outwardly from collar 30 in perpendicular alignment to collar 30 and in parallel spaced alignment to the interior surface of mounting member 24 thereby forming channel 36 between the interior surface of mounting member 24 and the exterior surface of protrusion 34. A step 38 is positioned between protrusion 34 and the end 40 of collar 30 which defines a circular interior through hole. Step 38 and channel 36 serve to engage and hold motor housing 18 while allowing portions of the motor housing 18 to extend through the open end 40 of collar 30 to engage and rotate rotatable drive element 12.

As is shown, the features of the interior side 32 of mounting member 24 are generally circular in shape so as to allow rotation of rotatable drive element 12. In contrast, key-features 42 are positioned in the exterior side 26 of mounting member 24. Key-features 42 are any aberration, deviation, irregularity, anomaly in the round features in the exterior side 26 of mounting member 24. Key-features 42 breakup the circular shape of the features in the exterior side 26 of mounting member 24 and thereby serve to prevent rotation of motor housing 18 when connected to bracket 16. In the arrangement shown, key-features 42 include a pair of semi-circular recesses 44 on the mounting member 24 that extend all the way to the collar 30. A divider 46 extends partially between the two recesses 44 and provides separation thereto. Divider 46 is positioned in alignment with the center of extension arm 22, for added strength and ease of alignment, and separates adjacent recesses 44.

Electrical contacts 48 are positioned in the key-features 42 at approximately the center of each recess 44 and extend outwardly from the exterior surface of collar 30 within channel 36. In the arrangement shown, electrical contacts 48 are circular spring loaded conductive plungers, however any other form of an electrical contact is hereby contemplated. Electrical contacts 48 are electrically connected to a conduit 50 which extends through a passageway 54 in extension arm 22 of bracket 16 and through a passageway 56 in mounting plate 20. Passageway 56 in mounting plate 20 is to the side of and intentionally separated from upper through hole 58 and lower through hole 60 so as to prevent conduit 50 from being damaged when mounting bracket 16 is installed. Through holes 58, 60 receive fasteners 62 (not shown), such as conventional screws which are used to attach brackets 16 to a wall, ceiling or other mounting structure. In the arrangement shown, the lower through hole 60 is positioned approximately in the lateral middle of mounting plate 20 whereas the upper through hole 58 is positioned laterally to one side of the mounting plate 20. This offset provides advantages during mounting, namely, a fastener 62 can be inserted in the bottom through hole 60 and then the bracket 16 can be rotated on the lower fastener 62 into place followed by a fastener 62 into the upper through hole 58 to complete installation.

The lower end of conduit 50 is connected to a socket assembly 64. Socket assembly 64 is any form of an electrical connector such as a USB port, a two-conductor socket, a three conductor socket, a four conductor socket, a five conductor socket, a six conductor socket, a phone jack, an Ethernet socket, or any other standard or non-standard socket used to electrically connect conduit 50 to any other device or object.

A components recess 66 is positioned in mounting plate 20 which is sized and shaped to receive a motor controller assembly 68, which is described further herein. Components recess 66 is formed of any suitable size, shape and design. As one example, in the arrangement shown, components recess 66 is positioned between the sidewalls 67 and front wall 69 of mounting plate 20 and positioned adjacent to the through holes 58, 60.

Motor Housing:

In one arrangement, as is shown, motor housing 18 is connected adjacent the exterior end of rotatable drive element 12. Motor housing 18 is connected to the exterior side 26 of mounting member 24 of bracket 16. Motor housing 18 is formed of any suitable size and shape. In one arrangement, as is shown, motor housing 18 is formed of a hollow tube 70 which is formed as an extension of rotatable drive element 12 and with approximately the same exterior size, shape, diameter and appearance of the rotatable drive element 12, as well as having a continuous extension of guide structure 14 therein. In this arrangement, when motor housing 18 is connected to the end of rotatable drive element 12, the length of rotatable drive element 12 is relatively seamlessly extended, as is, the length of guide structure 14. In one arrangement, as is shown, rotatable drive element 12 connects to the interior side 28 of mounting member 24. In this arrangement, mounting member 24 hides or covers the seam between rotatable drive element 12 and motor housing 18. In this arrangement, the motor housing 18 remains stationary as rotatable drive element 12 rotates, as is further described herein. In an alternative arrangement, motor housing 18, or motor 76 is positioned within the hollow drive element 12.

Motor housing 18 has an exterior end 72 and an interior end 74. Positioned within the open interior compartment of hollow tube 70 between interior end 74 and exterior end 72 is a motor 76. Motor 76 is any form of a motor that converts electrical energy to mechanical energy and provides rotation and torque as output. In the arrangement shown, motor 76 is connected to a transmission 78. Transmission 78 is any form of a device that transmits rotation of motor 76 and gears such as a gear box, a planetary gear box or the like. Transmission 78 transmits the rotation of motor 76 and converts energy into the desirable speed useful for the application. The transmission 78 helps to maximize the torque produced by the motor 76 while maximizing battery life.

Transmission 78 is connected to a drive shaft 80 which extends outwardly from the interior end 74 of motor housing 18. Drive shaft 80 extends through motor end cap 82 which is connected to the interior end 74 of hollow tube 70.

Motor end cap 82 has a generally circular external ring 84 having an interior edge 86 and an exterior edge 88. Interior edge 86 connects to hollow tube 70 whereas the exterior edge 88 connects to mounting member 24 of bracket 16. A collar 90 extends inwardly from the ring 84 thereby separating the interior side 86 from the exterior side 88 and provides a mounting surface for mounting motor end cap 82 to the other components of motor housing 18. An opening 92 positioned in the collar 90 allows for the drive shaft 80 of transmission 78 to extend from the interior side 86 of motor end cap 82 to the exterior side 88 of motor end cap 82.

Key-features 94 are positioned in the exterior surface of motor end cap 82. Key-features 94 are any aberration, deviation, irregularity and/or anomaly in the generally round exterior surface of ring 84 of motor end cap 82. Key-features 94 breakup the circular shape of the motor end cap 82 and thereby serving to prevent rotation of motor housing 18, when connected to bracket 16. In the arrangement shown, key-features 94 include a pair of protrusions or a squared end that protrudes outward. Key-features 94 extend from the exterior edge 88 of ring 84 to the collar 90 of motor end cap 82. A divider 96 extends partially between the two semi-circular protrusions and provides separation thereto. Divider 96 is positioned in alignment with the center of extension arm 22 for added strength and ease of alignment.

Electrical contacts 98 are positioned in the key-features 94 at approximately the center of each protrusion, on the interior side of ring 84. Electrical contacts 98 extend outwardly from the exterior surface 88 of collar 90. Electrical contacts 98 are connected to electrical connectors 99 which extend through the motor end cap 82 and transmit the power received by electrical contacts 98 to the electrical components contained within motor housing 18. In the arrangement shown, electrical contacts 98 are circular spring loaded conductive plungers, however any other form of an electrical contact is hereby contemplated. Electrical contacts 98 are electrically connected to the motor 76 and motor controller assembly 68 as is described herein.

In the arrangement shown, a pair of fasteners 100 extend through the collar 90 and connect to the transmission 78, or any other component of the motor housing 18, thereby locking the two components together. A bearing 102 and motor coupler 104 are positioned over the drive shaft 80, held in place by a locking arrangement, between motor coupler 104 connects and drive shaft 80. Motor coupler 104 has a rounded or angled nose 106 which tapers outwardly as it extends towards motor housing 18. The exterior periphery of motor coupler 104 adjacent motor housing 18 is formed in the shape of gears 108 or a gear tooth arrangement. That is, at the external surface of motor coupler 104 near its base where motor coupler 104 connects to the motor housing 18, the gears 108 mesh with gears in or attached to the rotatable drive element 12 and serve to rotate rotatable drive element 12 when motor 76 and/or transmission 78 is rotated. The rounded or angled nose 106 eases alignment and insertion of the motor coupler 104 through bracket 16 and into the rotatable drive element 12. A shoulder 110 is positioned towards the motor housing 18 from gears 108 and nose 106 and extends outwardly past gears 108. Shoulder 110 serves as a stop for bearing 102 which is positioned around body 112 and held in place by clip 114.

In this arrangement, as motor 76 rotates, the drive shaft 80 of transmission 78 rotates which rotates motor coupler 104 which rotates bearing 102 within ring 84 of motor end cap 82.

The exterior end 72 of motor 76 is connected to a motor controller 68. Motor controller 68 includes all the components to control motor 76 and to control operation of the architectural covering 10. In an alternative arrangement, some or all of the components of motor controller 68 are positioned external to the motor housing hollow tube 70, and in one arrangement, some of these components are positioned within bracket 16. In yet another alternative arrangement, the motor 76 and some or all of the components of motor controller 68 are positioned within the drive element 12.

Motor controller 68 is any device which controls the operation of motor 76. In one arrangement, motor controller 68 is an electrical circuit board or PC board 116 which is electrically connected to a microprocessor 118, to memory 120, a receiver or transceiver 122, and an antenna 124. Microprocessor 118 is any programmable device that accepts analog or digital signals or data as input, processes it according to instructions stored in its memory 120, and provides results as output. Microprocessor 118 receives signals from receiver or transceiver 122 and processes them according to instructions stored in memory 120 and then controls motor 76 based on these signals. Memory 120 is any form of electronic memory such as a hard drive, flash, ram or the like. Antenna 124 is any electronic device which converts electric power into electromagnetic signals or electromagnetic waves, which are commonly known as radio waves or RF (radio frequency) (hereinafter collectively referred to as "electromagnetic signals" without limitation). Antenna 124 can transmit and/or receive these electromagnetic signals. In one arrangement these electromagnetic signals are transmitted via AM or FM RF communication, while any other range of RF is hereby contemplated such as 433 MHz or 908 MHz, Wi-Fi, or any other band, frequency, protocol or the like. In the arrangement shown, a meandering monopole antenna or fractal antenna is used; however any other form of an antenna is hereby contemplated. Antenna 124 is positioned adjacent the exterior end 72 of motor housing 18 so as to be in the best position to receive electromagnetic signals without interference. In the arrangement shown, antenna 124 is positioned just inside of end cap 126. In an alternative arrangement, antenna 124 is incorporated within end cap 126. In another arrangement end cap 126 is replaced with a decorative finial; or alternatively a decorative finial is connected to end cap 126.

To detect rotation and track the position of rotatable drive element 12, a sensor assembly 128 is connected to motor housing 18. Sensor assembly 128 is any form of a device which senses the rotation or position of architectural covering 10, such as reed switches, mechanical encoders, magnetic encoders, or the like. In one arrangement, as is shown, sensor assembly 128 includes a magnet wheel 130 connected to a secondary motor shaft 132 extending outwardly from the exterior end 72 of motor 76 such that when motor 76 rotates, secondary motor shaft 132 rotates, thereby rotating magnetic wheel 130. Positioned adjacent to magnet 130 is at least one, and as is shown two, Hall Effect sensors 134 positioned opposite one another. In this arrangement, Hall Effect sensors 134 are connected to PC board 116 adjacent magnet 130 which extends into an opening in PC board 116. This arrangement using Hall Effect Sensors 134 is more fully described in Applicant's related patent application entitled "Low-Power Architectural Covering," U.S. Pat. No. 9,249,623 granted on Feb. 2, 2016 which is fully incorporated by reference herein.

Battery Tube Assembly:

A battery tube assembly 136 is connected to the architectural covering 10. Battery Tube Assembly 136 is formed of any suitable size, shape and design. As one example, in the arrangement shown, the battery tube assembly 136 includes an elongated hollow tubular member 138 which is sized and shaped to receive a stack of conventional batteries 140 therein within close and acceptable tolerances such as A, AA, B, C or D cell batteries. The lower end of battery tube assembly 136 is closed by a battery end cap 142. The opposite, or upper end of battery tube assembly 136 is removeably and replaceably enclosed by a battery connector cap 144. Battery connector cap 144 is removeably and replaceably connected to battery tube assembly 136 by a key-slot 146 positioned in the elongated hollow tubular member which is in locking and mating communication with a protrusion in the battery connector cap 144. However, any other means of connecting battery connector cap 144 to elongated hollow tubular member 138 is hereby contemplated such as threads, a snap fit design, a button-lock design or the like. A transmission wire 146 which terminates in a plug 148 extends outwardly from battery connector cap 144 and transmits electricity to architectural covering 10. Plug 148 matingly and matchingly and removeably and replaceably connects to socket assembly 64 in mounting plate 20 of bracket 16.

A battery tube mounting bracket 150 is removeably and replaceably connected to the elongated hollow tubular member 138 and serves to mount and hold elongated hollow tubular member 138 therein. Battery tube mounting bracket 150 is formed of any suitable size, shape and design. As one example, in the arrangement shown, battery tube mounting bracket 150 is a generally elongated extrusion having a back wall 152 connected to its outward edges to sidewalls 154. The space between back wall 152 and opposing sidewalls 154 is sized and shaped to frictionally and tightly, but removeably, receive hollow elongated tubular member 138. To achieve this frictional engagement, the ends 156 of sidewalls 154 angle or curve inward toward one another. In this arrangement, elongated hollow tubular member 138 can be forced within the space between sidewalls 154 and back wall 152; and elongated hollow tubular member 138 can be forced out of the space between sidewalls 154 and back wall 152. Elongated hollow tubular member 138 can be mounted within the vicinity of bracket 16 and motor housing 18 in either a vertical alignment (as is shown) in a perpendicular alignment or in any other alignment by fastening battery tube mounting member 150 to the wall, ceiling or structure architectural covering 10 is mounted to. Mounting can be accomplished by passing conventional fasteners, such as screws or bolts, through the back wall 152 of battery tube mounting bracket 150.

Motor Coupler Sleeve:

Rotatable drive element 12 connects to the motor housing 18 through connection of the motor coupler 104 to a motor coupler sleeve 160. Motor coupler sleeve 160 is an elongated hollow tubular member having an exterior surface 162 and an interior surface 164 which extend in generally parallel spaced relation to one another. The exterior surface 162 has gears or teeth therein that extend along a length of motor coupler sleeve 160. The gears or teeth in the exterior surface 162 of motor coupler sleeve 160 matingly and meshingly and removeably and replaceably engage and receive gears or teeth in the interior surface 166 of rotatable drive element 12 adjacent its open hollow end 168. A collar 170, or protrusion positioned in the exterior surface 162 of motor coupler sleeve 160 sets the distance at which motor coupler sleeve 160 can be inserted into the end 168 of rotatable drive element 12. The interior surface 164 of motor coupler sleeve 160 also has gears or teeth therein that extend along a length of motor coupler sleeve 160. The gears or teeth in the interior surface 164 of motor coupler sleeve 160 matingly and meshingly and removeably and replaceably engage and receive gears 108 in the interior surface of motor copuler 104 of motor housing 18. In this arrangement, nose 106 of motor coupler 104 is inserted through the mounting member 24 of bracket 16 and into the hollow interior of motor coupler sleeve 160 such that the gears 108 of motor coupler 104 engage the teeth or gears in the interior surface 164 of motor coupler sleeve 160. A collar 170, or protrusion positioned in the exterior surface 162 of motor coupler sleeve 160 sets the distance at which motor coupler sleeve 160 can be inserted into the end 168 of rotatable drive element 12.

When motor coupler sleeve 160 is fully inserted within the hollow interior end 168 of rotatable drive element 12 and the motor coupler 104 is fully inserted into the hollow interior of motor coupler sleeve 160, rotation of motor coupler 104 causes rotation of rotatable drive element 12.

Center Coupler:

Two rotatable drive elements 12 can connect to one another in end-to-end alignment through the use of a center coupler 172. The use of multiple center couplers 172 can be used to connect two, three, four or more rotatable drive elements 12 together without limit.

Center coupler 172 is formed of any suitable size, shape and design. As one example, in the arrangement shown, center coupler 172 is a pair of elongated hollow tubular members 174 connected at their inward facing edge to a bearing assembly 176. In one arrangement, bearing assembly 176 includes an individual bearing 178 associated with each elongated hollow tubular member 174. The exterior surface 180 of each elongated hollow tubular member 174 has gears or teeth therein that extend along a length of each elongated hollow tubular member 174. The gears or teeth in the exterior surface 180 of elongated hollow tubular member 174 matingly and meshingly and removeably and replaceably engage and receive gears or teeth in the interior surface 166 of rotatable drive element 12 adjacent its open hollow end 168.

In one arrangement, bearing assembly 176 allows for free and independent rotation of each elongated hollow tubular member 174 of center coupler 172 without affecting the other. This allows for rotation of two rotatable drive elements 12 free and independent of one another. This allows for individual control and operation of one side of architectural covering 10, such as when two motor housings 18 are associated with a two rotatable drive element 12 architectural covering 10, where each motor housing 18 controls only the rotatable drive element 12 it is connected to.

In an alternative arrangement, the two elongated hollow tubular members 174 are connected to one another, or only a single elongated hollow tubular member 174 is used. In this arrangement, the rotatable drive elements 12 do not rotate independently of one another. When two motor housings 18 are used with this arrangement, additional torque is provided by the combined force of two motors 76.

In one arrangement, the elongated hollow tubular members 174 are inserted all the way into the open ends 168 of rotatable drive elements until the ends 168 engage or approximately engage the bearing assembly 176. In this arrangement, rotatable drive elements 12 are fully inserted over center coupler 172. In one arrangement, when fully inserted into opposing rotatable drive elements 12 no further support is necessary. In an alternative arrangement, center coupler 172 is connected to a bracket 16. That is, the bearing assembly 176 is held within the mounting member 20 of a bracket 16. When bearing assembly 176 is positioned within mounting member 20 of a bracket 16, rotatable drive elements 12 are free to rotate upon bearings 178. In this way, additional support is provided while still allowing for necessary rotation.

The center coupler 172 provides for easier installation by allowing the assembly of long rotatable drive elements 12 from shorter rotatable drive elements 12. This also reduces the cost and ease of shipping. In addition, in one arrangement, elongated hollow tubular members 174 of the center coupler 172 are formed of a material that has some bend to it. Suitable materials include plastic, rubber, composite UHMW material or the like. The benefits of this material, used in association with the hollow design of the tubular members 174 allow the center coupler 172 to provide some give to the two rotatable drive elements 12. This give or ability to slightly bend allows for the combined rotatable drive elements 12 to be installed on walls or in applications that are not exactly perfectly straight, or allows for less-precise alignment during installation. In one arrangement, motor coupler sleeve 160 is also made of the same material which allows for less-precise installation of motor housing 18 into motor coupler sleeve 160. The use of one of these plastic or composite materials also serves to reduce noise of the architectural covering 10 during use.

Multiple center couplers 170 can be used to connect any number of rotatable drive elements together.

Rotatable Drive Element Extension:

In the arrangement shown in FIG. 1, only a single motor housing 18 is connected to the two rotatable drive elements 12, which drives the combined rotatable drive elements 12. A rotatable drive element extension 182 is connected to the exterior side 26 of the mounting member 14 of the second bracket 16. Rotatable drive element extension 182 is formed of any suitable size, shape and design. As one example, in the arrangement shown, rotatable drive element extension 182 is simply a dummy motor housing lacking the internal drive components such as the motor 76, transmission 78 and motor controller assembly 68 and the like. In one arrangement, in all other ways, rotatable drive element extension 182 has an identical appearance and design to motor housing 18 described herein. In one arrangement, rotatable drive element extensions 182 do include the hollow tube, motor end cap 82, bearing 102 and motor coupler 104 so as to connect rotatable drive element 12 and allow rotation thereof. Motor housing 18 and rotatable drive element extension 182 are secured to brackets 16 by a locking-screw 184 which extends through mounting member 24 and engages the motor end cap 82 of motor housing 18 or rotatable drive element extension 182 after installation. Locking-screw 184 prevents the motor housing 18 or the rotatable drive element extension 182 from falling out of bracket 16. In this way, the end 168 of rotatable drive element 12 connected to the motor housing 18 is identified as the motor-side; whereas the end 168 of rotatable drive element 12 connected to the rotatable drive element extension 182 is identified as the non-motor side.

Idler Attachment Elements:

Idler attachment elements 186 are connected to and positioned around rotatable drive element 12. Idler attachment elements 186 are formed of any suitable size and shape. In one arrangement, as is shown, idler attachment elements 186 are formed of a circular hoop member 188 which is sized and shaped to fit loosely around rotatable drive element 12. In one arrangement, a mounting ring 190 is connected to the circular hoop member 188 for attachment of shade material 192 which hangs down from idler attachment elements 186 and drive attachment elements 194.

Drive Attachment Elements:

Drive attachment elements 194, like idler attachment elements 186 are connected to and positioned around rotatable drive element 12. A single drive attachment element 194 is positioned outside of, or at the end of the row of idler attachment elements 186. Drive attachment element 194 is formed of any suitable size, shape and design. In one arrangement, as is shown, drive attachment element 194 has a generally circular shape, fits over, and receives rotatable drive element 12 with at least one tooth configured to engage the guide structure 14 such that when the rotatable drive element 12 rotates the drive attachment element 194 is driven along the length of rotatable drive element 12. In one arrangement the drive attachment element 194 is the inward most ring and is inward of all idler attachment elements 186. In another arrangement, the drive attachment element 194 is the second inward most ring and is inward of all but one idler attachment elements 186. This arrangement facilitates crushing the shade material at the center and helps to reduce the light gap present at the center. In another arrangement, the drive attachment element 194 is the second inward most ring and the inward most ring is a partial drive attachment element 194, that, as one example, only has a single tooth therein and both guides along the guide structure in the rotatable drive element 12 as well as allows for jumping out of the groove to facilitate a crush at the center, as is described immediately above.

The idler attachment elements 186 and the driver attachment elements 194 are more fully described in applicant's related patent applications which are fully incorporated by reference herein along with any related patent applications.

Assembly:

The architectural covering 10 is assembled by connecting the opposing rotatable drive elements 12 by fully inserting the elongated hollow tubular members 174 of center coupler 172 into the open end 168 of each rotatable drive element 12 until each bearing 178 is adjacent the end 168 of rotatable drive element 12. Bearing assembly 176 may or may not be connected to a mounting member 24 of a center bracket 16 to provide additional support at the middle of combined rotatable drive element 12. In addition, motor coupler sleeves 160 are fully inserted in the open outward ends 168 of rotatable drive elements 12 until collar 170 engages the end 168 of each rotatable drive element 12.

Once the two rotatable drive elements 12 are combined and assembled, the location of the non-motor side bracket 16 of the architectural covering 10 is established by aligning the center of center coupler 172 with the center of the window or other structure architectural covering 10 is intended to cover. Alternatively, by the location of the bracket 16 of the non-motor end of the architectural covering 10 is established by measuring from the center of the desired application outwardly based on the length of the rotatable drive element 12. Once the location of bracket 16 of the non-motor end of the architectural covering 10 is located, the rotatable drive element 12 is removed and the non-motor side bracket 16 is installed with a fastener 62 inserted through the through holes 60, 62.

Once the non-motor side bracket 16 is installed, using the combined rotatable drive element 12 as a guide, the location of the motor-side bracket 16 is established. This is accomplished by inserting the end 168 of the non-motor side of drive element 12 into the recess of the interior side 28 of non-motor side bracket 16. Next, the recess of the interior side 28 of motor-side bracket 16 is installed over the motor-side end of rotatable drive element 12. In this way the position of the motor-side bracket 16 is located and the rotatable drive element 12 is removed to allow for installation of the second bracket 16.

Once the location of the motor-side bracket 16 is established, a fastener 62 is inserted into the lower through hole 60 of mounting plate 20, also known as the cantilever hole. Once the lower fastener 62 is inserted into the second bracket 16, the bracket 16 can rotate or cantilever thereon. Next, the non-motor end 168 of rotatable drive element 12 is again inserted into the non-motor side bracket 16. Next, the motor-side end of the rotatable drive element 12 is aligned with and inserted into the mounting member 24 of motor-side bracket 16 by rotating bracket 16 upon fastener 62. Once the motor-side bracket 16 is aligned with the rotatable drive element 12, the second fastener 62 is fastened into through hole 58 and thereby the installation of the opposing brackets 16 is complete.

Next the motor housing 18 and rotatable drive element extension 182 are connected to the exterior sides 26 of mounting members 24 of brackets 16. This is accomplished by aligning the key features 94 in the motor housing 18 and rotatable drive element extension 182 with the key features 42 of brackets 16. Once aligned, the motor housing 18 and rotatable drive element extension 182 are forced into tight frictional engagement with brackets 16 with the key-features 42, 94 in mating alignment and engagement with one another. In this position, the electrical contacts 98 of motor housing 18 are in electrical engagement with the electrical contacts 48 of motor-side bracket 16. Once the motor housing 18 and rotatable drive element extension 182 are fully inserted into or onto brackets 16, locking-screw 184 is tightened thereby ensuring motor housing 18 and rotatable drive element extension 182 do not accidently separate from bracket 16.

Next, battery tube assembly 136 is installed by fastening battery tube mounting bracket 150 to a wall, ceiling or other structure, preferably behind the stack of shade material adjacent the motor-side bracket 16. Once the bracket 150 is installed, the elongated tube 138 is forced into the bracket 150 and the plug 148 is engaged into the socket assembly 64 thereby electrically connecting the power of batteries 140 to the components of motor housing 18.

Figure 2:
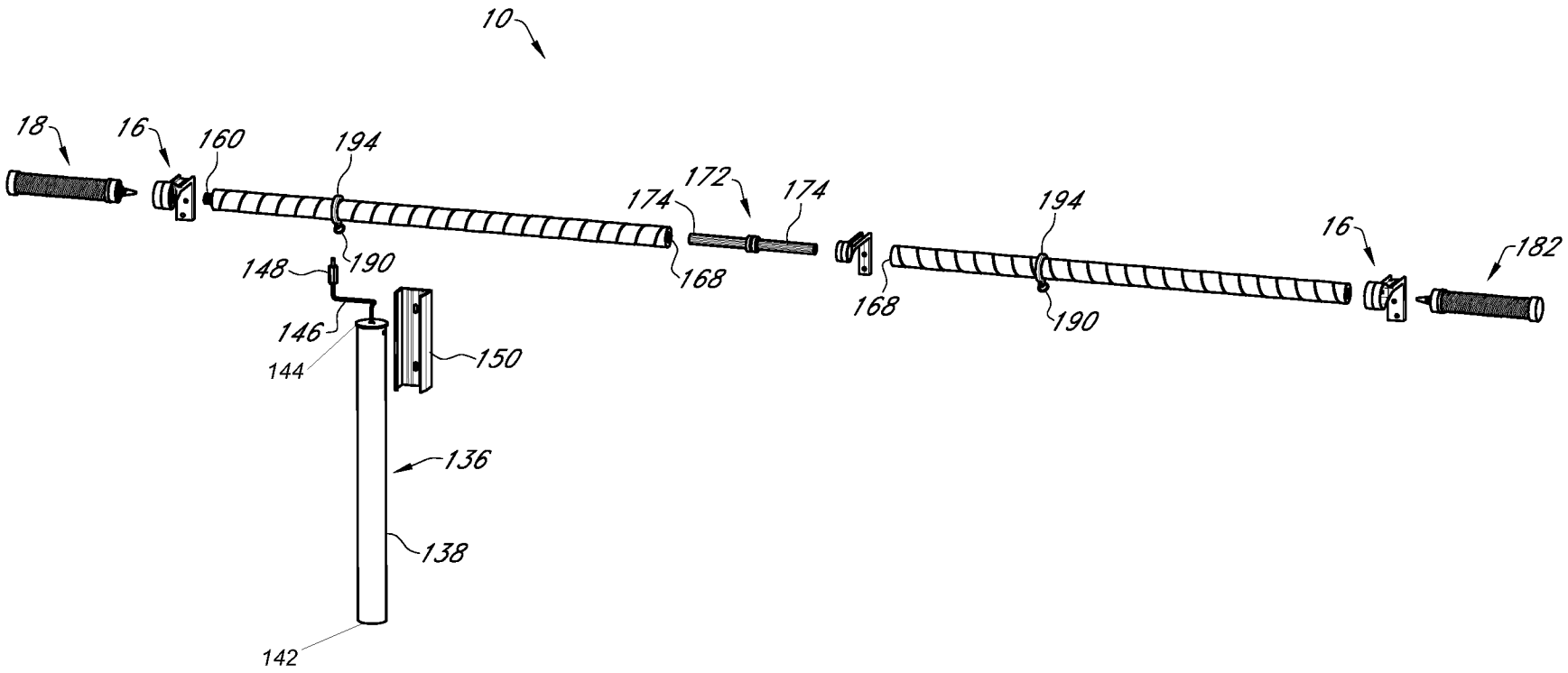
FIG. 2 is a perspective exploded view of the elements shown in FIG. 1.
Figure 3:
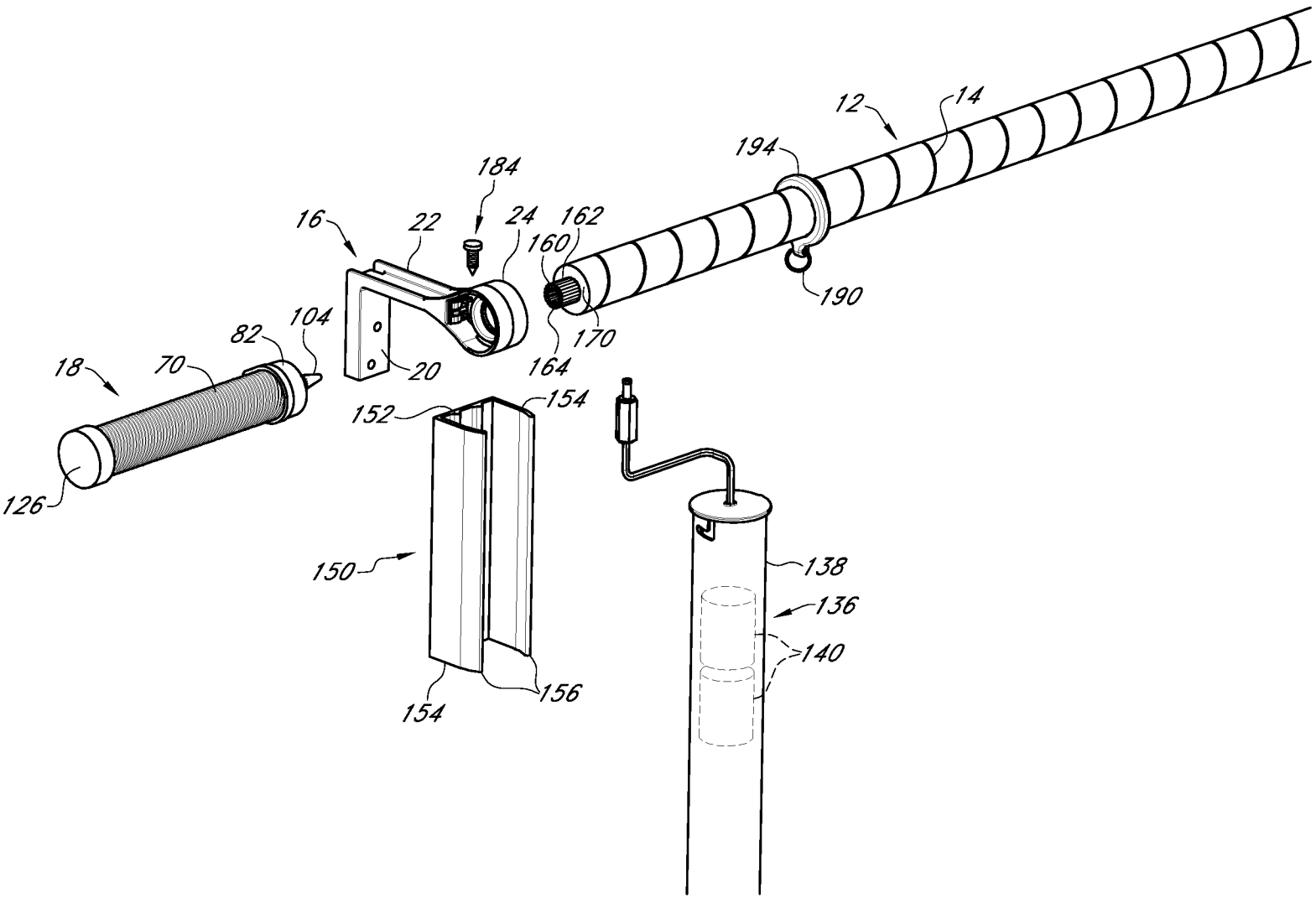
FIG. 3 is a close-up perspective exploded view of FIG. 2 showing the motor housing, bracket having a key feature and electrical contacts, a motor coupler sleeve positioned within the outward end of the rotatable drive element.
Figure 4:
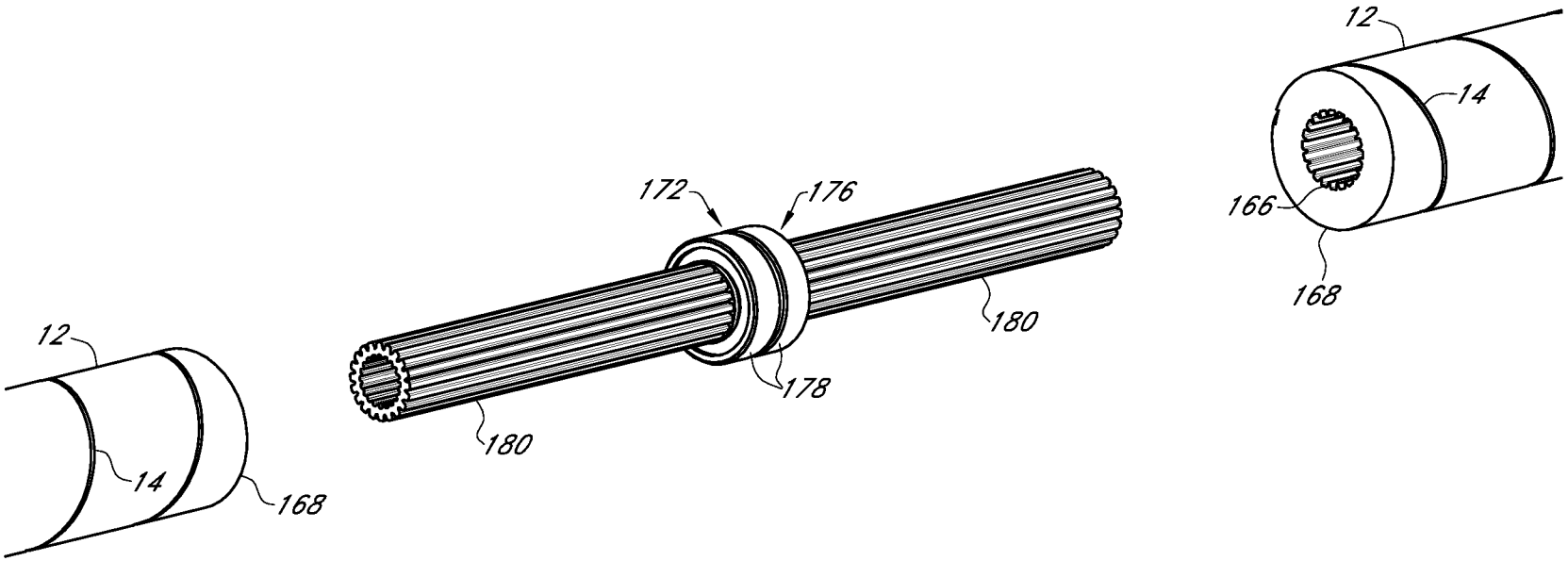
FIG. 4 is a close-up perspective exploded view of FIG. 2 showing the center coupler and the ends of rotatable drive elements.
Figure 5:
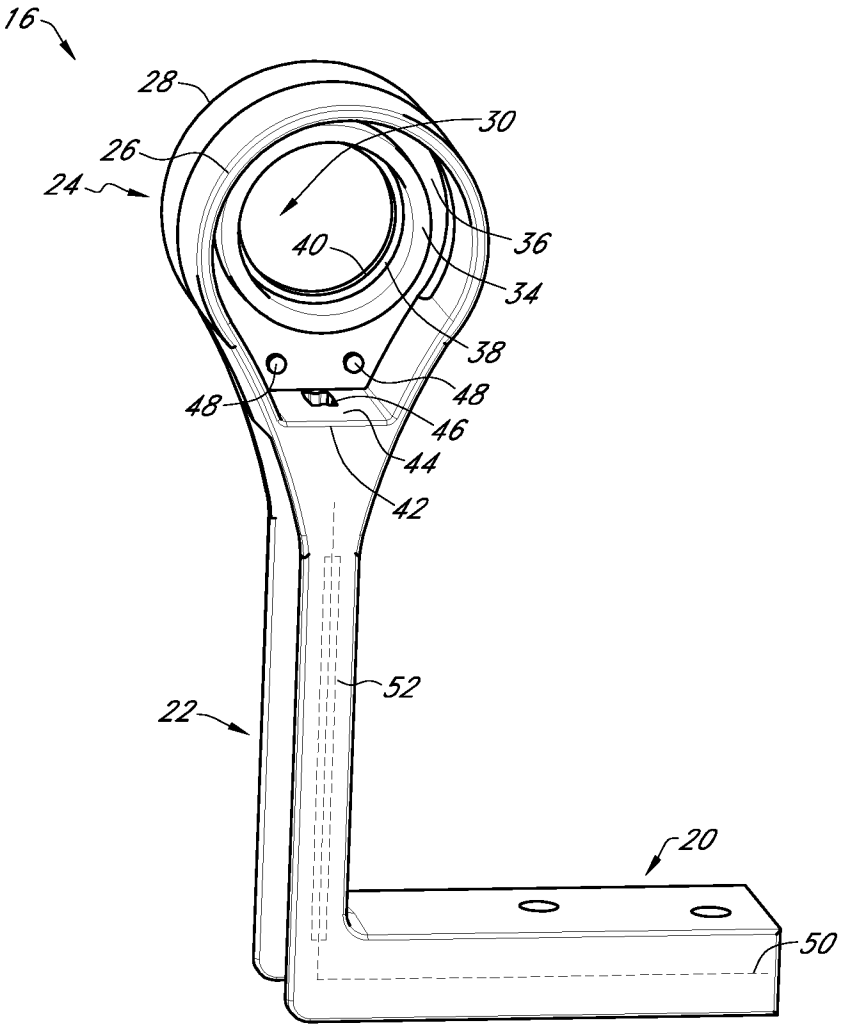
FIG. 5 is a close-up perspective view of a bracket which connects a motor housing to a rotatable drive element, the view showing the side which engages a motor housing, the view showing the key feature and the electrical contacts.
Figure 6:
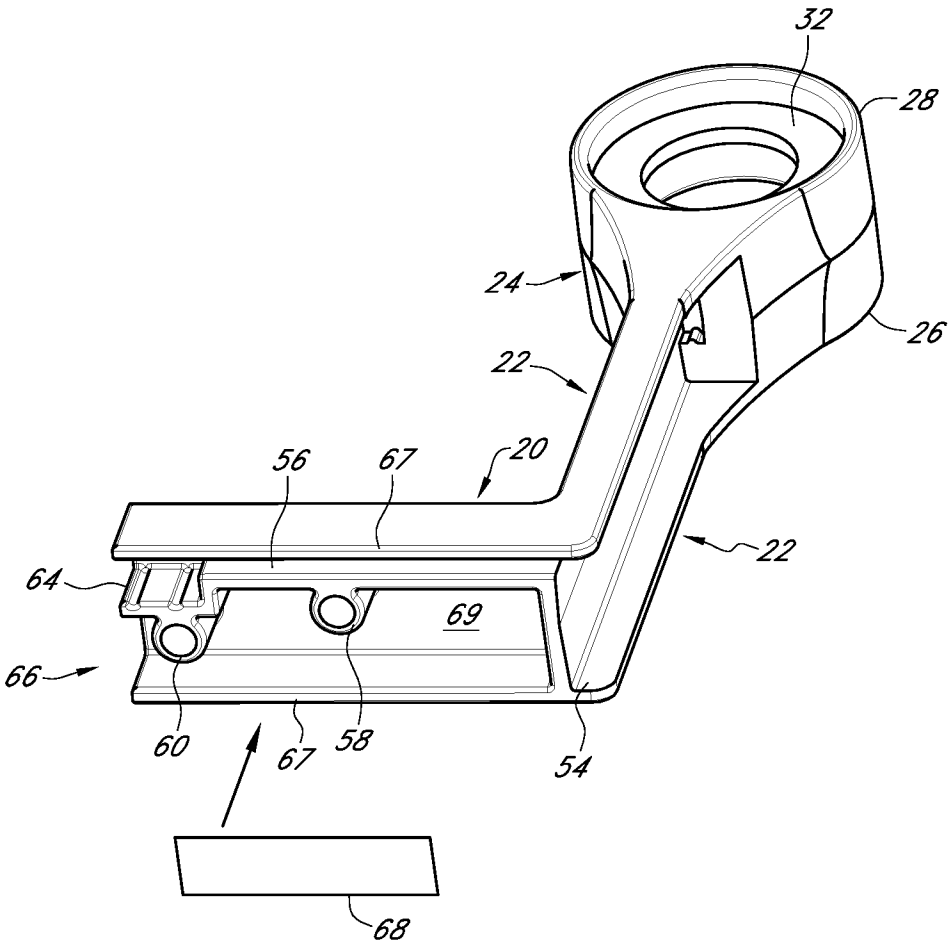
FIG. 6 is a close-up perspective view of a bracket which connects a motor housing to a rotatable drive element, the view showing the side of the bracket which engages a rotatable drive element, the view also showing the electrical socket and passageway, as well as a cavity which provides a spot for mounting and housing electronics for controlling the motor housing.
Figure 7:
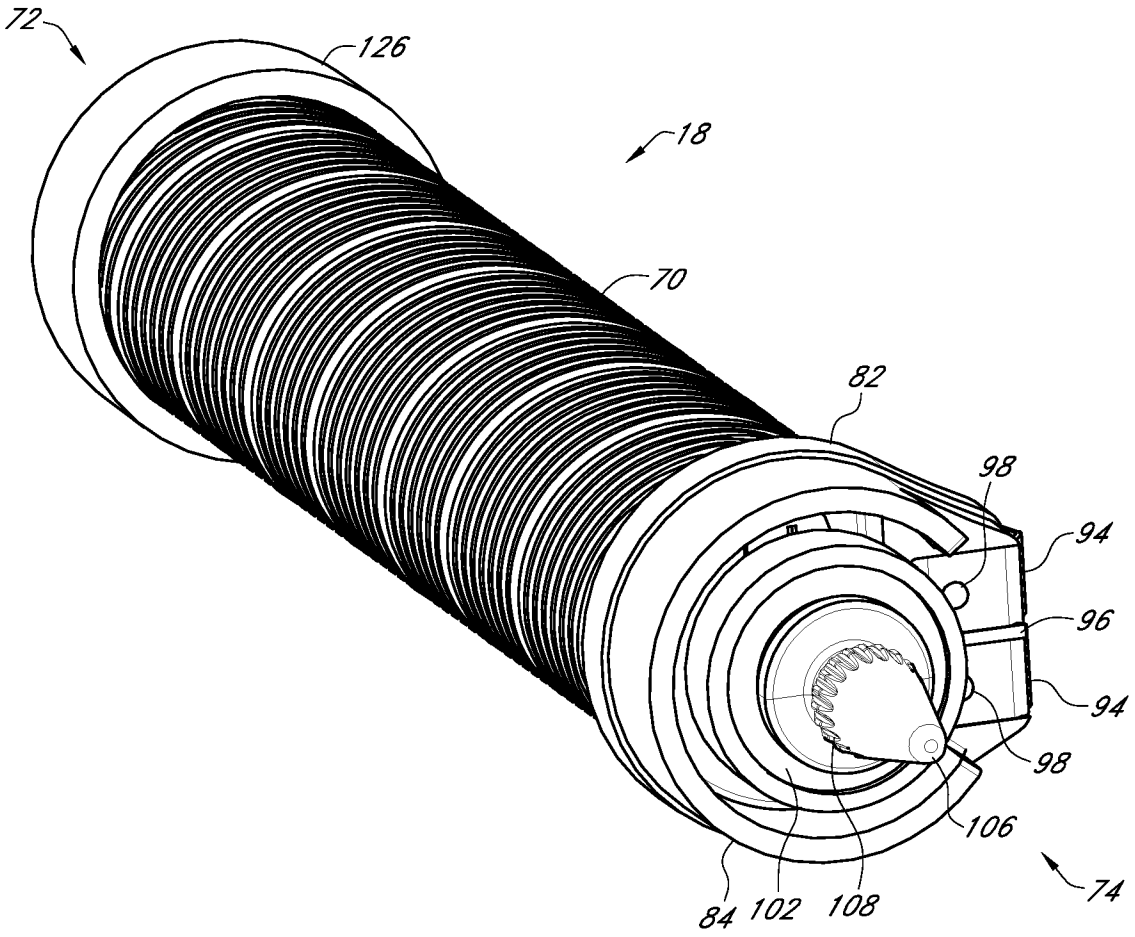
FIG. 7 is a close up perspective exploded view of a motor housing showing a threaded surface structure, an exterior end cap, a bearing a motor coupler a motor end cap and a key feature having electrical contacts.
Figure 8:
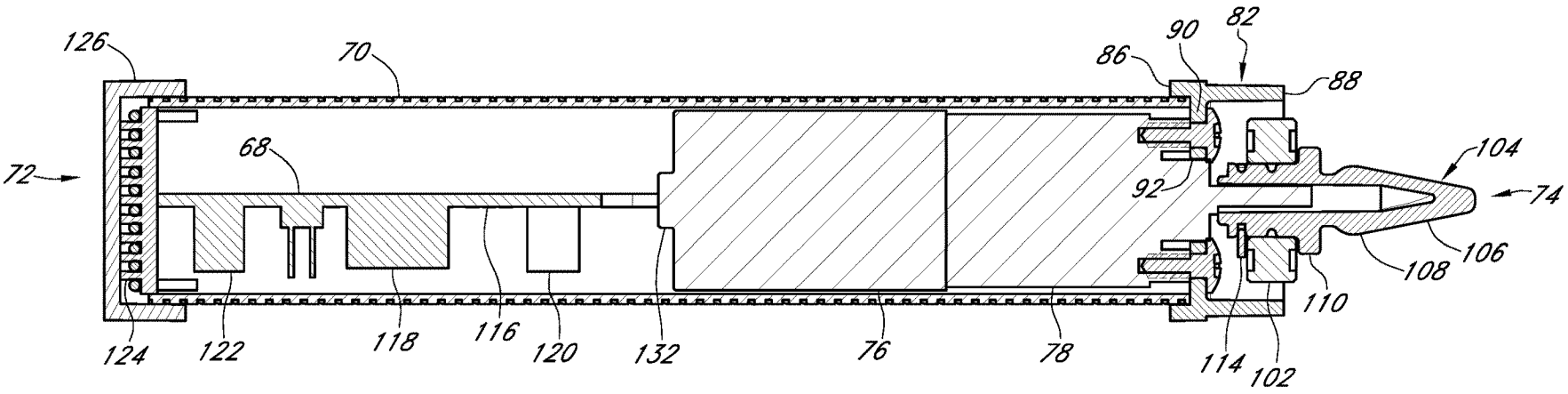
FIG. 8 is side elevation cut-away view of the motor housing shown in FIG. 7, the view showing the motor coupler, bearing, planetary gear box, electrical motor, sensor assembly, motor controller assembly, and antenna.
Figure 9:
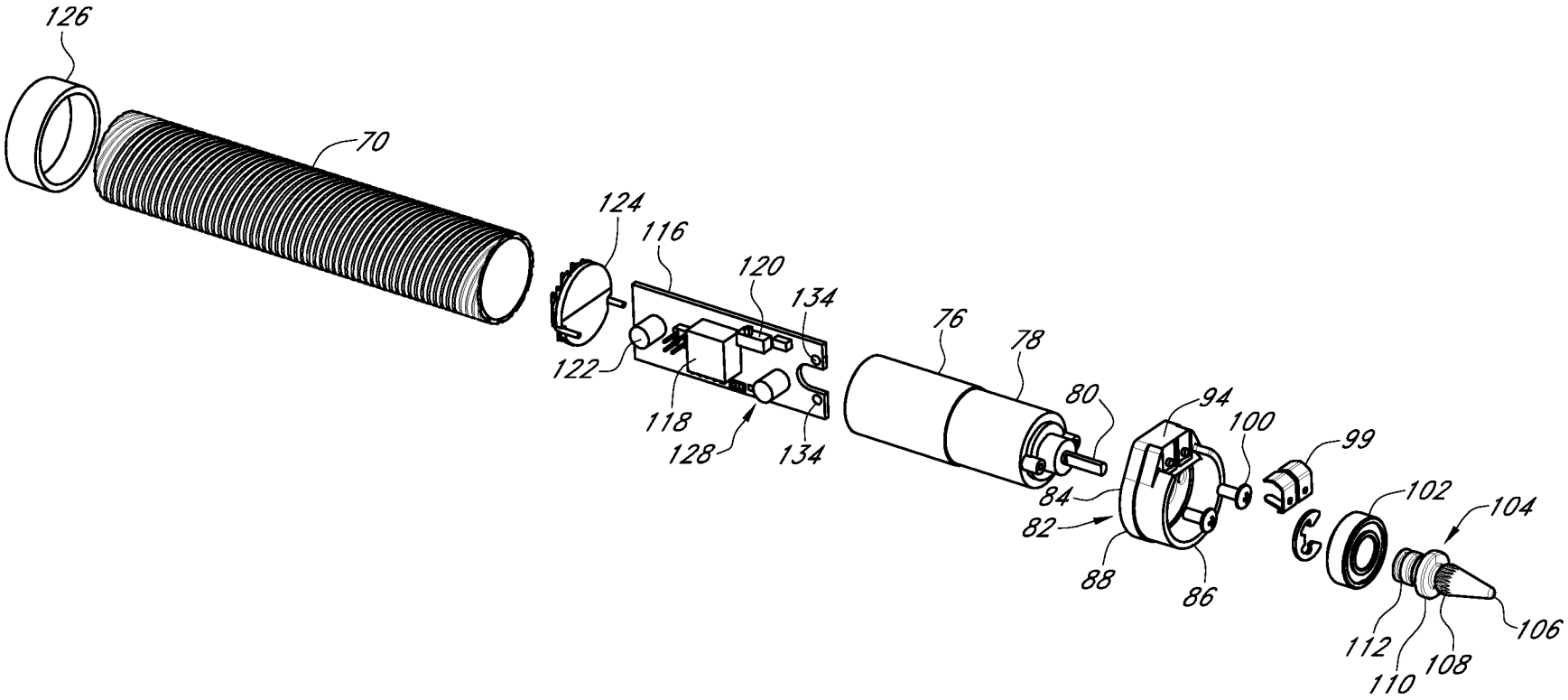
FIG. 9 is an exploded perspective view of the motor housing shown in FIG. 7, the view showing the motor coupler, bearing, planetary gear box, electrical motor, sensor assembly, motor controller assembly, antenna motor end cap and exterior end cap.
Figure 10:
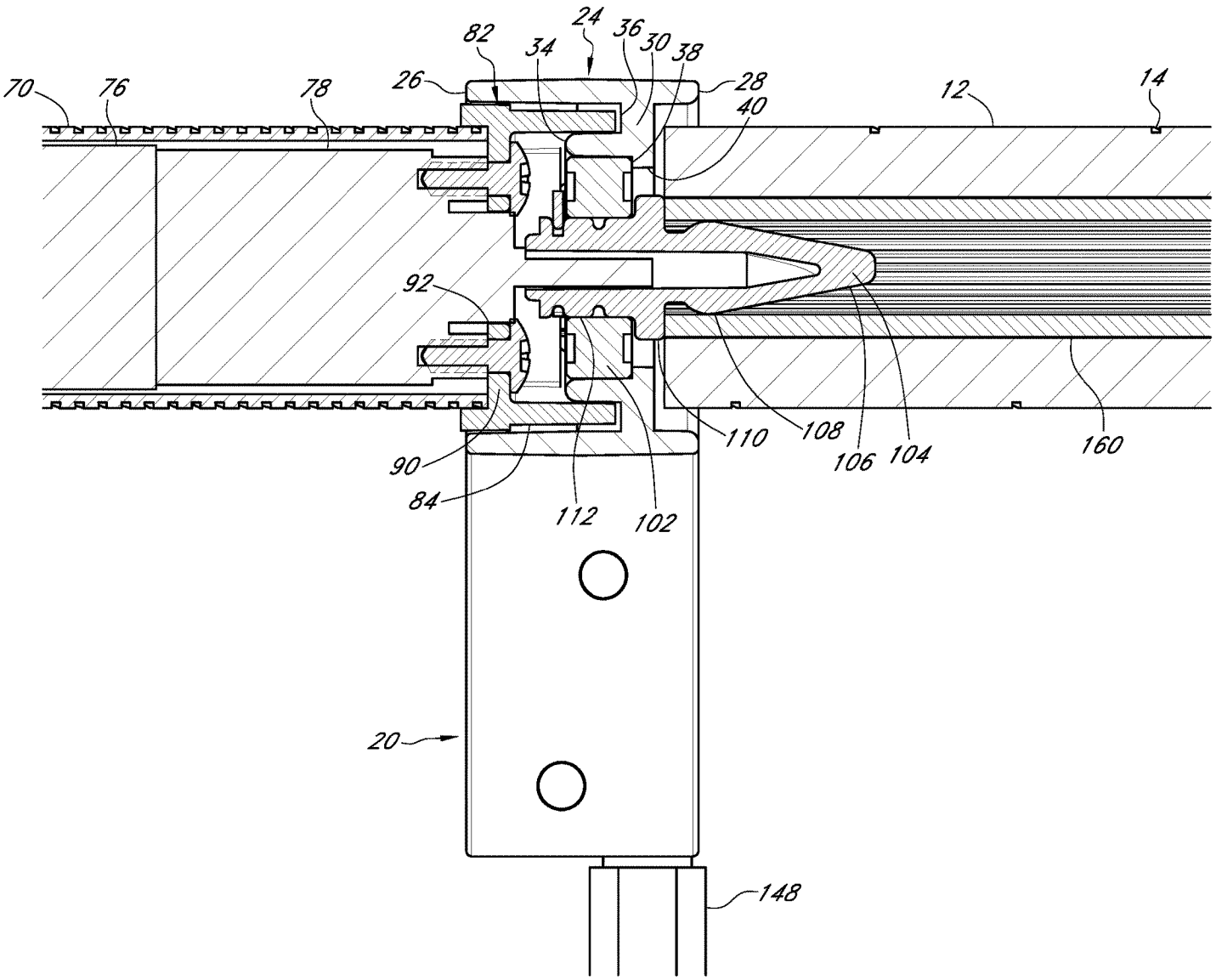
FIG. 10 is side elevation cut-away view of the motor housing shown in FIG. 7 connected to a rotatable drive element through a motor bracket, the view showing the motor coupler, bearing, planetary gear box, electrical motor, electrical plug and rotatable drive element.
Figure 11:
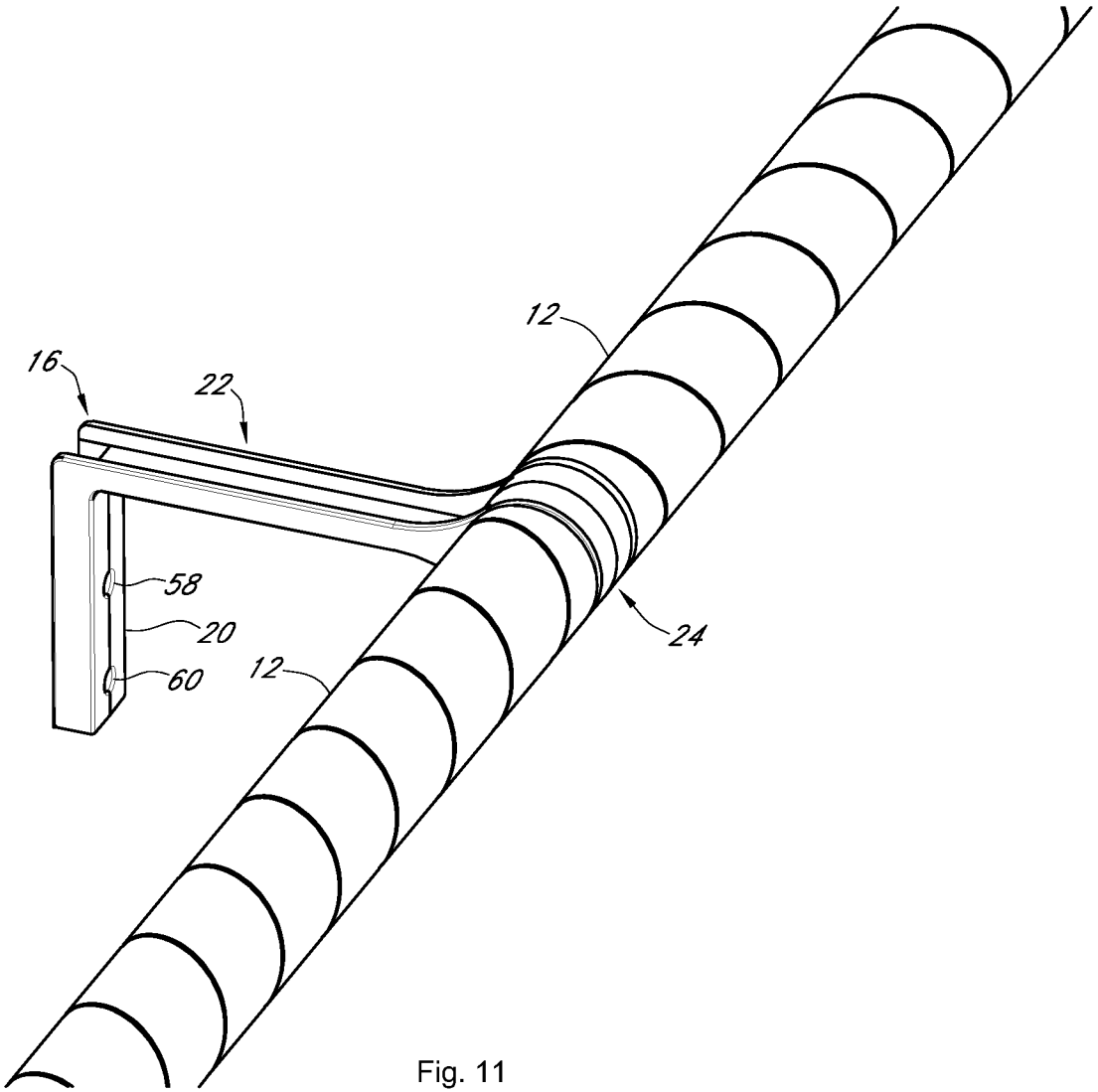
FIG. 11 is a perspective view of the rotatable drive elements connected together at a center bracket, the center coupler being positioned within the bracket and the open interior of the rotatable drive element.
Figure 12:
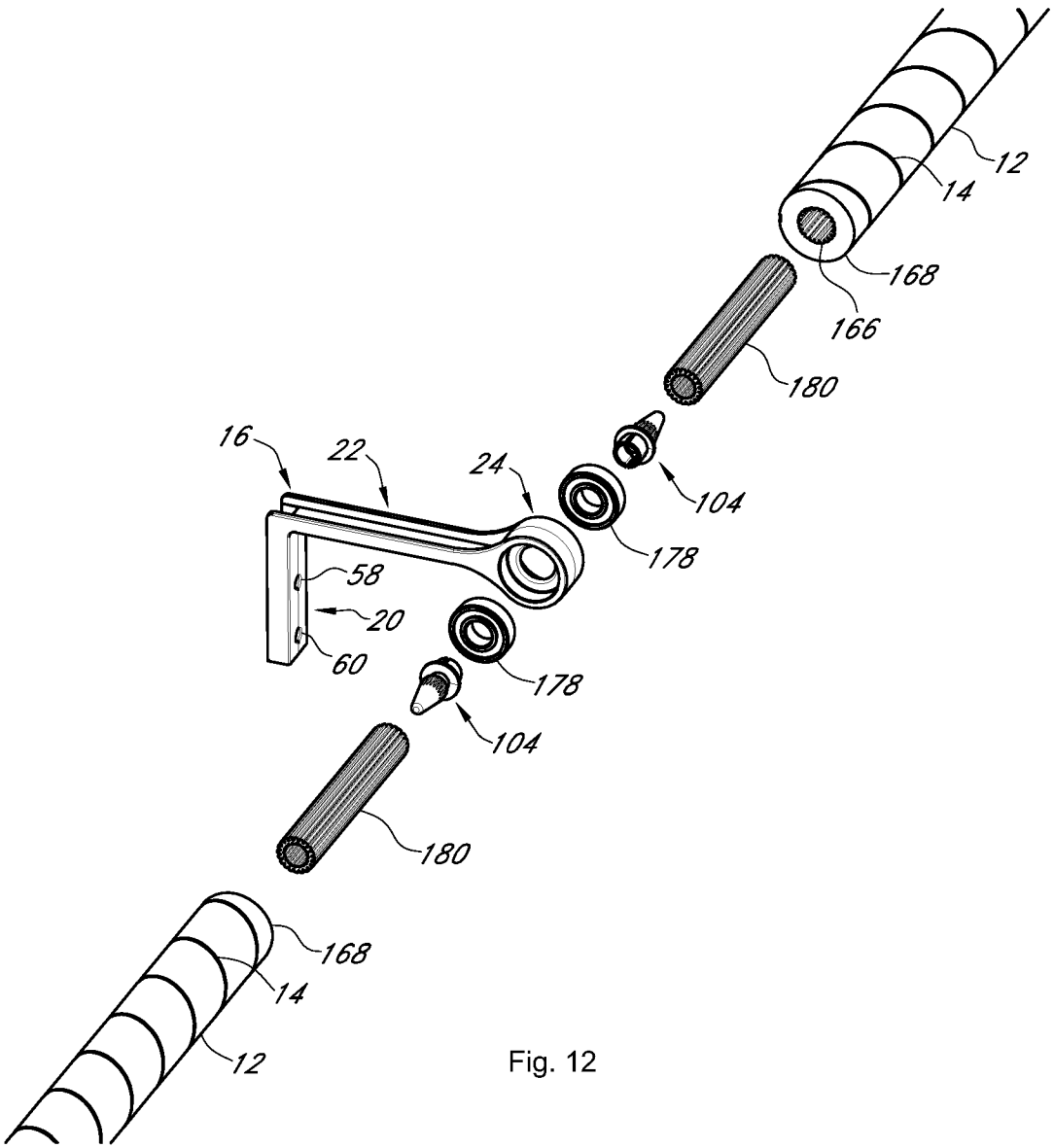
FIG. 12 is a perspective exploded view of FIG. 11.
Figure 13:
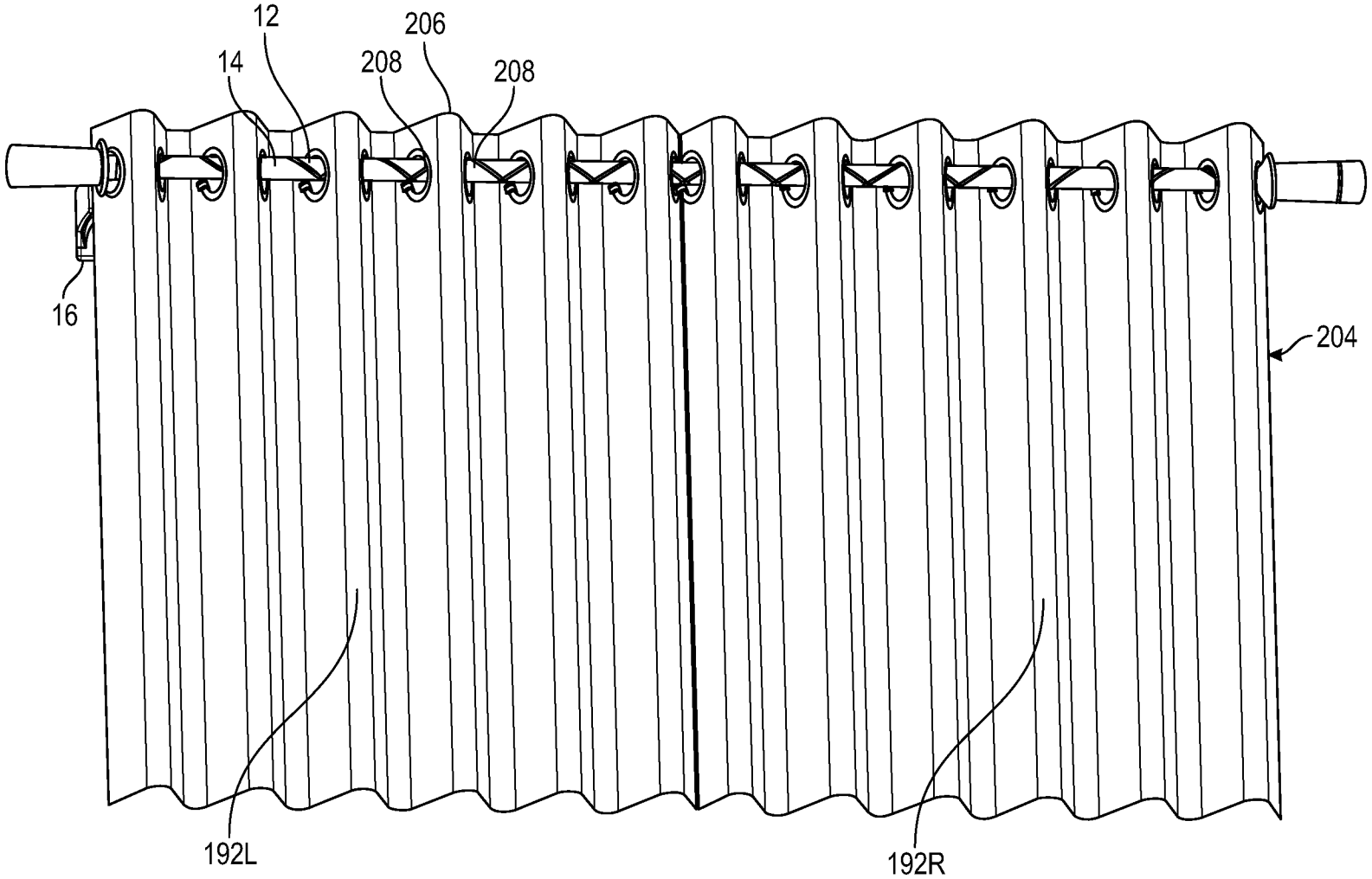
FIG. 13 is a front elevation view of a center opening and closing motorized grommet drapery apparatus, the view showing the grommets positioned over the rotatable drive element, the view showing the shade material in a fully closed position with a very slight light gap between the inward most edges of opposing left and right shade material.
Figure 14:
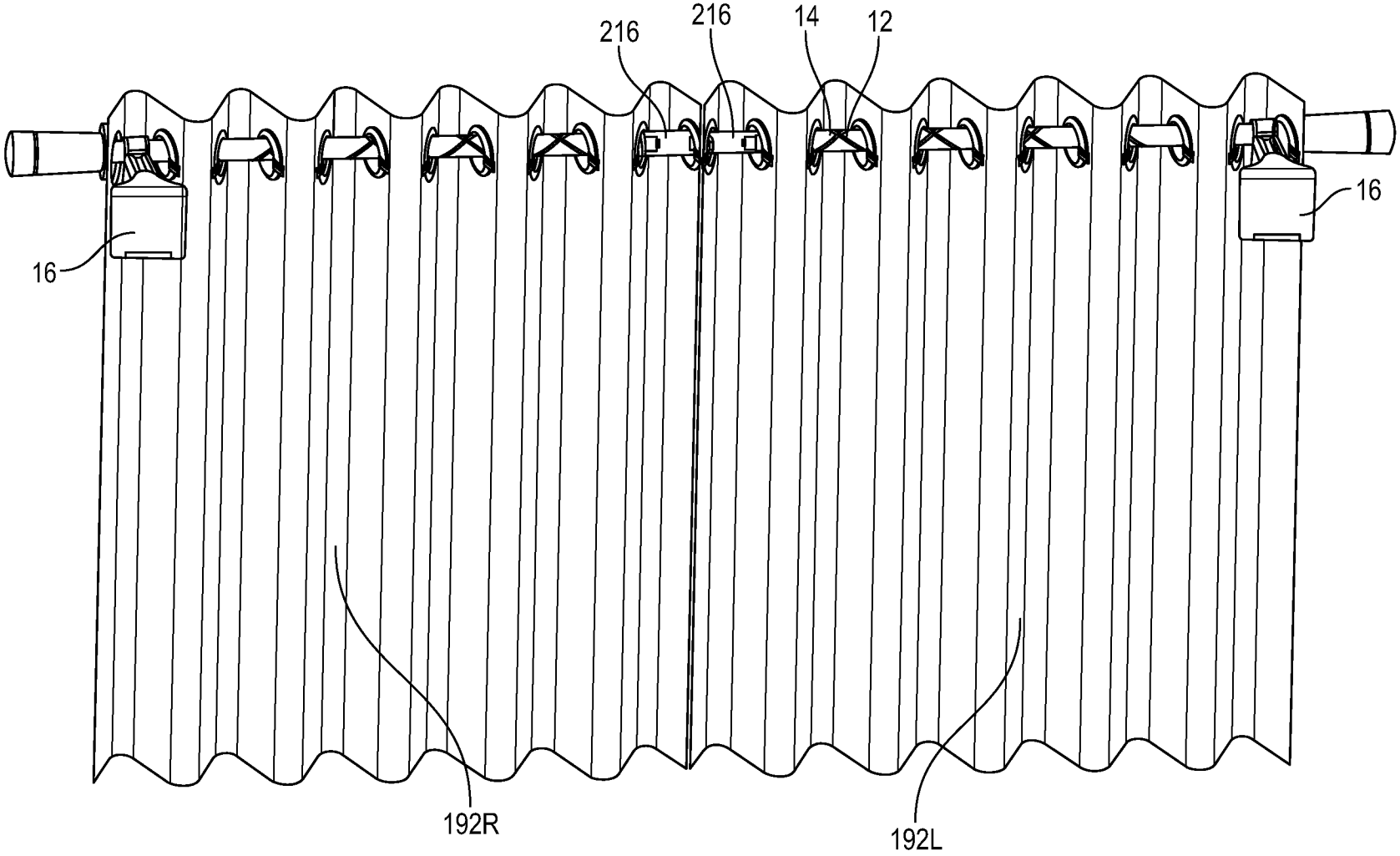
FIG. 14 is a rear view of FIG. 13, the view showing the grommet driver connected to the drive element and the inward most grommets.
Figure 15:
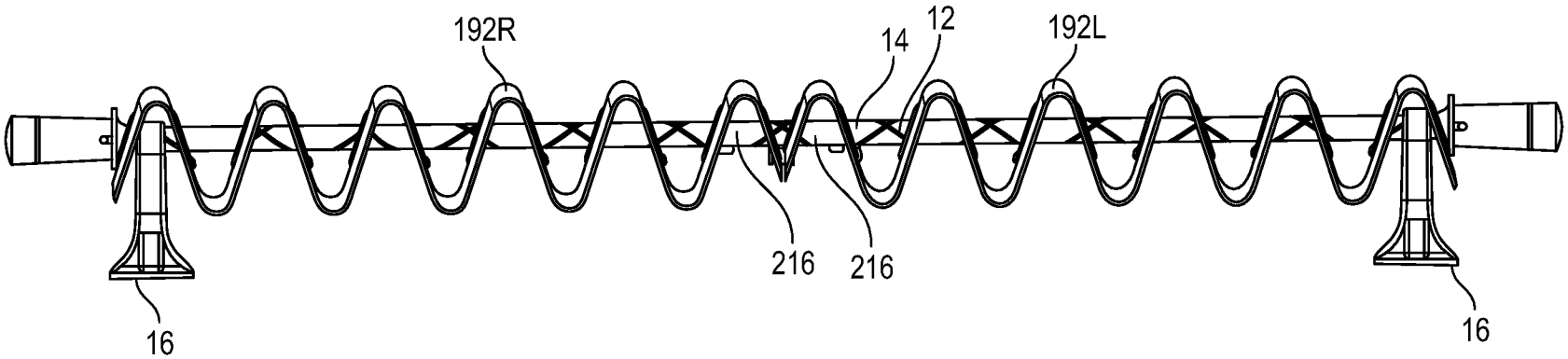
FIG. 15 is a top elevation view of the motorized grommet drapery apparatus shown in FIGS. 13 and 14.
Figure 16:
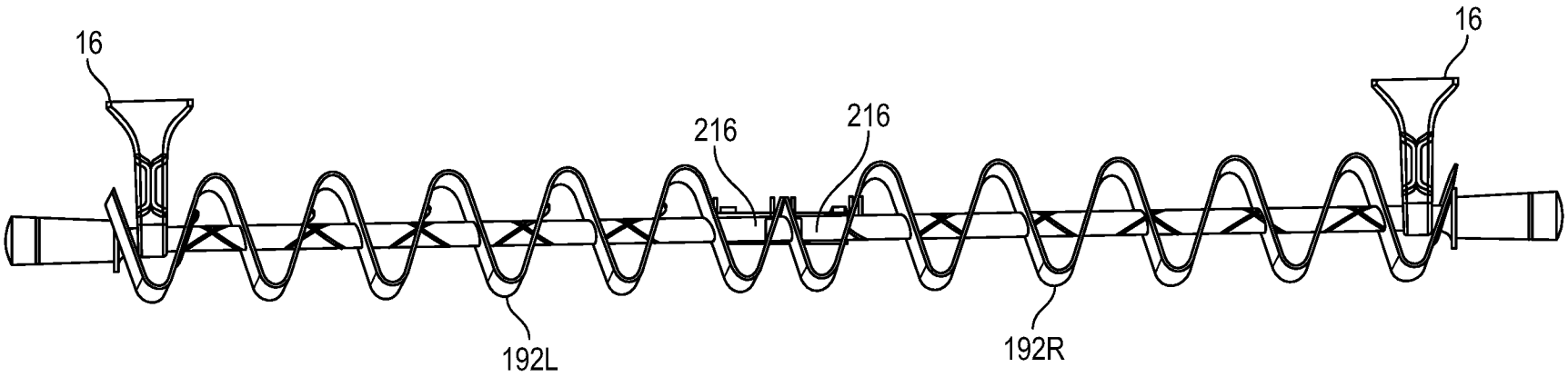
FIG. 16 is a bottom elevation view of the motorized grommet drapery apparatus shown in FIGS. 13-15.
Figure 17:
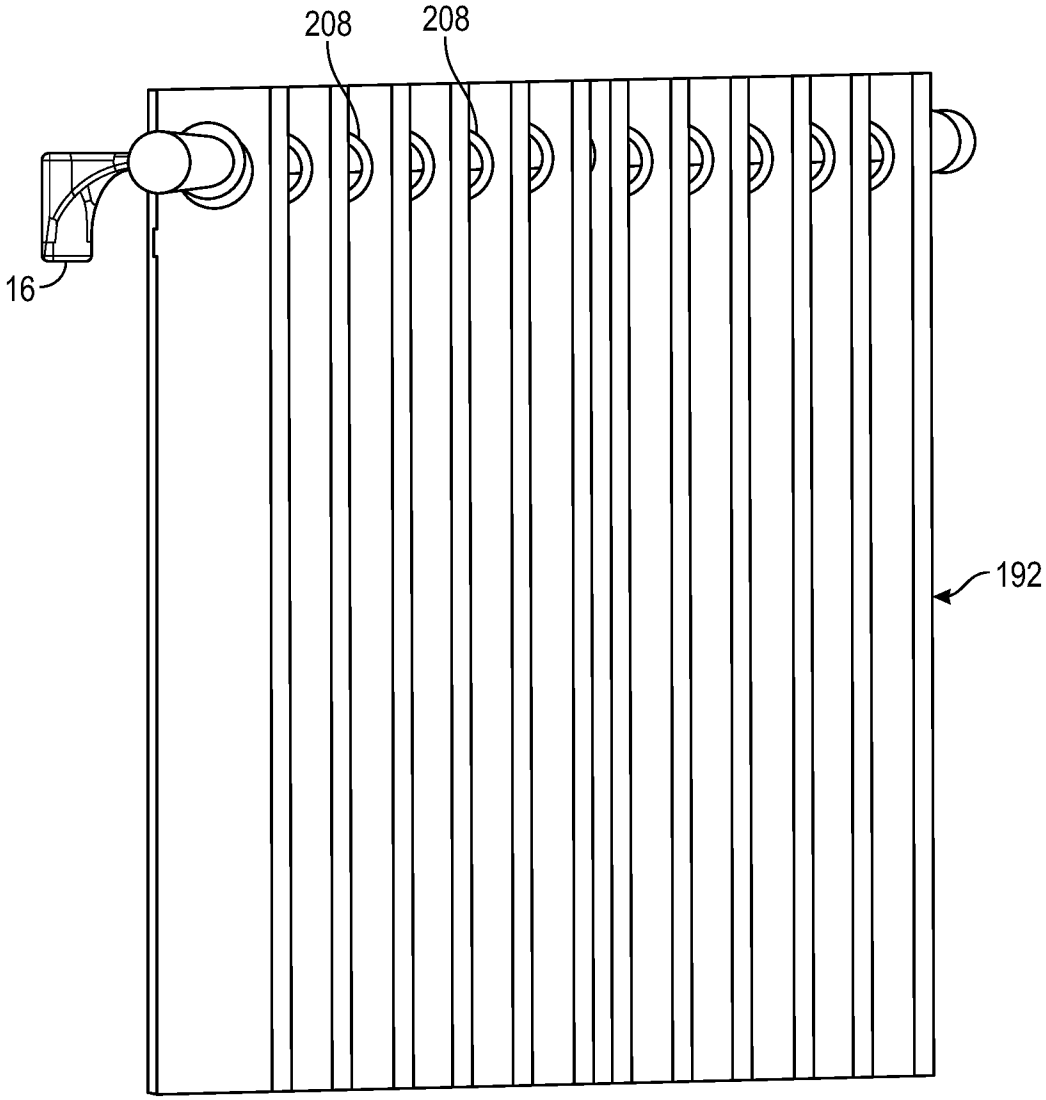
FIG. 17 is a perspective view of the motorized grommet drapery apparatus of FIGS. 13-16.
Figure 18:
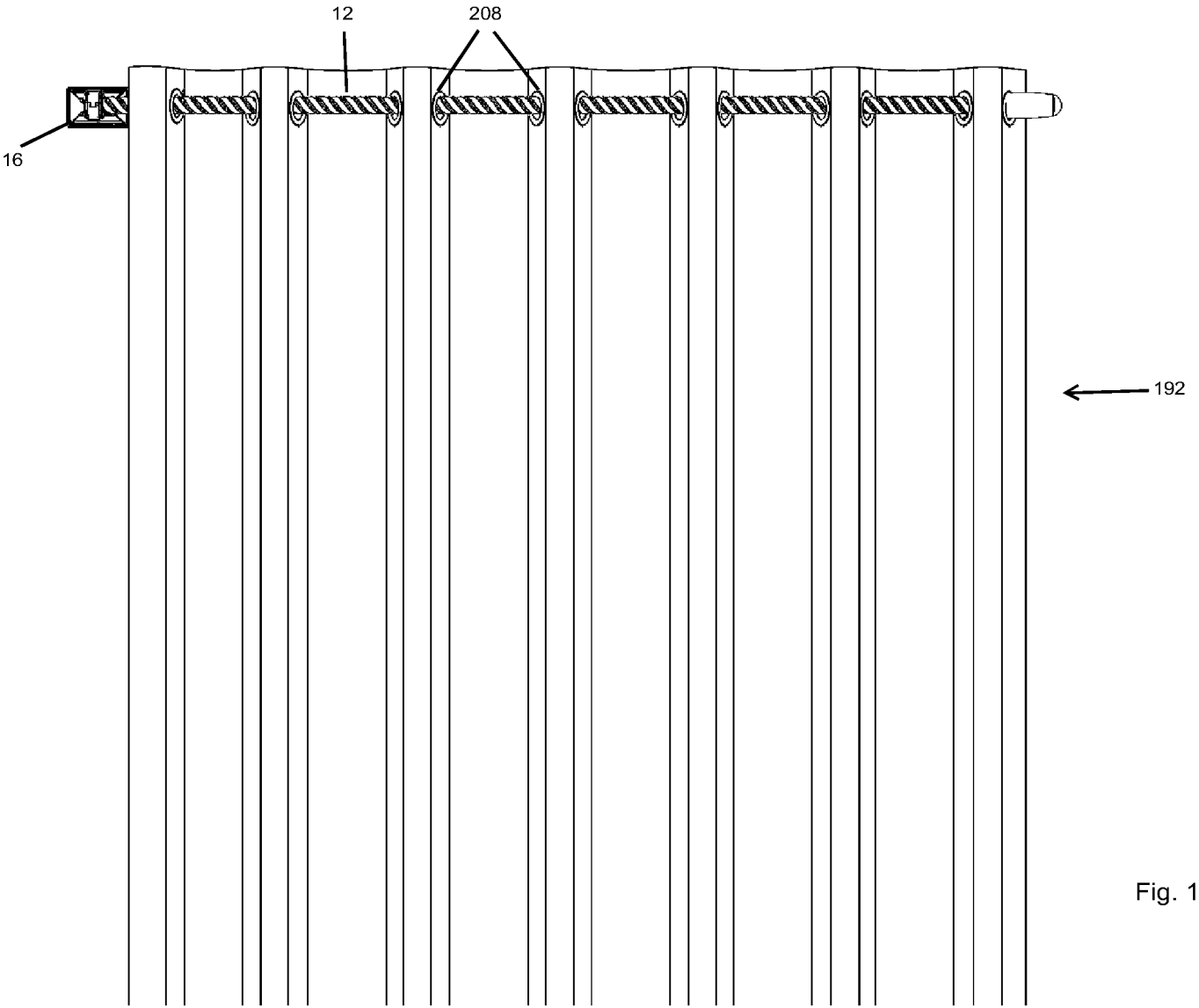
FIG. 18 is an elevation view of the motorized grommet drapery apparatus of FIGS. 13-17.
Figure 19:
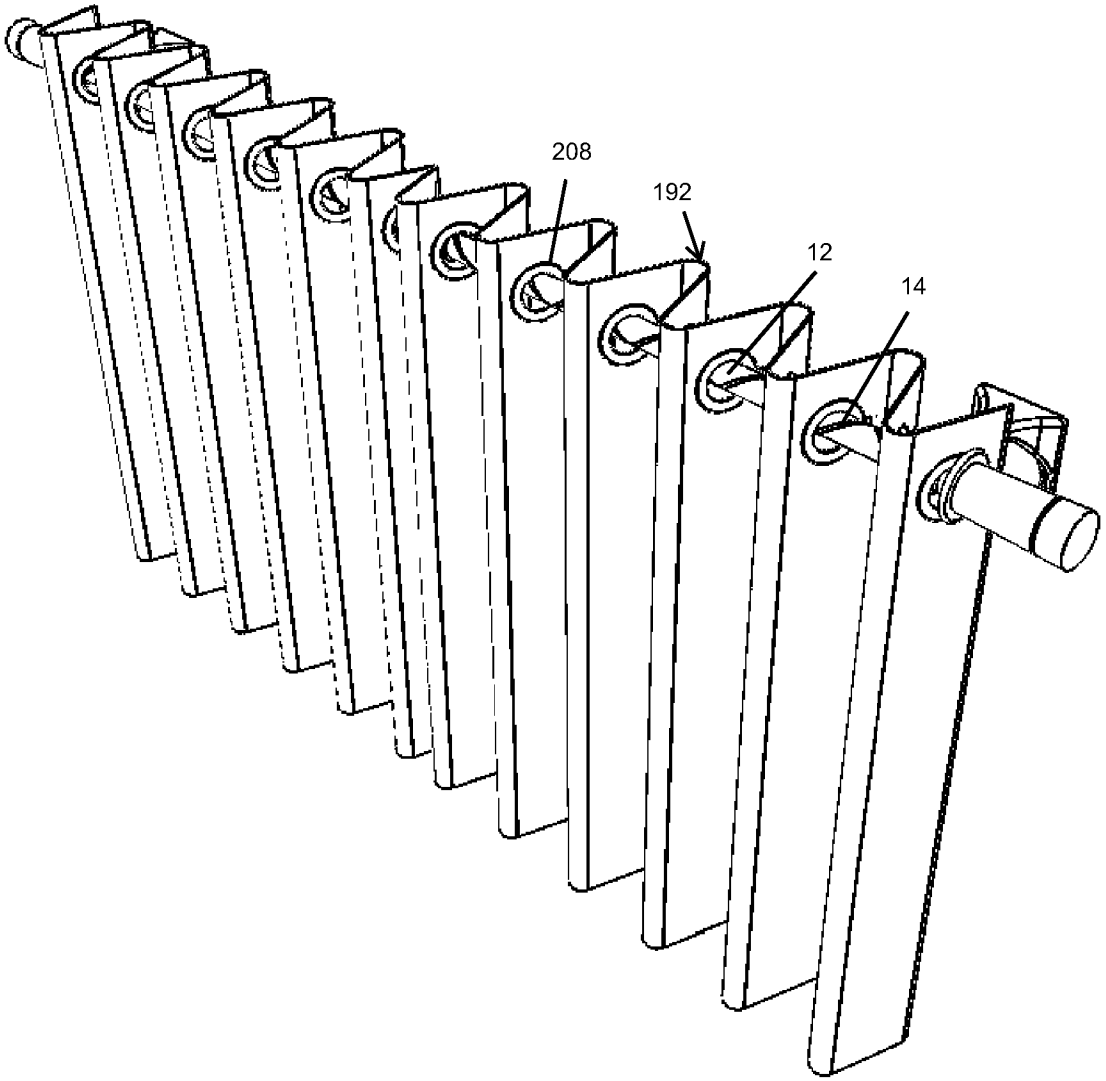
FIG. 19 is a perspective view of the motorized grommet drapery apparatus of FIGS. 13-18.
Figure 20:
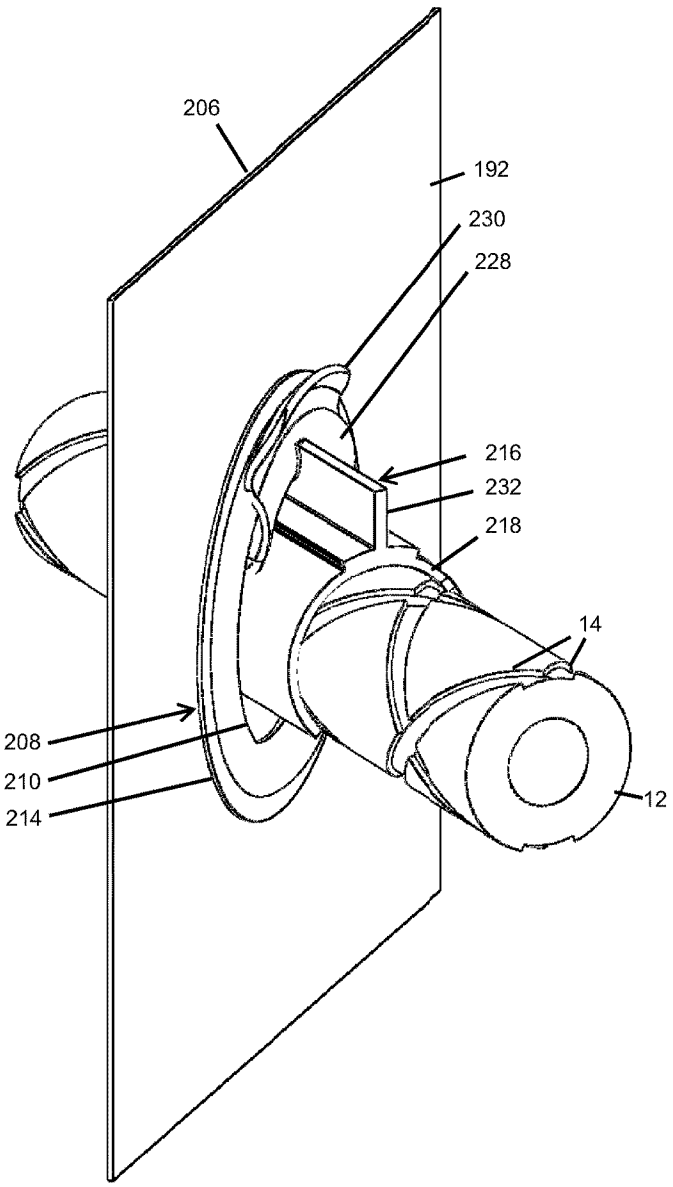
FIG. 20 is a close-up cut-away perspective view of the motorized grommet drapery apparatus of FIGS. 13-19, the view showing the grommets positioned in the grommet drapery driver which is positioned over the rotatable drive element, the view showing the shade material supported by and hanging down from the support rod, the view showing the a squared helical guide structure, or said another way, a guide structure that has a square profile when viewed from the side.
Figure 21:
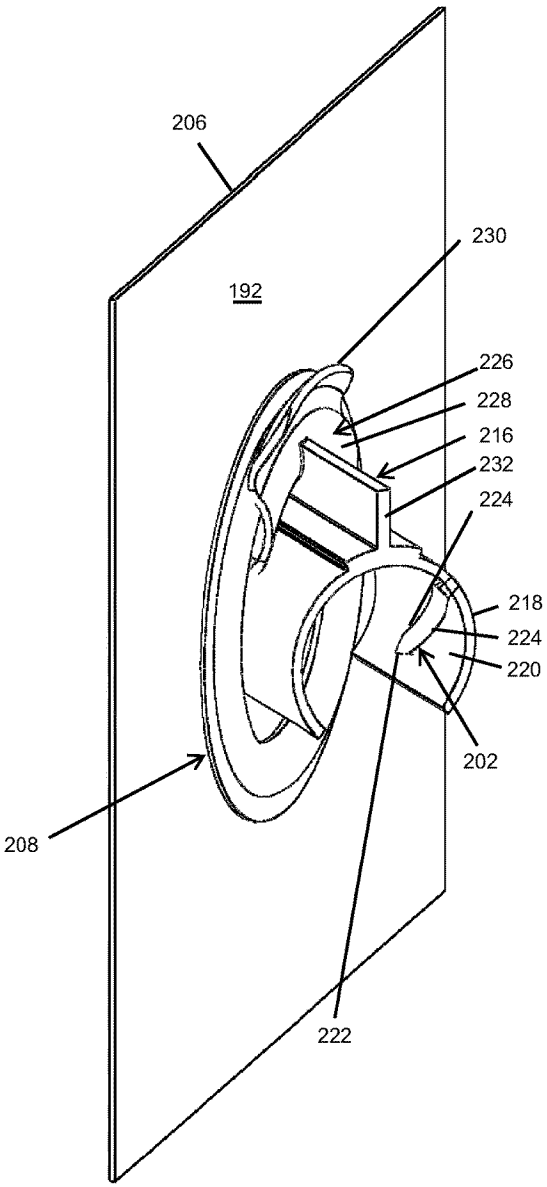
FIG. 21 is a close-up cut-away perspective view of the motorized grommet drapery apparatus of FIGS. 13-20 with the rotatable drive element removed, the view showing the interior surface of the grommet drapery driver including the driver tooth which engages the guide structure in the rotatable drive element.
Figure 22:
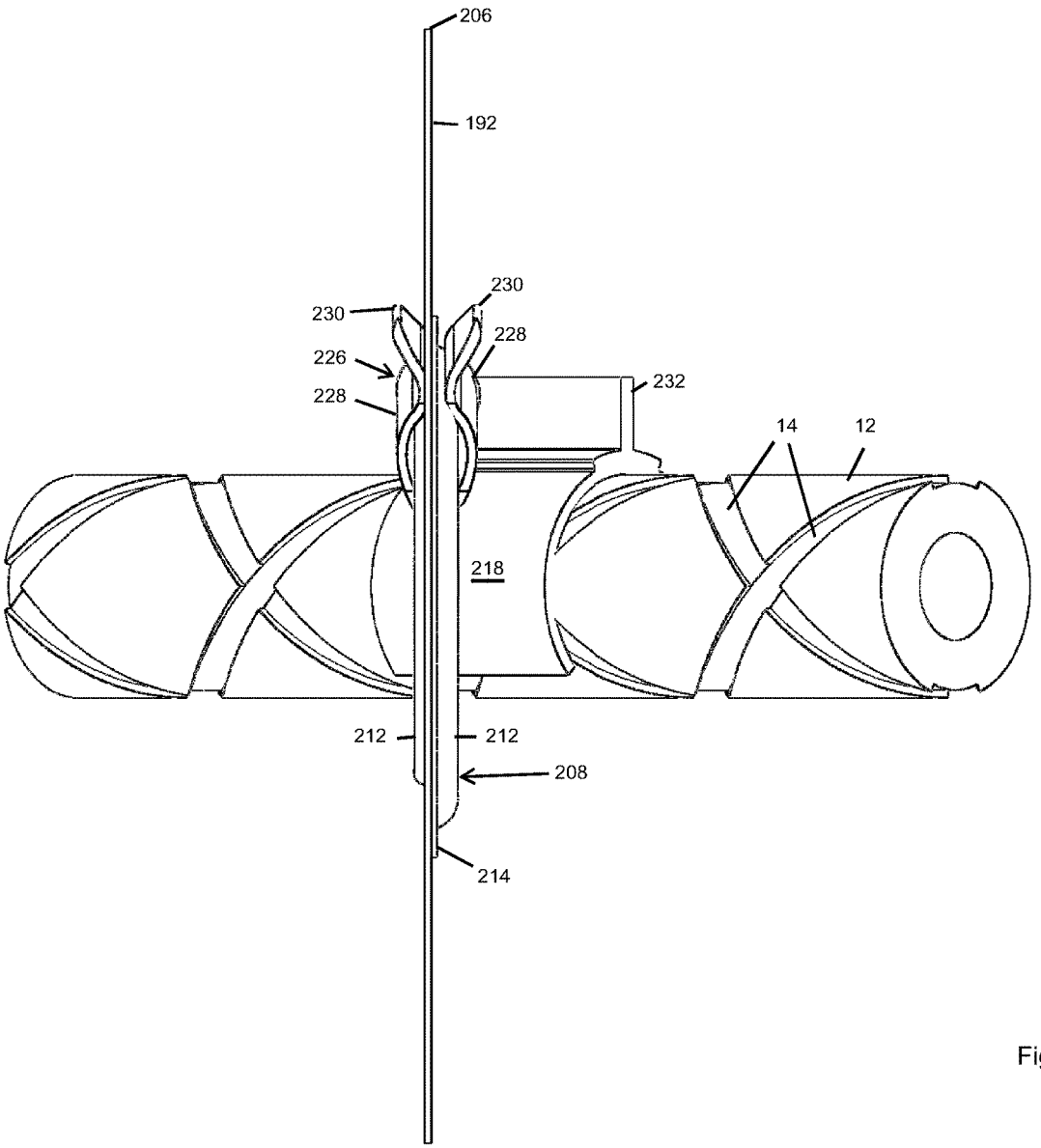
FIG. 22 is a close-up cut-away perspective view of the motorized grommet drapery apparatus of FIGS. 13-21 with the view being perpendicular to the shade material, the view showing the grommets positioned in the grommet drapery driver which is positioned over the rotatable drive element, the view showing the shade material supported by and hanging down from the support rod, the view showing the a squared helical guide structure, or said another way, a guide structure that has a square profile when viewed from the side.
Figure 23:
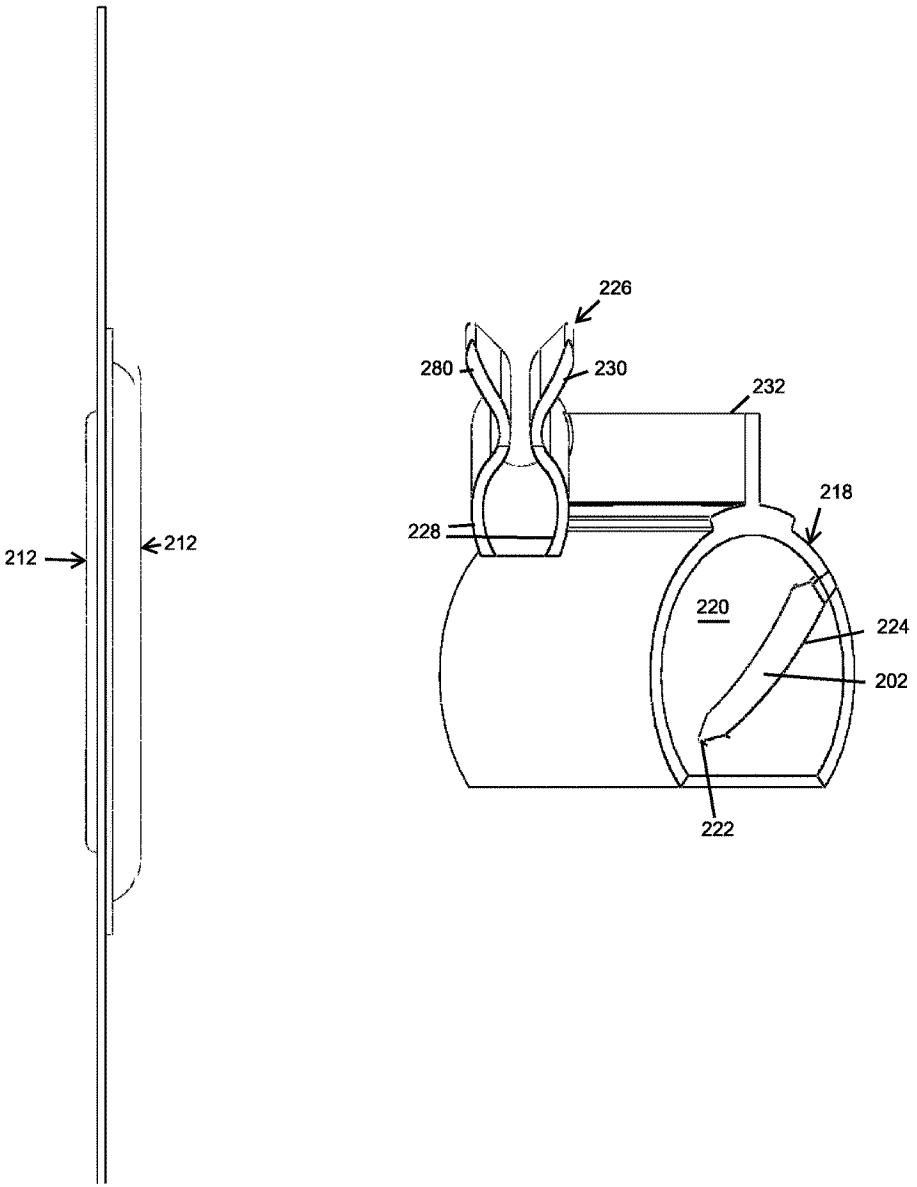
FIG. 23 is a close-up exploded perspective view of the motorized grommet drapery apparatus of FIGS. 13-22 with the view being perpendicular to the shade material, the view showing the grommet drapery driver positioned away from the grommet and the rotatable drive element removed.
Figure 24:
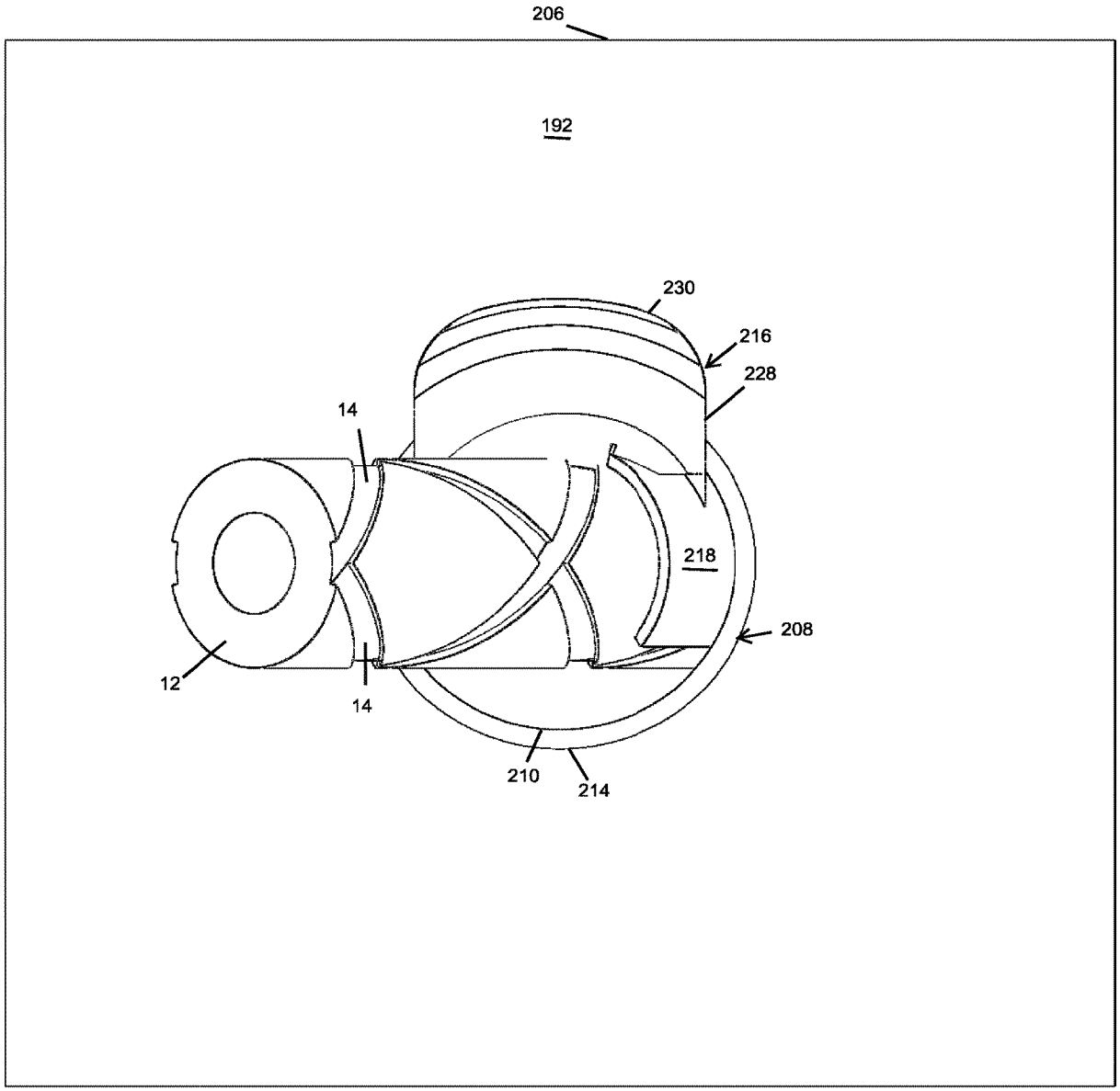
FIG. 24 is another perspective view angle of the FIGS. 20-23, the view being parallel to the shade material.
Figure 25:
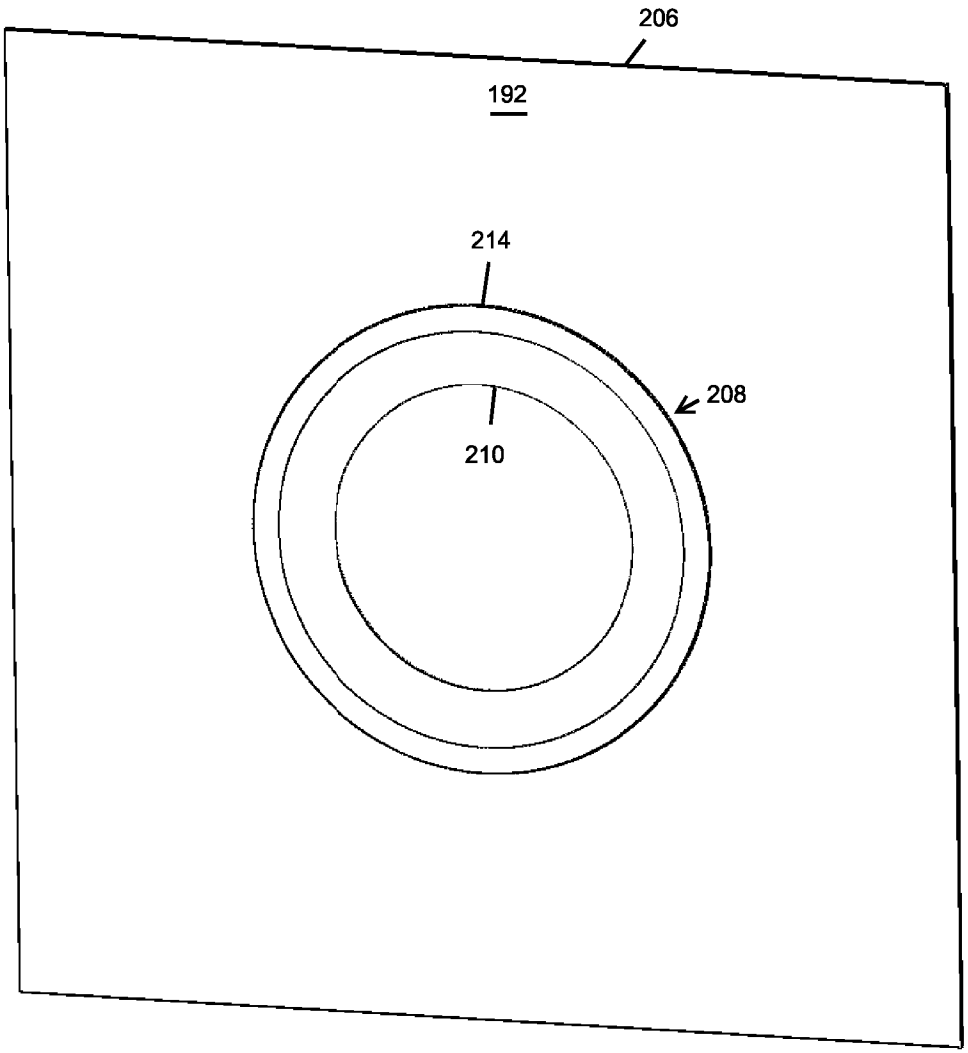
FIG. 25 is another perspective view angle of the FIG. 23, the view being parallel to the shade material.
Figure 25:
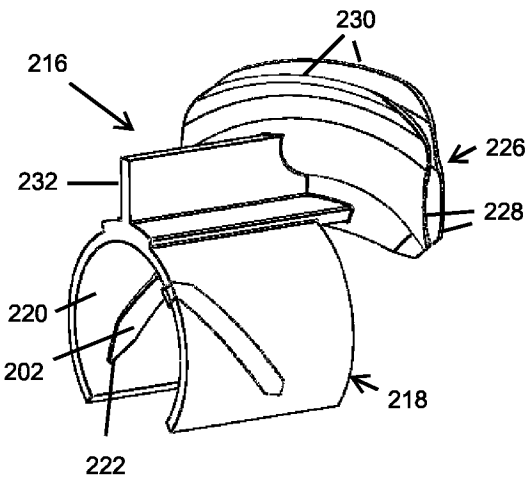
Figure 26:
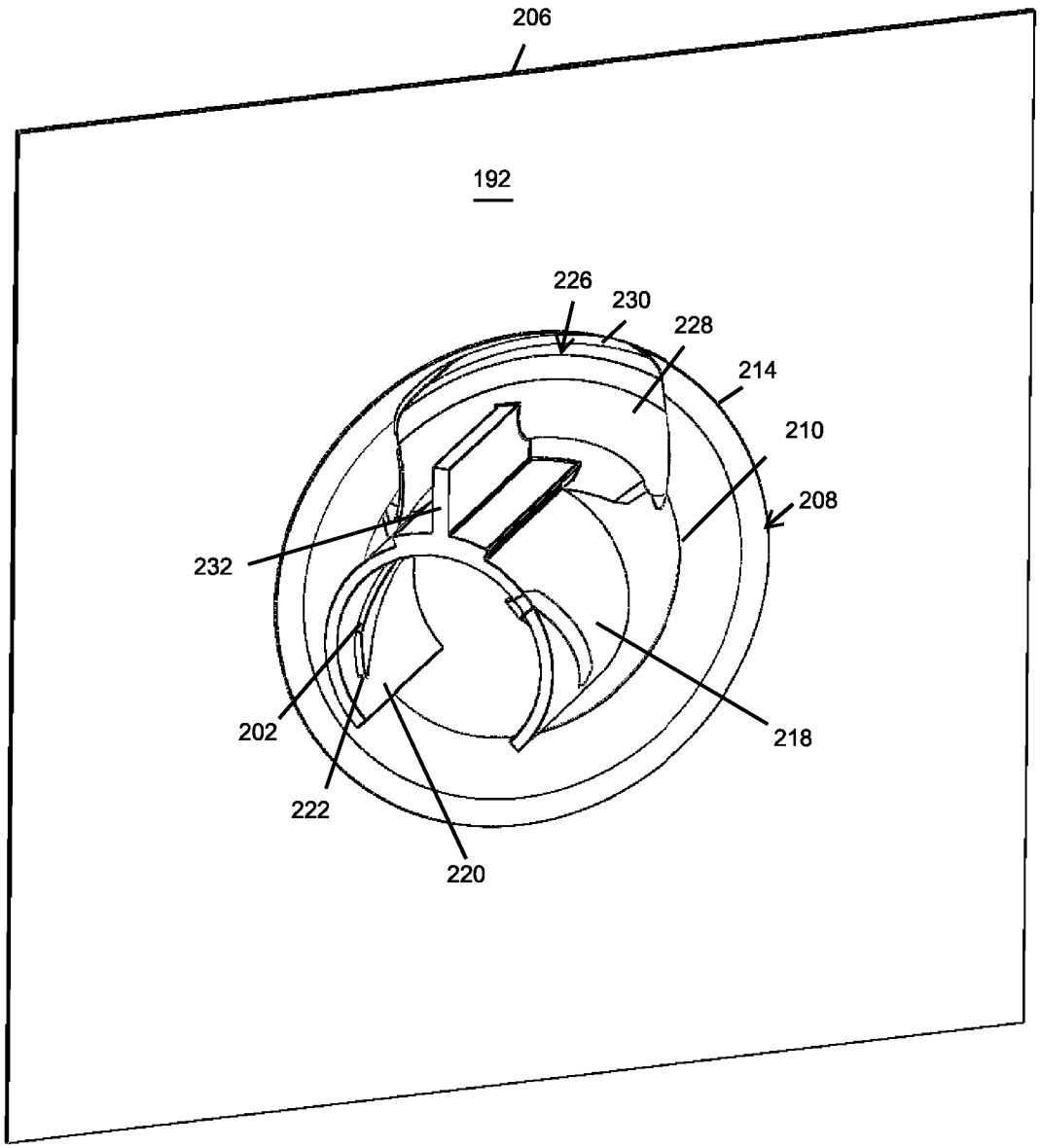
FIG. 26 is another perspective view angle of the FIG. 20-25, the view being in perspective to the shade material to the shade material.
Figure 27:
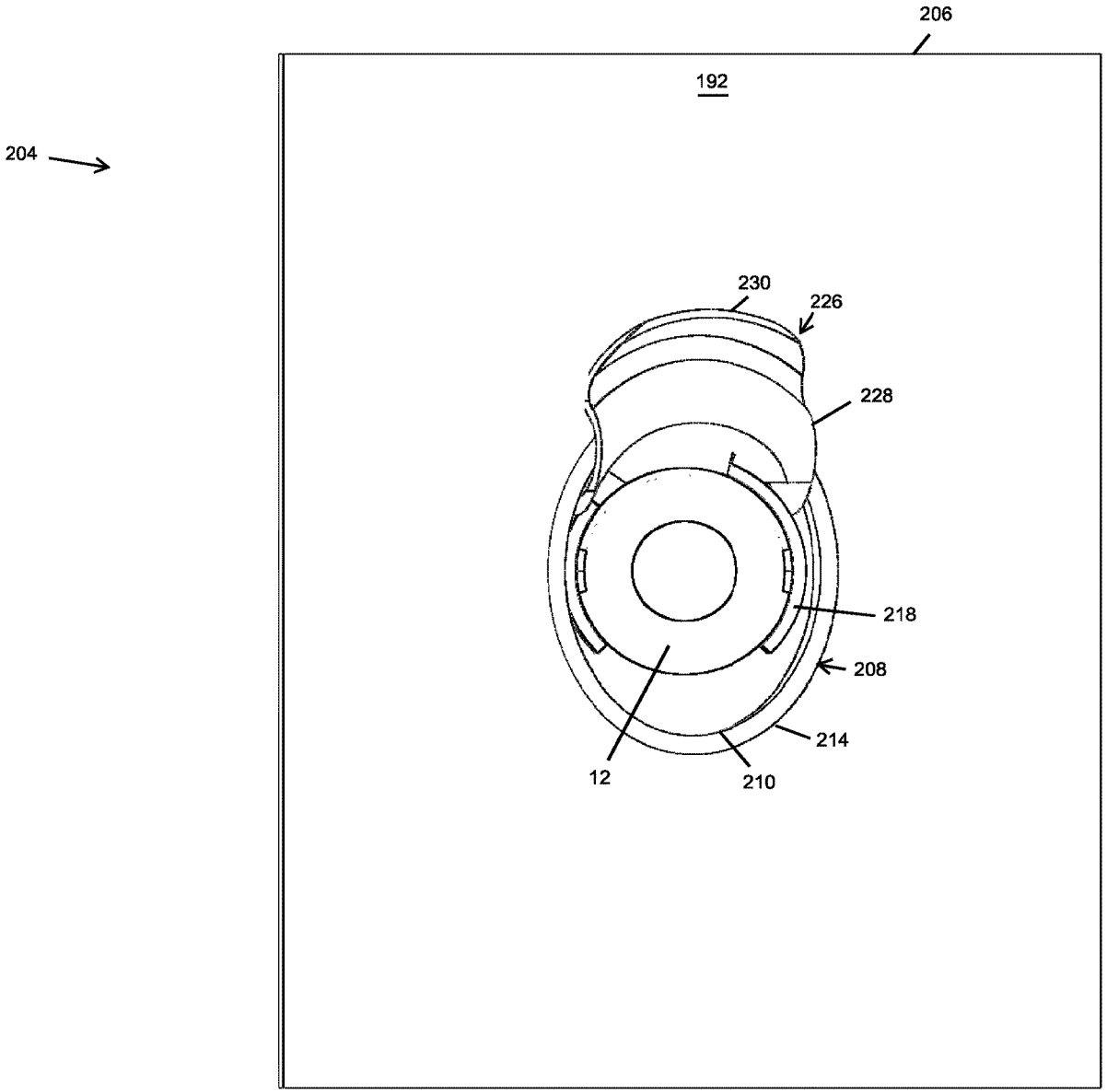
FIG. 27 is an elevation view of the of the motorized grommet drapery apparatus of FIGS. 13-26, the view being in perpendicular to the length of the rotatable drive element.
Figure 28:
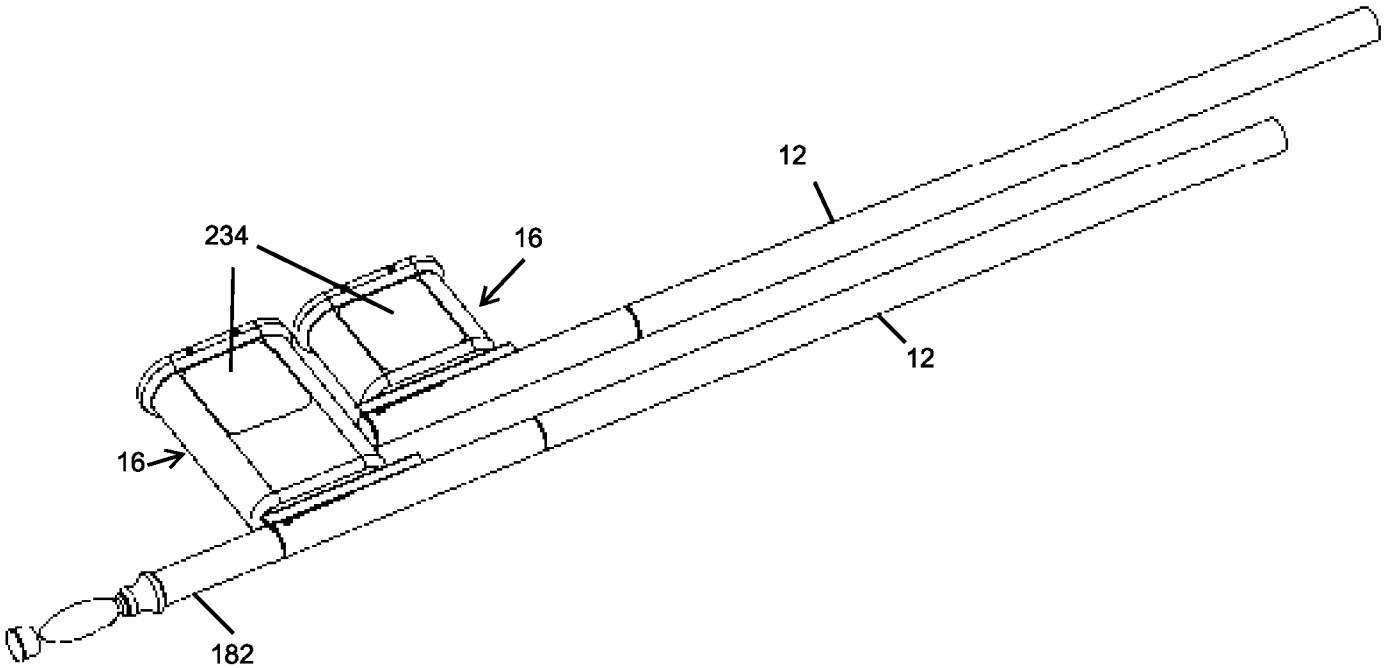
FIG. 28 is a perspective view of a motorized grommet drapery apparatus having batteries positioned in the wall bracket.
Figure 29:
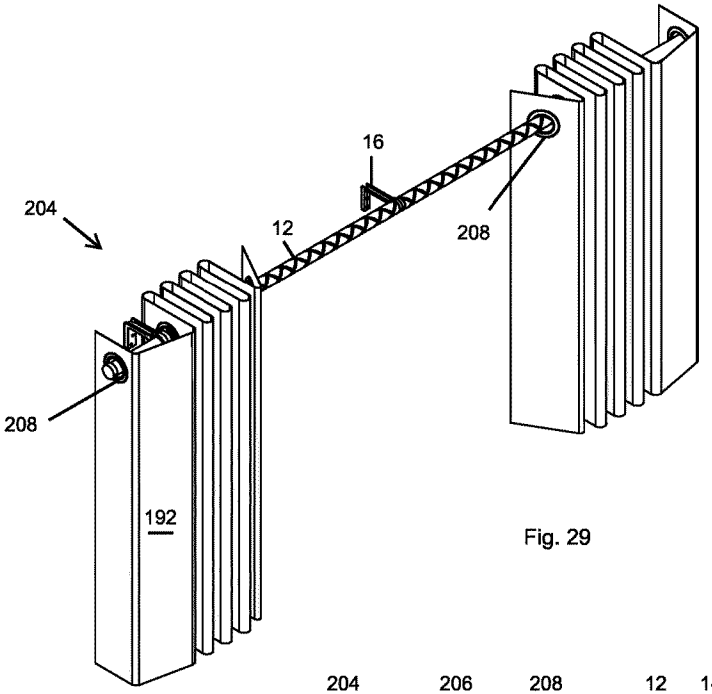
FIG. 29 is a perspective view of a motorized grommet drapery apparatus; the view showing the center opening motorized grommet drapery apparatus in a fully opened position.
Figure 31:
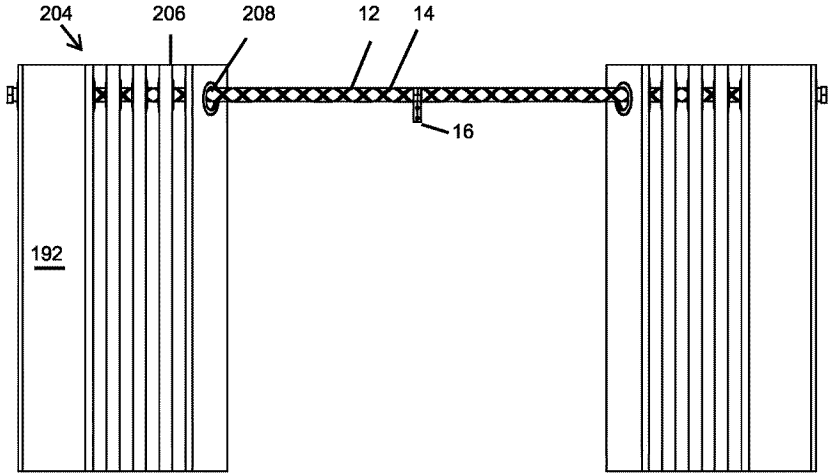
FIG. 31 is a front elevation view of FIG. 29.
Figure 30:
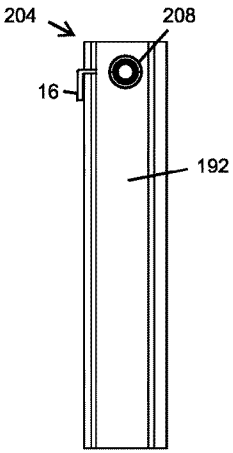
FIG. 30 is a side elevation view of FIG. 29.
Figure 32:
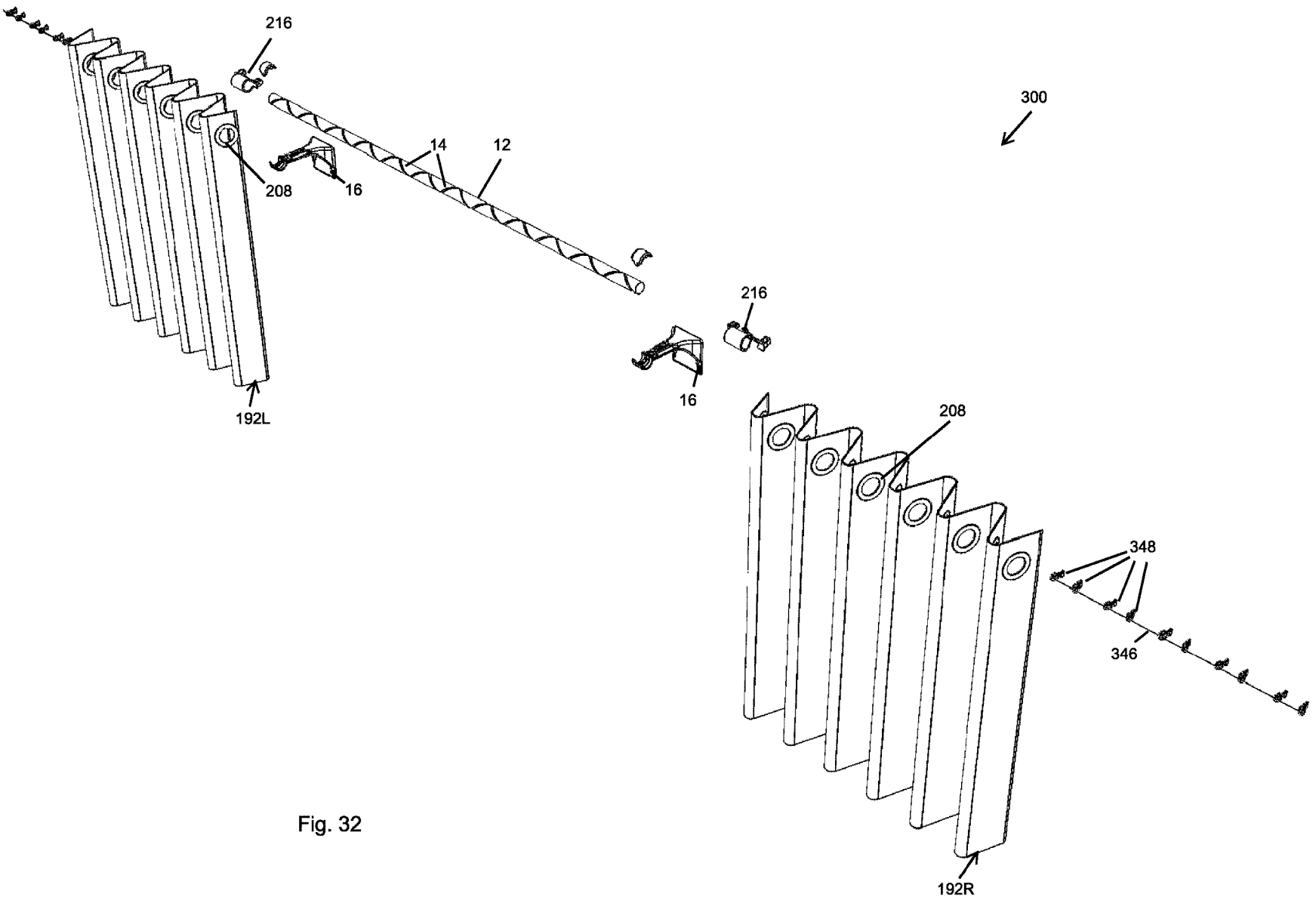
FIG. 32 is an exploded perspective view of an alternative arrangement of a motorized grommet drapery apparatus, shown in FIGS. 32-37.
Figure 33:
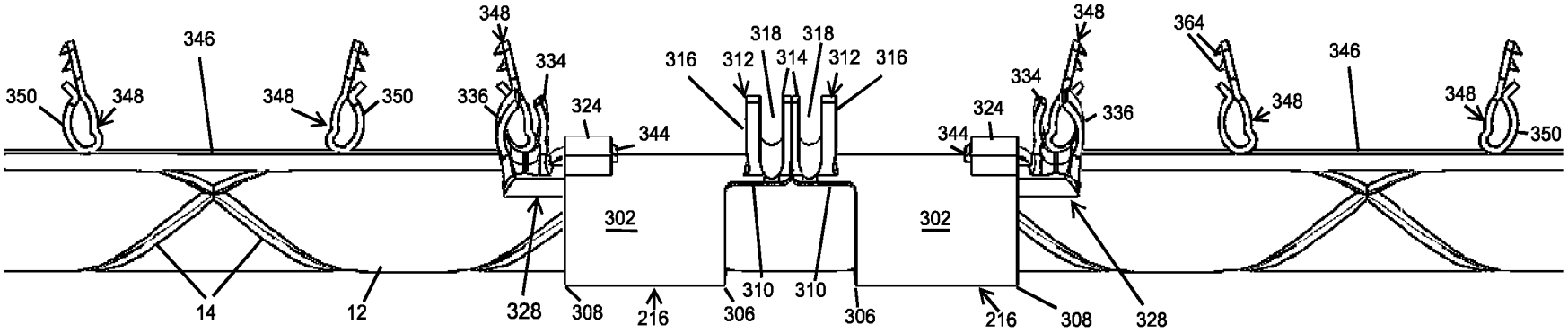
FIG. 33 is a close-up elevation view of an alternative arrangement of a motorized grommet drapery apparatus, shown in FIGS. 32-37; the view showing the grommet drivers positioned over the drive element.
Figure 34:
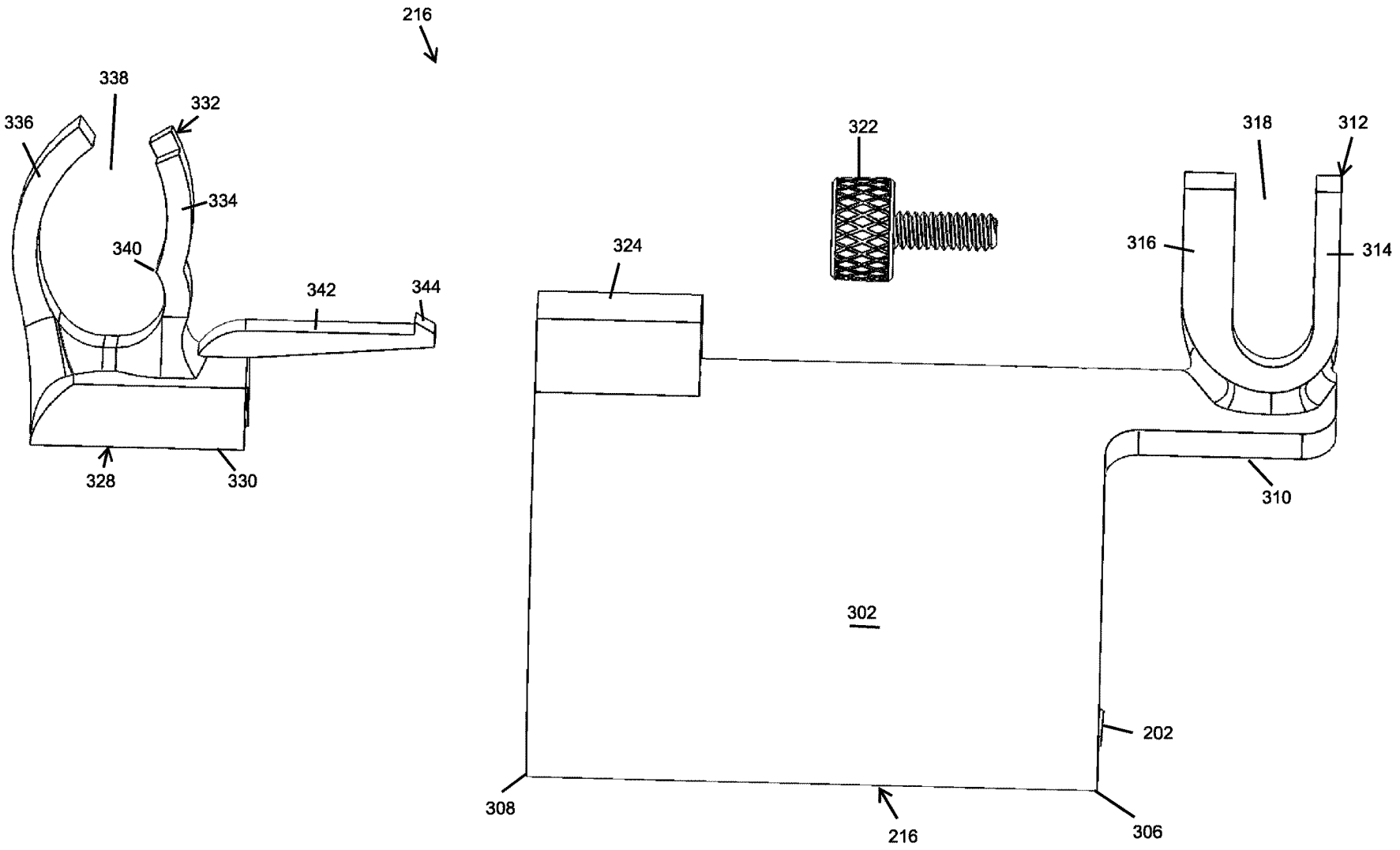
FIG. 34 is a close-up elevation exploded view of the grommet drivers shown in FIG. 33.
Figure 35:
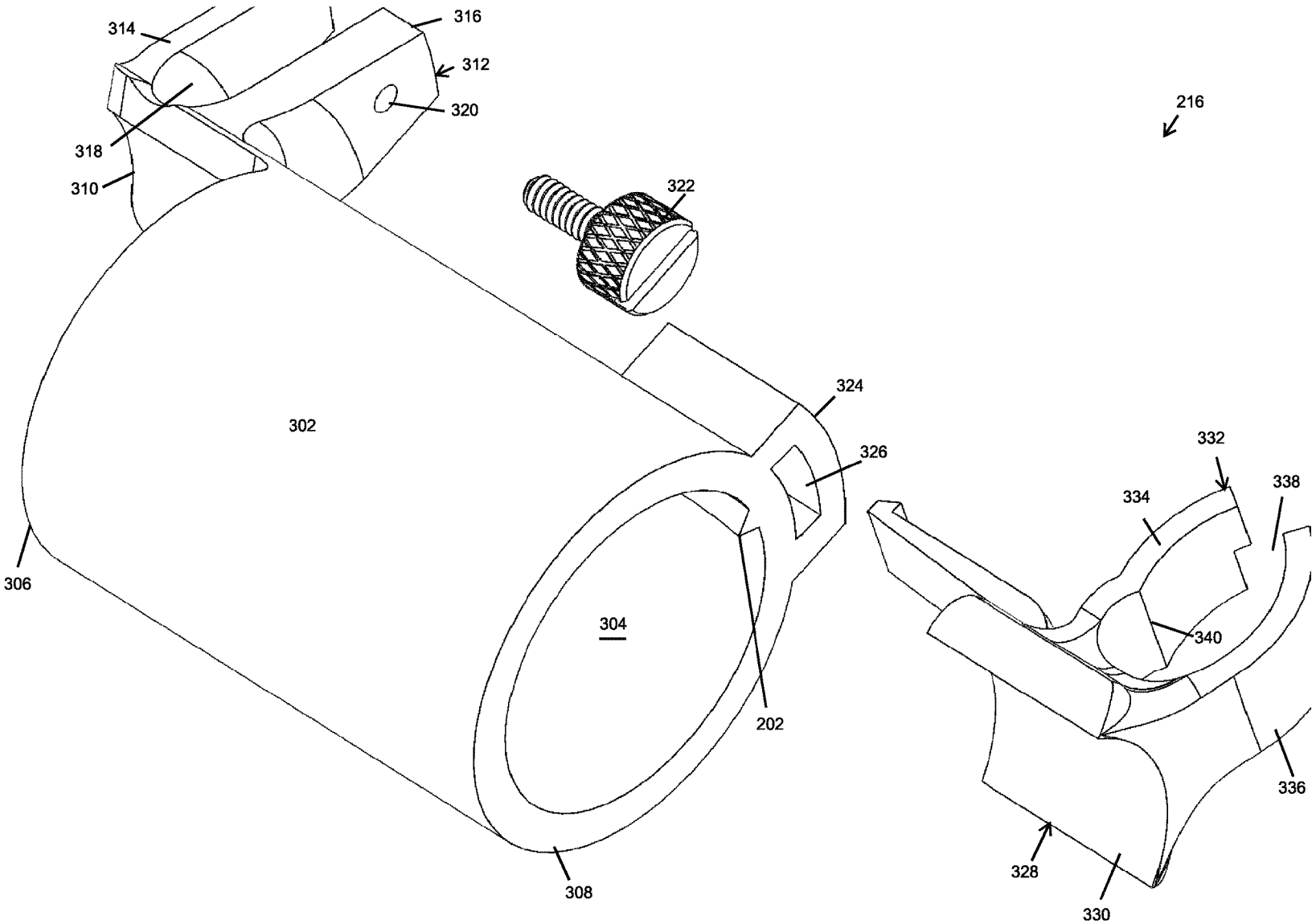
FIG. 35 is a close-up perspective exploded view of the grommet drivers shown in FIGS. 33-34.

In Operation—Single Motor Assembly:

In the arrangement wherein only a single motor housing 18 is connected to the combined rotatable drive element 12 (such as is shown in FIGS. 1 & 2) the single motor housing 18 rotates both rotatable drive elements 12. In this arrangement, the motor housing 18 is installed on the left bracket 16 and locked in place by the mating engagement of key-features 42, 94 as well as the engagement of locking-screw 184, which prevents rotation of motor housing 18 when motor 76 rotates. With motor coupler 104 inserted into the motor coupler sleeve 160, as motor 76 rotates, the components of transmission 78 rotate which rotates drive shaft 80 which rotates motor coupler 104 on bearing 102. This rotation is transferred through the motor coupler sleeve 160 and thereby rotates the first rotatable drive element 12. The rotation of the first rotatable drive element 12 is transferred through center coupler 172 to rotate the second rotatable drive element 12. The end opposite motor housing 18 of the second rotatable drive element 12 rotates freely upon bearing 102 and is supported by the right bracket 16. In this way, a single motor housing 18 rotates dual rotatable drive elements 12. In this arrangement, when the center coupler 172 is supported by a bracket 16, the bearings 178 allow free rotation of the rotatable drive elements 12 within the mounting member 24 of the bracket 16.

Actuation:

In this arrangement, motor 76 of architectural covering 10 can be actuated in any one of a plurality of methods and manners. Motorized control of architectural covering 10 can be implemented in several ways. As examples, the motor 76 can be actuated by tugging on the architectural covering 10, by using a remote control device using RF communication, by using a voice command and a voice command module, an internet enabled application, or any other method.

Tugging:

One method of actuating the motor 122 is through tugging the architectural covering 10. This method and system is more fully described in Applicant's related patent application entitled "Low-Power Architectural Covering," U.S. Pat. No. 9,249,623 granted on Feb. 2, 2016 which is fully incorporated by reference herein. A tug is defined a small manual movement of the architectural covering. This tug is sensed by a tug sensor such as an accelerometer, hall effect sensors, reed switch or the like as is more fully described in Applicant's related patent applications. When the tug sensor senses the tug, the system is woken up from a sleep state. In sleep state, power use is minimized to maximize battery life. When the system is woken up, the tug sensor senses the tug and the microprocessor 118 deciphers the tug and determines how to actuate the motor 76.

In one arrangement, the microprocessor 118 is programmed to recognize, one, two, three, or more tugs separated by a predetermined amount of time, such as between a quarter second and one and a half seconds. However any other amount of time between tugs is hereby contemplated such as ¼ second, ½ second, ¾ second, 1 second, 1¼ seconds, 1½ seconds, 1¾ seconds, 2 seconds, and the like. When microprocessor 118 detects a single tug, pursuant to instructions stored in the memory 120, microprocessor 118 instructs motor 76 to go to a first corresponding position, such as open. When microprocessor 118 detects two tugs, pursuant to instructions stored in memory 120, the microprocessor 118 instructs motor 120 to go to a second corresponding position, such as closed. When microprocessor 118 detects three tugs, pursuant to instructions stored in memory 120, microprocessor 118 instructs motor 122 to go to a third corresponding position, such as half open. Any number of tugs and positions can be programmed.

Remote Control and Voice Control Operation:

One method of actuating the motor 76 is through using a wireless remote 196. This method and system is more fully described in Applicant's related patent application entitled System and Method for Wireless Voice Actuation of Motorized Window Coverings Ser. No. 61/807,846 filed on Apr. 3, 2013 which is fully incorporated by reference herein. In that application, as is contemplated herein, a wireless remote 196 is actuated by the user, by pressing a button. When actuated, the wireless remote 196 transmits an electromagnetic signal over-the-air, which is received by the antenna 124 of the motor controller assembly 68. Once antenna 124 receives the electromagnetic signal it is transmitted to receiver or transceiver 122 which converts the signal and transmits it to microprocessor 118. Microprocessor 118 interprets the signal based on instructions stored in memory 120 and actuates the architectural covering 10 to the predetermined position. As is also presented in that application, is a voice actuation module 198, which receives a user's voice command, converts it to an electromagnetic signal which is received by architectural covering 10 in the manner described herein.

Internet Control and Operation:

One other method of actuating the motor 76 is through use of the internet and use of an electronic device. This method and system is more fully described in Applicant's related patent application entitled System and Method for Wireless Communication With and Control of Motorized Window Coverings Ser. No. 61/807,804 filed on Apr. 3, 2013 which is fully incorporated by reference herein. In that application, as is contemplated herein, motor 76 is actuated by a user having an internet enabled handheld device, such as a laptop, tablet or smartphone, which transmits a signal through the internet which is received at a gateway which then transmits an electromagnetic signal to the architectural coverings 10 as is described herein.

In Operation—Dual Motor Assembly:

In the arrangement wherein a motor housing 18 is connected to both ends of the combined rotatable drive element 12 there are two modes of operation. The first mode of operation includes where the center coupler 172 does not allow for independent rotation of rotatable drive elements 12. In this arrangement, the two motor housings 12 combine to contribute to the rotation of the combined rotatable drive elements 12. In this arrangement, a benefit is that the two motor housings 18 provide additional power and torque for the application. In this arrangement, a drawback is that the two motor housings 18 should be actuated simultaneously and be tuned to operate in cooperation with one another, otherwise one motor housing 18 will be working against the other.

In an alternative arrangement, center coupler 172 allows for independent rotation of rotatable drive elements 12 upon bearings 178. In this arrangement, a single motor housing 18 only rotates a single rotatable drive element 12. This eliminates coordinating opposing motor housings 18 as one will not affect the other. This also provides for independent actuation of one side of the architectural covering 10 while leaving the opposing side unaffected.

Coordination of Dual Motor Housings:

In the arrangement wherein two motor housings 18 are used, coordination of the two motor housings 18 may be desired. That is, in some applications it is desirable to turn on and turn off motors 76 at the same time. In other applications it is also important to rotate the motors 76 at the same speed. There are multiple ways to accomplish this coordination. In one arrangement, the two motor housings 18 are connected by an electrical conduit, such as a wire, which transmits control signals from one motor housing 18 to the other motor housing 18. More specifically, the two motor controller assemblies 68 are connected to one another and communicate with one another. This ensures that when one motor housing 18 receives a control signal, such as through a tug or through a wireless or electromagnetic signal, that the control signal is relayed to the other motor housing 18. This ensures when one motor housing 18 receives a control signal so does the other motor housing 18.

In another arrangement, the two motor housings 18 are wirelessly connected to one another. In this arrangement, the motor controller assemblies 68 of each motor housing 18 have a transceiver 122, instead of a receiver, which allows for sending as well as receiving control signals. In this arrangement, when a control signal is received by one motor controller assembly 68, the transceiver 122 re-broadcasts or relays the control signal which is received by the transceiver 122 of the other motor controller assembly 68. In this way, the two motor controller assemblies 68 communicate with one another to ensure the control signals have been received by both motor controller assemblies 68.

Additional information is also transmitted from motor housing 18 to motor housing 18 in the ways described herein, such as wirelessly or through wired communication. This information can include as speed, location, state (such as awake or asleep mode) and the like so as to coordinate operation and actuation of the two motors 76.

Conductive Brackets:

In one arrangement, the brackets 16 are formed of a conductive material such as steel, copper, aluminum, an alloy or the like. In this arrangement, the bracket 16 itself can be used as a pathway or conductor for carrying electricity from battery tube assembly 136. In this way, when plug 148 connects to socket assembly 64 a conduit 50 or wire can be eliminated because this conduit 50 has been replaced by the bracket 16 itself. This reduces cost of the system and eases the assembly by eliminating a part.

Components Recess:

In one arrangement, the motor controller assembly 68, or a portion thereof is positioned within the components recess 66 of bracket 16. In this arrangement, all or some of the necessary components for controlling motor 76 are positioned within the bracket 16. As one example, antenna 124, receiver or transceiver 122, memory 120 and microprocessor 118 are positioned within components recess 66 of bracket 16. This arrangement allows for a smaller motor housing 18 which improves the aesthetic appearance and design.

Alternative Arrangement—Motorized Grommet Drapery:

In an alternative arrangement, with reference to FIGS. 13-31, a grommet drapery 204 is shown having shade material 192 with a plurality of openings adjacent its upper edge 206. These openings are positioned in spaced relation to one another and are aligned at the same distance down from the upper edge 206. A grommet 208 is placed in each of these openings.

Grommets 208 are formed of any suitable size, shape and design. In the arrangement shown, grommets 208 are generally circular in shape and are formed of a metallic material, however any other shape and any other material is hereby contemplated for use such as plastic, composite material, UHMW material or the like. In the arrangement shown, grommets 208 have a generally circular interior edge 210 which defines an open interior. The interior edge 210 curves around to opposing sides 212 of grommets 208 which extend outwardly from the interior edge 210 and terminate in a generally circular exterior edge 214.

Grommets 208 are positioned through the openings in shade material 192 and are affixed to the shade material 192. In one arrangement, opposing sides 212 of grommets 208 are pressed onto the shade material 192 and into one another such that the shade material 192 is frictionally and tightly held or pinched between opposing sides 212 of grommets 208. Alternatively, grommets 208 are connected to shade material in any other way. Alternatively, grommets 208 are not present, and instead only openings are present in shade material 192.

Conventional drapery grommets 208 generally have an open interior diameter of between one and three inches, with common sizes being 1", 1 7/16", 1½", and the like.

In the arrangement shown, the plurality of grommets 208 are positioned over the rotatable drive element 12. Said another way, the rotatable drive element 12 passes through the plurality of grommets 208. To accomplish this, the shade material 192 and grommets 208 are positioned in a zigzag formation. Or, said another way, the shade material 192 weaves back-and-forth so as to align the open interior of the grommets 208 such that the drive element 12 can pass there through.

In the arrangement shown, a left shade material 192L and a right shade material 192R are connected to rotatable drive element 12 in a center opening and closing arrangement. In this arrangement, the outward most grommet 208 is positioned outward of the rotatable drive element 12. Or said another way, the outward most grommet 208 is positioned over the motor housing 18 or the rotatable drive element extension 182 on the opposite side of wall bracket 16. Because the outward most grommet 208 cannot slide past the bracket 16, the outward most grommet 208 anchors the shade material 192 and defines the inward most extension of shade material 192.

A grommet driver 216 is connected to rotatable drive element 12 as well as to shade material 192. Grommet driver 216 is formed of any suitable size, shape and design. In the arrangement shown, grommet driver 216 has a main body 218, which receives the rotatable drive element 12. In the arrangement shown, main body 218 is arcuate in shape and has an interior surface 220, which is sized and shaped to receive the exterior surface of rotatable drive element 12 within close tolerances. While the arrangement shown depicts a main body 218 having an open bottom end, in an alternative arrangement, main body 218 is fully enclosed, or said another way, the main body 218 completes the circle and therefore reaches around the entirety of rotatable drive element 12.

At least one tooth 202, as is described herein is positioned in the interior surface 220 of main body 218. In the arrangement shown, a pair of teeth 202 are positioned, one on each side of main body 218. Teeth 202 have a pointed ends 222 which help to guide the teeth through guide structure 14. In the arrangement shown, teeth 202 have squared sidewalls which correspond to a squared groove as guide structure 14. That is, when viewed from the side, guide structure 14 is a generally square or rectangular groove. Testing has proven that square or rectangular grooves, as guide structure 14, provide promising performance. That is, the square or rectangular groove provides improved guidance to grommet driver 216 and reduces the number of failures. Teeth 202 have a size and shape that closely match the dimensions of the square or rectangular groove of guide structure 14; That is, the sidewalls 224 which are square and extend perpendicularly outwardly from the interior surface 220 of main body 218. However, in an alternative arrangement, any other size and shape of teeth 202 is hereby contemplated for use.

Grommet driver 216 connects to grommet 208 by any manner such as bolting, screwing, clipping, snap-fitting or the like, or by being formed directly into grommet 208. In one arrangement, as is shown, a grommet clip 226 is connected to main body 218. Grommet clip 226 extends upwardly from the upper edge of main body 218 and engages and holds grommet 208. Grommet clip 226 has a pair of opposing flanges 228 that are spaced apart to receive grommet 208 between the opposing flanges 228. Opposing flanges 228 are biased inward toward one another and flex such that when a grommet 208 is positioned between flanges 228, the flanges 228, frictionally and tightly hold grommet 208 there between. Grommets 208 are inserted and removed from the grommet clip 226 by deflecting opposing flanges 228 away from one another. To aid with insertion and removal of grommets 208 from grommet clip 226, the upper end of flanges 228 have tongues 230 which flare or angle away from one another. These tongues 230 allow a user to engage the tongues 230 to bend them away from one another, they also help to guide a grommet 208 into the open interior between flanges 228 when they are pressed into the space between opposing tongues 230.

In one arrangement, grommet driver 216 also includes a support fin 232. In the arrangement shown, support fin 232 extends upwardly from the upper surface of main body 218. Fin 232 extends the lateral length of main body 218. The forward edge of fin 232 terminates in line with the forward edge of main body 218. The rearward edge of fin 232 engages the forward one of the opposing flanges 228 and provides support thereto.

In one arrangement, batteries 140 are positioned within the brackets 16 themselves. In one arrangement, these brackets 16 have an access panel 234, which provides access to an open interior in which batteries 140 are housed. The installation of batteries 140 in brackets 16 eliminates the need for placing batteries in the rotatable drive element extension 182, or in an external battery tube assembly 136. This simplifies the design, eliminates parts, and improves the aesthetic appearance of the assembly.

In Operation:

A pair of grommet shade materials 192L and 192R are positioned over the rotatable drive element 12. All but the outward most grommets 208 are positioned over the rotatable drive element 12. The outward most grommets 208 are positioned outward of brackets 16 and are positioned over the motor assembly 18 or the rotatable drive element extension 182. By placing the outward most grommet 208 outside of the rotatable drive element 12 this anchors the shade material 192, or prevents the entirety of the shade material from being moved when the inward edge of the shade material 192 is moved along the rotatable drive element 12.

Grommet drivers 216 are positioned over the rotatable drive element 12. In the arrangement wherein the main body 218 of grommet drivers 216 is open at its lower edge, the main body 218 can be snapped over the rotatable drive element 12 such that the teeth 202 engage and slide along the grooves of guide structure 14. Alternatively, in the arrangement wherein the main body 218 of grommet drivers 216 is closed or forms a full circle, the main body 218 is slid over an end of rotatable drive element 12 and is moved to the desired position with the teeth 202 engaging and sliding along the grooves of guide structure 14.

Once the grommet drivers 216 are in position over rotatable drive element 12, grommets 208 of shade material 192 are connected to grommet drivers 216. To do so, the interior edge 210 of grommets 208 are placed over grommet clips 226 and forced between flanges 228 such that flanges 228 frictionally hold grommets 208 therein.

In one arrangement, grommet drivers 216 are connected to the inward most grommet 208. However, in an alternative arrangement, grommet driver 216 is connected to the second most inward grommet 208, in another arrangement grommet driver is connected to the first and second inward most grommet 208. By connecting grommet driver 216 to the second most grommet 208 light gaps can be reduced between the inward edges of opposing left and right shade materials 192L, 192R. That is, when closing the shade material 192, when the grommet drivers 216 are connected to the second inward most grommet 208, an additional amount or layer of shade material 192 is positioned in the area where an annoying and aesthetically displeasing light gap is often present. That is, by positioning the grommet driver 216 on the second grommet 208, the grommet driver 216 drives two layers of shade material 192 towards the center which reduces the potential for a light gap. Support fin 232 which extends upwardly from main body 218 helps to engage the first or flap layer of shade material by increasing the forward surface area of grommet driver 216.

Once fully assembled, when the rotatable drive element 12 is rotated the grommet drivers 216 are driven along the length of the rotatable drive element 12 by engagement of teeth 202 in the grooves of guide structure 14. As the grommet driver 216 is driven across the length of the rotatable drive element 12 the shade material 192 is pulled or pushed over the rotatable drive element 12. In this arrangement the interior edge 210 of grommets 208 (that are not connected to the grommet driver 216) slide over the rotatable drive element 12. Rotation in a first direction will open the shade material 192 while rotation in a second direction will close the shade material 192.

Rotation of the rotatable drive element 12 not only drives the grommet driver 216 but this rotation eliminates or reduces the potential for binding of the grommets 208 on the rotatable drive element 12. That is, in a conventional non-rotating support rod arrangement, when the shade material 192 is pulled along the length of the support rod, one problem is that the grommets 208 tend to cant or angle. This causes opposing sides of the interior edge 210 of grommets 208 to bind, cinch or lock up on the support rod. By rotating the rotatable drive element 12, binding or cinching of the grommets is practically eliminated as friction between the grommets 208 and the rotatable drive element 12 is substantially reduced due to the rotation. This is because the rotatable drive element 12 rotates generally perpendicularly to the grommets 208, which are attached to the hanging shade material 192, which helps to keep the vertical orientation of the grommets 208. In this way, not only is the shade material 192 driven across the length of the rotatable drive element 12, but binding or cinching is practically eliminated.

Accordingly, this arrangement provides numerous advantages. One advantage of this arrangement is that the grommets 208 act as loose gears as they pass through or partially engage the helical grooves of the guide structure 14. This reduces the friction during an opening or closing process thereby reducing the overall energy requirement for opening and closing the shade material 192.

Another advantage of the arrangement is that the potential for binding of the grommets 208 on the drive element 12 is reduced or eliminated. That is, because grommet draperies zig-zag along the drive element 12, unlike ringed draperies which simply hand on rings which are perpendicularly aligned to the drive element 12 or support rod, grommet draperies have substantially higher tendency to cant, cinch and bind up when they are moved, more particularly, when they are being pulled to a closing position. This can be very frustrating to a user, often causing the need for a higher pulling position (higher on the shade material 192, nearer the drive element 12) along with a rapid jerk and/or increased force. This frequently causes damage to the mechanism or distortion and damage to the shade material 192. This phenomenon of binding is eliminated when the drive element 12 is spinning in the direction of opening or closing since the grommets 208 have no opportunity to bind on a spinning drive element 12.

Yet another advantage of the arrangement is that it positions the shade material 192 in a more consistent and more aesthetically pleasing arrangement. The designer's preference is that, when draperies are closed, that the folds of the fabric are equally distributed. When a grommet shade 192 is manually pulled to a close position, the distribution of folds in the shade material 192 is often uneven with greater spacing between folds closest to the closing direction and tighter spacing of between the folds adjacent the non-moving end. This is because force is only applied to the leading edge of the shade material 192. The remaining portions of the shade material 192 must be pulled therefrom and resistance between the grommets 208 and the drive element 12 tend to keep portions of the shade material 192 away from the leading edge in place until the shade material 192 is sufficiently stretched by the closing action. This problem is resolved when the drive element 12 having a helical groove 14 therein, is rotated such as by electric or manual means because the rotating drive element 12 applies force to all grommets 208, not just grommets 208 at the leading edge of the shade material 192. That is, the rotating drive element 12 interacts with the grommets 208 and urges grommets 208 in the direction the helical coil of the guide structure 14 is rotated. This causes force to be applied across the length of the shade material 192 and causes even distribution of folds when the shade material 192 is moved in the closing direction. Similarly, but oppositely, as the shade material 192 is opened, the shade material 192 similarly opens in relatively consistent fashion along its length until the inner folds begin to stack up.

Grommet Drapery 300:

In an alternative arrangement, with specific reference to FIGS. 32-37, an alternative arrangement of a grommet drapery 300 is presented. In this arrangement, as one example, grommet drapery 300 includes a pair of grommet drivers 216. In the arrangement shown, grommet drivers 216 have a main body that is generally cylindrical in shape. The main body of grommet driver 216 has a generally cylindrical shape that has an exterior surface 302 and an interior surface 304 that are both generally smooth and cylindrical in shape when viewed from an end. The main body of grommet drivers 216 extend a lateral length from an inward end 306 to an outward end 308 in a generally cylindrical manner.

The interior surface 304 of grommet driver 216 is sized and shaped to fit over the exterior shape of drive element 12. In the arrangement shown, the interior surface 304 of grommet driver 216 includes a tooth 202. Tooth 202 is sized and shaped to receive guide structure 14 of drive element 12. In the arrangement shown, when grommet driver 216 is viewed from an end 306, 308, tooth 202 is generally triangular in shape, or pointed, however any other size, shape and design is hereby contemplated for use.

The inward end 306 of grommet driver 216 includes an extension 310 that extends forward from inward end 306, and away from outward end 308. In the arrangement shown, as one example, extension 310 is in the shape of a portion of the cylindrical member that forms the main body of grommet driver 216 that is positioned at the top and/or rear side of the grommet driver 216. In this way, extension 310 covers a portion of the drive element 12 at the forward upward and/or rearward end of grommet driver 216 with its interior surface continuous with the interior surface 304 of the main body, and its exterior surface continuous with the exterior surface 302 of the main body of grommet driver 216.

The upper surface of extension 310 includes a connector member 312. Connector member 312 is formed of any suitable size, shape and design and is configured to connect to an inward most grommet 208 of shade material 192. In the arrangement shown, as one example, connector member 312 includes an inner wall 314 and an outer wall 316 that extend perpendicularly away from the exterior surface of extension 310 in approximate parallel spaced relation to one another thereby defining a slot 318 between the opposing facing surfaces of inner wall and outer wall 316, and in approximate perpendicular relation to the length of extension 310. In the arrangement shown, the inner wall 314 extends upwardly from the inward most end of extension 310. In this way, the inward most end of extension 310 and the inward facing surface of inner wall 314 define the inward stop surface of grommet driver 216. That is, when opposing grommet drivers 216 engage one another at a fully closed position of a center closing/center opening drapery 10, the opposing inward most ends of extensions 310 and inner walls 314 engage one another. In this way, the inward ends of inner wall 314 and extension 310 serve as a stop surface for the fully closed position.

To facilitate the reception of a grommet 208 within the slot 318, when viewed from the front or rear side, the lower end of slot 318 has a U-shape. Or, said another way, the lower end of slot 318 has a semicircular shape. This shape is configured to receive and hold the rounded interior edge 210 of a grommet 208 therein. Also, by carving semicircular shape in the extension 310 between inner wall 314 and outer wall 316, this makes the material of extension 310 slightly thinner thereby reducing the amount of clearance required between the inner diameter of grommet 208 and the outer diameter of drive element 12.

Figure 36:
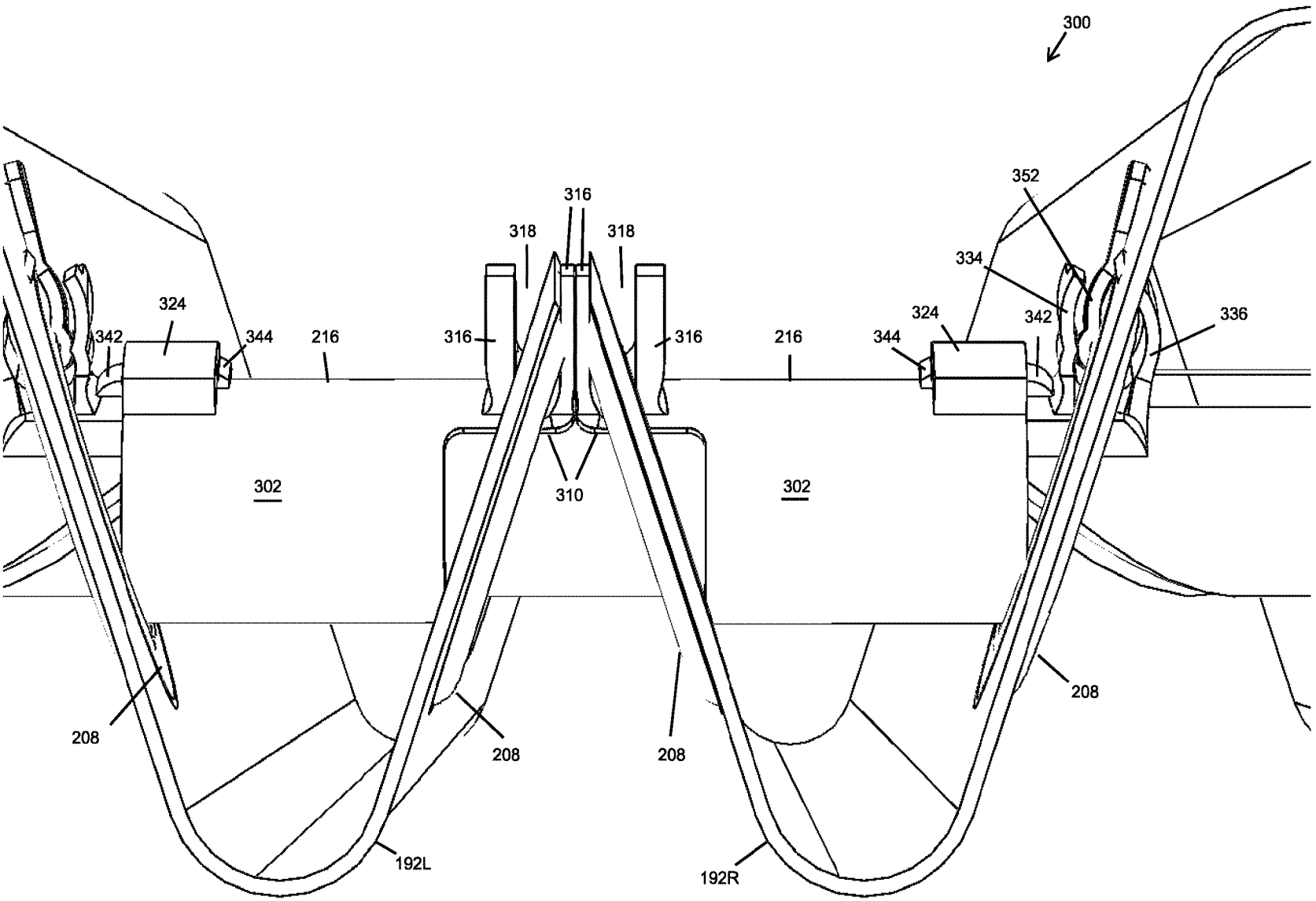
FIG. 36 is a close-up elevation view of the grommet drivers shown in FIGS. 33-35; the view showing the shade material connected to the grommet drives and the shade material in a fully closed position with the inward edges of opposing shade material connecting to one another to reduce or eliminate a light gap.

In addition, the size and shape of the slot 318 is configured to allow grommet 208 to extend through slot 318 in a generally aligned manner, such that the grommet 208 is perpendicular to the length of drive element 12, as well as at an angle. That is, in one arrangement, as is shown in FIG. 36, it is desirable to have the grommet 208 extend through slot 318 at an angle such that the inward most and second inward most grommets 208 extend at an angle to one another causing the shade material 192 between the inward most and second inward most grommets 208 to be formed in a properly spaced V-shaped formation, which many users prefer as an optimal configuration.

In one arrangement, as is shown, the upper ends of inner wall 314 and outer wall 316 include an opening 320 that is sized and shaped and configured to receive a locking screw 322. Locking screw 322 is any device that is used to lock a grommet 208 within slot 318 in the desired position. In the arrangement shown, as one example, locking screw 322 is a thumb screw that includes a standard-sized threaded shaft connected to an oversized head that a user can manipulate to easily tighten and loosen locking screw 322. This locking screw 322 is used to lock and tighten a grommet 208 within slot 318. This locking screw 322 is also used to lock the position of the angle of grommet 208.

In the arrangement shown, the inward end 306 of the main body of the grommet driver 216 includes a collar 324 that has a slot 326 therein. Collar 324 and slot 326 are formed of any suitable size, shape and design and are configured to receive a first grommet clip attachment 328 therein. In the arrangement shown, as one example, collar 324 includes a center wall that connects at its outward ends to end walls that extend forward from the center wall toward the exterior surface 302 of the main body of grommet drapery 300. The outward end of collar 324 is positioned in approximate flush alignment with the outward end 308 of main body of grommet driver 216. Collar 324 and slot 326 extend inward a distance from the outward end 308 of grommet driver 216 a distance before terminating in an open end. In this way, the inward end of collar 324 terminates in an open end, like the outward end 308. Collar 324 and slot 326 serve to receive and hold a first grommet clip attachment 328.

First grommet clip attachment 328 is formed of any suitable size, shape and design and serves to connect to the outward end 308 of grommet driver 216 and hold the second inward-most grommet 208 and grommet clip 348. In the arrangement shown, as one example, first grommet clip attachment 328 includes a main body 330 that, in one arrangement, is similarly shaped to extension 310. That is, in the arrangement shown, as one example, main body 330 is in the shape of a portion of the cylindrical member, such that when connected to the main body of grommet driver 216, the main body 330 of first grommet clip attachment 328 continues the extension of grommet driver 216. In the arrangement shown, when main body 330 of grommet clip attachment 328 is connected to the main body of grommet driver 216, the main body 330 is positioned at the top and/or rear side of the grommet driver 216. In this way, main body 330 covers a portion of the drive element 12 at the outward upward and/or rearward end of grommet driver 216 with its interior surface continuous with the interior surface 304 of the main body, and its exterior surface continuous with the exterior surface 302 of the main body of grommet driver 216. In the arrangement shown, first grommet clip attachment 328 is positioned in approximate alignment with extension 310 on the opposite side of the main body of grommet driver 216.

The upper surface of first grommet clip attachment 328 includes a connector member 332. Connector member 332 is formed of any suitable size, shape and design and is configured to connect to and hold a grommet clip 348 which holds a second inward most grommet 208 of shade material 192. In the arrangement shown, as one example, connector member 332 includes an inner wall 334 and an outer wall 336 that extend generally perpendicularly away from the exterior surface of extension 310, and main body of grommet driver 216 and main body 330 of first grommet clip attachment 328 in approximate parallel spaced relation to one another, thereby defining a slot 338 between the opposing facing surfaces of inner wall 334 and outer wall 336, and in approximate perpendicular relation to the length of extension 310, and main body of grommet driver 216 and main body 330 of first grommet clip attachment 328.

To facilitate the reception of a grommet clip 348, which holds a grommet 208, within the slot 338, when viewed from the front or rear side, the lower end of slot 338 has a U-shape. Or, said another way, the lower end of slot 338 has a semicircular shape that matches, mirrors or corresponds to the size and shape of the lower surface of grommet clip 348, as is further described herein.

Figure 37:
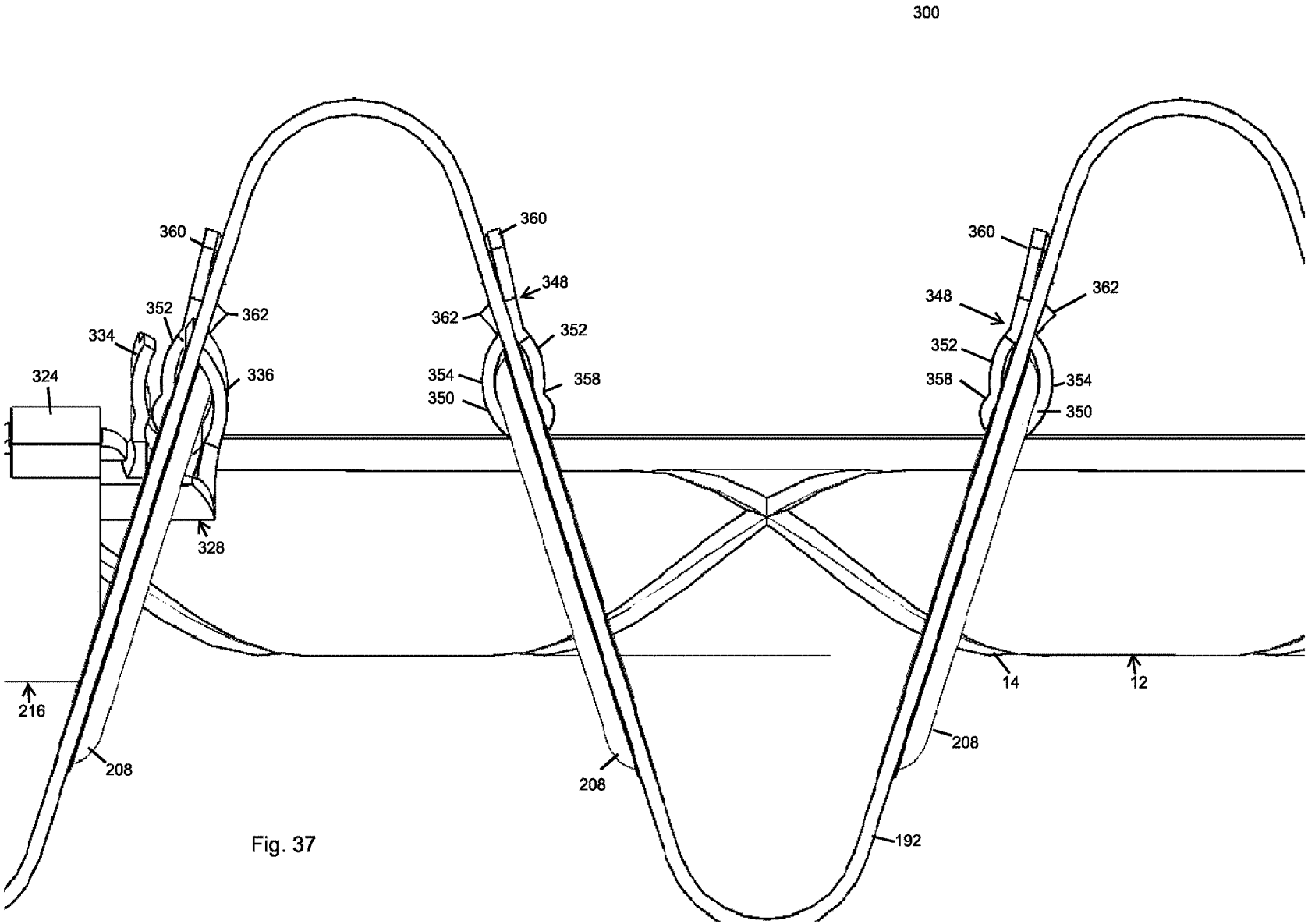
FIG. 37 is a close-up elevation view of the motorized grommet drapery system shown in FIGS. 33-35; the view showing the grommet clips connected to a lead and the inward most grommet clip connected to the grommet driver.
Figure 38:
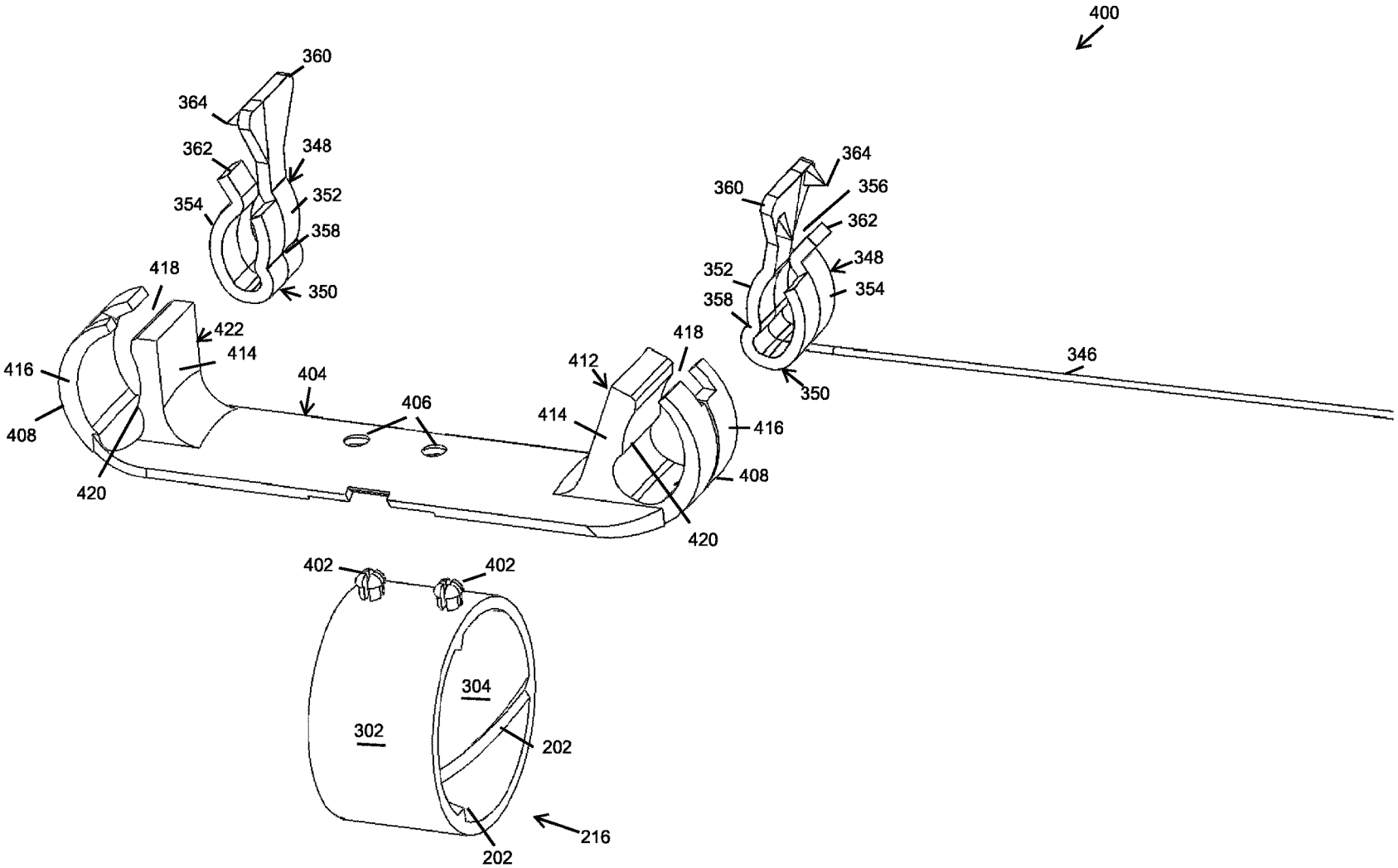
FIG. 38 is an exploded perspective view of an alternative arrangement of a motorized grommet drapery apparatus, shown in FIGS. 38-45; the view showing a grommet driver exploded from a carrier that has opposing connector members that receive grommet clips.
Figure 39:
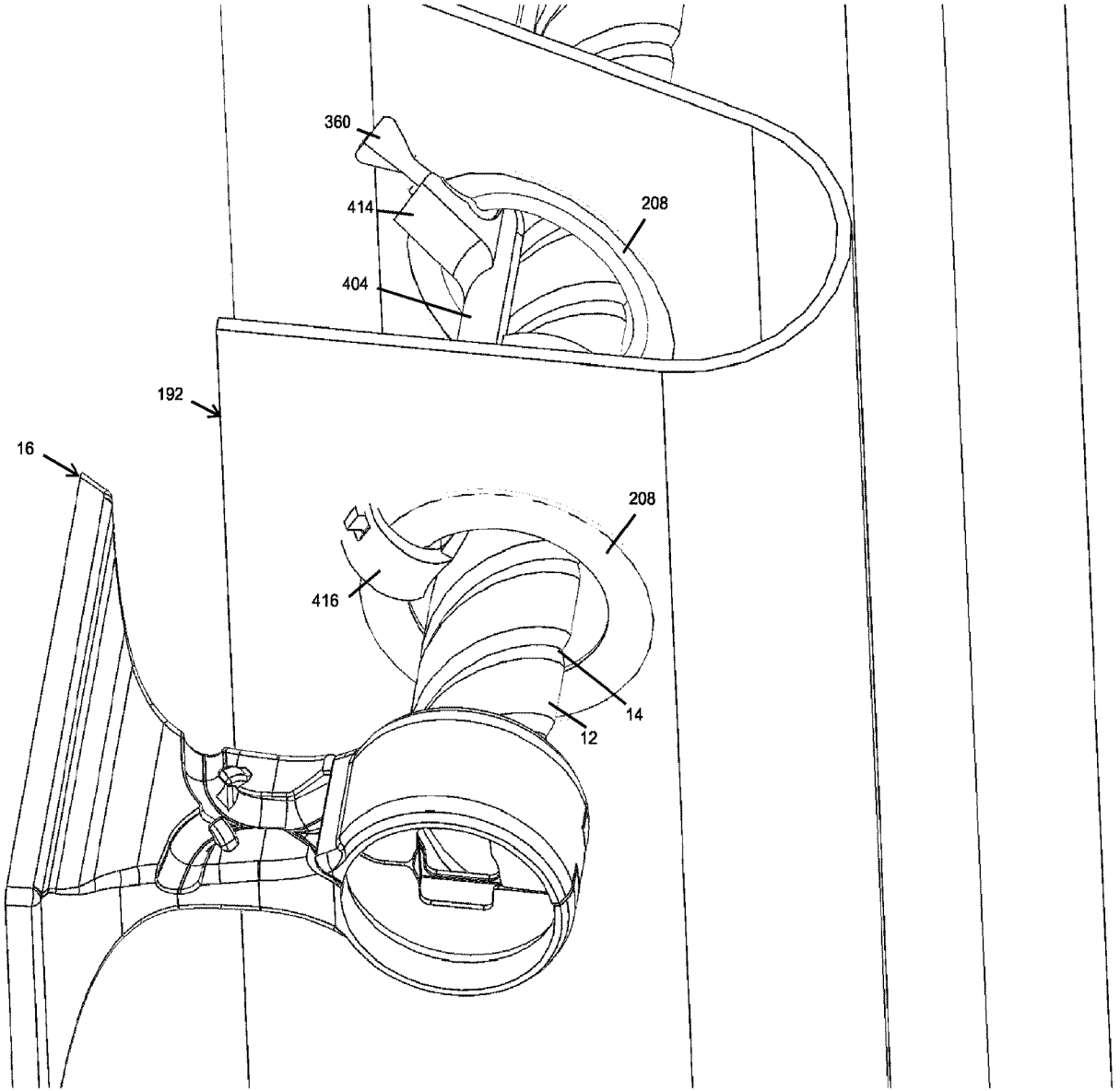
FIG. 39 is a perspective view of an alternative arrangement of a motorized grommet drapery apparatus, shown in FIGS. 38-45; the view showing a grommet driver connected to shade material.

In addition, the size and shape of the slot 338 is configured to allow grommet clip 348 to extend into slot 218 in a generally aligned manner, such that the grommet clip 348 as well as the grommet 208 it holds is perpendicular to the length of drive element 12, as well as at an angle. That is, in one arrangement, as is shown in FIGS. 36 and 37, it is desirable to have the grommet clip 348 and grommet 208 extend through slot 338 at an angle such that the inward most and second inward most grommets 208 extend at an angle to one another causing the shade material 192 between the inward most and second inward most grommets 208 to be formed in a properly spaced V-shaped formation, which many users prefer as an optimal configuration.

More specifically, in one arrangement, as is shown, the outward wall 336 curves from its lower end to its upper end in a generally continuous arcuate manner and the inner wall 334 curves from its lower end to its upper end, and includes a point or neck 340 that extends inward into slot 326 which defines a narrower point of the slot 338 which helps to hold grommet clip 348 within slot 338. However any other shape for inner wall 334 and outer wall 336 are hereby contemplated for use.

A locking member 342 is connected to the upper surface of main body 330 and extends inward therefrom a distance. Locking member 342 extends past the inward edge of main body 330. Locking member 342 is sized and shaped to be received within slot 326 and engage collar 324 thereby selectively locking the locking member 342 to collar 324. In the arrangement shown, as one example, locking member 342 is a generally elongated member that slightly tapers and narrows as it extends away from main body 330. A feature 344 is connected to the upward, outward end of the locking member 342 that facilitates locking to collar 324. In the arrangement shown, feature 344 includes an angled leading edge that extends upward as it extends rearward that facilities easy insertion into slot 326 of collar 324. The angled leading edge of feature 344 connects to a vertical that extends between the upper surface of locking member and the angled leading edge of feature 344.

When locking member 342 is inserted within slot 326 of collar 324, the angled leading edge helps guide the insertion of locking member 342 into slot 326 and once fully inserted, under the spring bias of locking member 342 deflecting to allow insertion within slot 326, the vertical wall engages the inward edge of collar 324 thereby locking first grommet clip 328 to grommet driver 216 and more specifically to collar 324. To remove first grommet clip 328 from grommet driver 216, the inward end of locking member 342 is depressed by applying a force thereon. This causes the elongated arm of locking member 342 to deflect. Once the elongated arm of locking member 342 deflects to the point where the vertical face of feature 344 clears the inward surface of the center wall of collar 324 the first grommet clip attachment 328 can be removed from the main body of grommet driver 216 by pulling the locking member 342 through the slot 326 thereby separating the first grommet clip attachment 328 from the grommet driver 216.

In one arrangement, a lead 346 connects adjacent grommet clips 348. Lead 346 is formed of any suitable size, shape and design and is configured to set the spacing of adjacent grommet clips 348. In the arrangement shown, as one example, grommet clips 348, like grommet clips 226, are configured to receive and hold grommets 208 therein. In one arrangement, as is shown, grommet clips 348 include a main body 350. Main body 350 is formed of any suitable size, shape and design and is configured to connect to a grommet 208 of shade material 192. In the arrangement shown, as one example, main body 350 includes an inner wall 352 and an outer wall 354 that extend generally perpendicularly away from the exterior surface of drive element 12 in approximate parallel spaced relation to one another thereby defining a slot 356 between the facing surfaces of inner wall 352 and outer wall 354, and in approximate perpendicular relation to the exterior surface of drive element 12. It is important to note that grommet clips 348 are paired into pairs of grommet clips 348 that connect to adjacent grommets 208. That is, because the shade material 192 of a grommet drapery extends in a generally sinusoidal curve, adjacent grommet clips 348 are defined with respect to one another with the inward edges or inner walls 352 of one pair of adjacent grommet clips 348 facing each other and the outward edges or outer walls 354 of adjacent grommet clips 348 facing away from each other, whereas the next adjacent pair of adjacent grommet clips 348 have the opposite arrangement, wherein the outer walls 354 of adjacent grommet clips 348 face toward each other and the inner walls 352 of adjacent grommet clips face away from each other. With reference to FIG. 37 which shows a pair of adjacent grommet clips 348 that are paired off with their inner walls 352 facing one another and their outward walls 354 facing away from one another. As such, the grommet clips 348 are essentially paired off, with each grommet clip 348 forming one half of a pair with the adjacent grommet clips 348 on each side of the grommet clip.

To facilitate the reception of a grommet 208 within the slot 356, when viewed from the front or rear side, the size and shape of the slot 356 is configured to receive grommet 208 with close and tight tolerances such that grommet 208 is easily inserted within, as well as removed from, slot 356 and once grommet 208 is within slot 356 grommet clip 348 applies a frictional force on grommet 208 thereby holding grommet 208 within grommet clip 348.

More specifically, in one arrangement, the outward wall 354 curves from its lower end to its upper end in a generally continuous arcuate manner and the inner wall 352 curves from its lower end to its upper end, and includes a point or neck 358 that extends inward into slot 356 which defines a narrower point of the slot 356 which helps to hold grommet 208 within slot 356. However, any other shape for inner wall 334 and outer wall 336 are hereby contemplated for use.

To further help facilitate insertion of grommets 208 within the slots 356 of grommet clips 348, an inward flange 360 is connected to the outward end of inner wall 352 and an outer flange 362 is connected to the outward end of outer wall 354. More specifically, the inner wall 352 curves around to form one side of slot 356. The upper end of inner wall 352 angles inward. The inner flange 360 connected to the upper end of inner wall 352 extends upward and outward therefrom. Similarly, the outer wall 354 curves around to form one side of slot 356. The upper end of outer wall 354 angles inward. The outer flange 362 connected to the upper end of outer wall 354 extends upward and outward therefrom. As such, the combination of the upwardly and outwardly extending inner flange 360 and outer flange 362 provide a V-shaped entry point that helps to guide grommet 208 within grommet clip 348. In the arrangement shown, the inner flange 360 extends farther than the outer flange 362. In one arrangement, this is acceptable and does not detract from the aesthetic appearance of the system as the inner flange 360 is configured to be placed on the rear side of the shade material 192, whereas the smaller, and less noticeable outer flange 362 is configured to be placed on the forward side of the shade material 192. By placing the larger inner flange 360 on the back side of the shade material 192, the shade material 192 hides the larger inner flanges 360 from view.

Grommet clips 348 are connected to grommets 208 in consecutive order. That is, the inward most grommet clip 348 is connected to the inward most grommet 208, and so on. Once the grommet clips 348 are installed, the inward most grommet clip 348 is installed in the first grommet clip attachment 328. In doing so, the grommet clip 348 is inserted within the slot 338 of the first grommet clip attachment 328 and the interior surfaces of the inner wall 334 and outer wall 336 engage and lock onto the inner wall 352 and outer wall 354 of grommet clip 348. In one arrangement, as is shown, the neck 340 that extends into the slot 338 of first grommet clip attachment 328 engages and locks onto the corresponding neck 358 of grommet clip 348 thereby holding the grommet clip 348 within slot 338.

In one arrangement, grommet clips 348 are positioned at fixed spacing along lead 346. In an alternative arrangement, grommet clips 348 may be positioned at any spacing along lead 346 which allows a user to adjust the grommet clips 348 to any desired position for any shade material 192.

In operation, as the shade material 192 is moved toward a closed position, as the slack is taken up in the lead 346, the grommet clips 348 stop at their respective positions as the lead is drawn tight by the movement of grommet driver 216. At a fully closed position, each grommet clip 348 is in place in its respective position. In this way, the addition of lead 346 controls the spacing of the grommets 208 and provides a consistent and desirable appearance to shade material 192 when shade material 192 is in a closed position.

In one arrangement, as is shown, the grommet clips 348 include one or more teeth 364. Teeth 364 are formed of any suitable size, shape and design and are configured to facilitate connection to and hold of shade material 192 and/or grommet 208. In one arrangement, as is shown, a plurality of teeth 364 extend inward from inner flange 360 of grommet clip 348 and engage and hold on to shade material 192 and/or grommet 208.

Grommet Drapery 400:

In an alternative arrangement, with specific reference to FIGS. 38-45, an alternative arrangement of a grommet drapery 400 is presented. In this arrangement, as one example, grommet drapery 400 includes a grommet driver 216 that has a main body that is generally cylindrical in shape. The main body of grommet driver 216 has a generally cylindrical shape that has an exterior surface 302 and an interior surface 304 that are both generally smooth and cylindrical in shape when viewed from an end. The main body of grommet drivers 216 extend a lateral length from an inward end 306 to an outward end 308 in a generally cylindrical manner.

The interior surface 304 of grommet driver 216 is sized and shaped to fit over the exterior shape of drive element 12. In the arrangement shown, the interior surface 304 of grommet driver 216 includes one or more teeth 202. Tooth 202 is sized and shaped to receive guide structure 14 of drive element 12. In the arrangement shown, when grommet driver 216 is viewed from an end 306, 308, tooth 202 is generally triangular in shape, or pointed, however any other size, shape and design is hereby contemplated for use.

In the arrangement shown, as one example, the upper end of main body of grommet driver 216 includes at least one feature, and in the arrangement shown a pair of features 402. Features 402 are formed of any suitable size, shape and design and facilitate connection of the main body of grommet driver 216 to a carrier 404 that connects to the inward most grommet 208 and the second inward most grommet 208.

In the arrangement shown, as one example features 402 are compressible friction-fit members or snap fit members that are configured to be inserted into and through openings 406 in carrier 404 and lock thereto. However, any other form of a member is hereby contemplated for use as feature 402, such as a conventional screw or bolt arrangement, a snap-fit feature, a locking member, gluing, welding, adhering, or by forming the main body and carrier 404 out of a single piece of material such as by casting, molding or machining, or any other process, manner or method.

Carrier 404 is formed of any suitable size, shape and design and is configured to connect to and hold the inward most grommet 208 and the second inward most grommet 208 in spaced relation to one another. In one arrangement, as is shown, carrier 404 extends a length from opposing ends 408 and has a generally curved upper surface and lower surface that mimic the curvature of drive element 12.

In one arrangement, as is shown, to facilitate a stronger connection and to ensure proper and precise alignment, the cylindrical main body of grommet driver 216 to the carrier 404, a recessed section 410 is positioned in the lower surface of carrier 404. Recessed section 410 is a recess or plurality of recesses that are configured to receive the main body of grommet driver 216 therein and in doing so properly aligns the main body of grommet driver 216 with the carrier, such that the length of carrier 404 between opposing ends is in alignment with a center axis that extends through the center of the cylindrical main body of grommet driver 216. In the arrangement shown, the outward edges of recessed section 410 form steps in the lower surface of carrier 404 that align with the outward edges of main body of grommet driver 216.

The outward ends 408 of carrier 404 include a connector member 412. Connector member 412 is formed of any suitable size, shape and design and is configured to connect to and hold a grommet clip 348 which holds a grommet 208 of shade material 192. In the arrangement shown, as one example, each end 408 of connector member 412 includes an inner wall 414 and an outer wall 416 that extend generally perpendicular away from the exterior surface of carrier 404 in approximate parallel spaced relation to one another thereby defining a slot 418 between the opposing facing surfaces of inner wall 414 and outer wall 416, and in approximate perpendicular relation to the length of carrier 404.

To facilitate the reception of a grommet clip 348, which holds a grommet 208, within the slot 418, when viewed from the front or rear side, the lower end of slot 418 has a U-shape. Or, said another way, the lower end of slot 418 has a semicircular shape that matches, mirrors or corresponds to the size and shape of the lower surface of grommet clip 348, as is further described herein.

Figure 40:
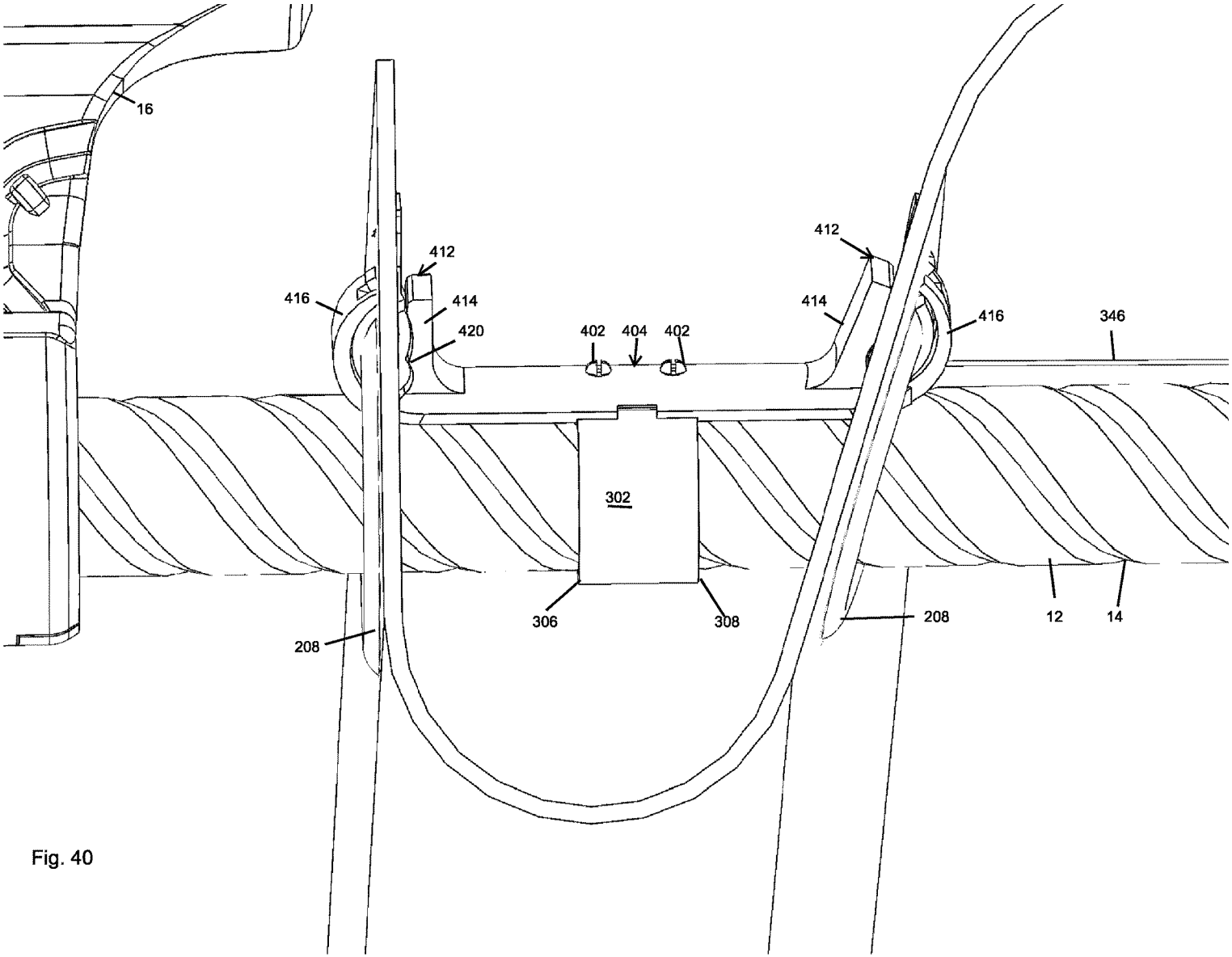
FIG. 40 is a close up top perspective of the view shown in FIG. 39.
Figure 41:
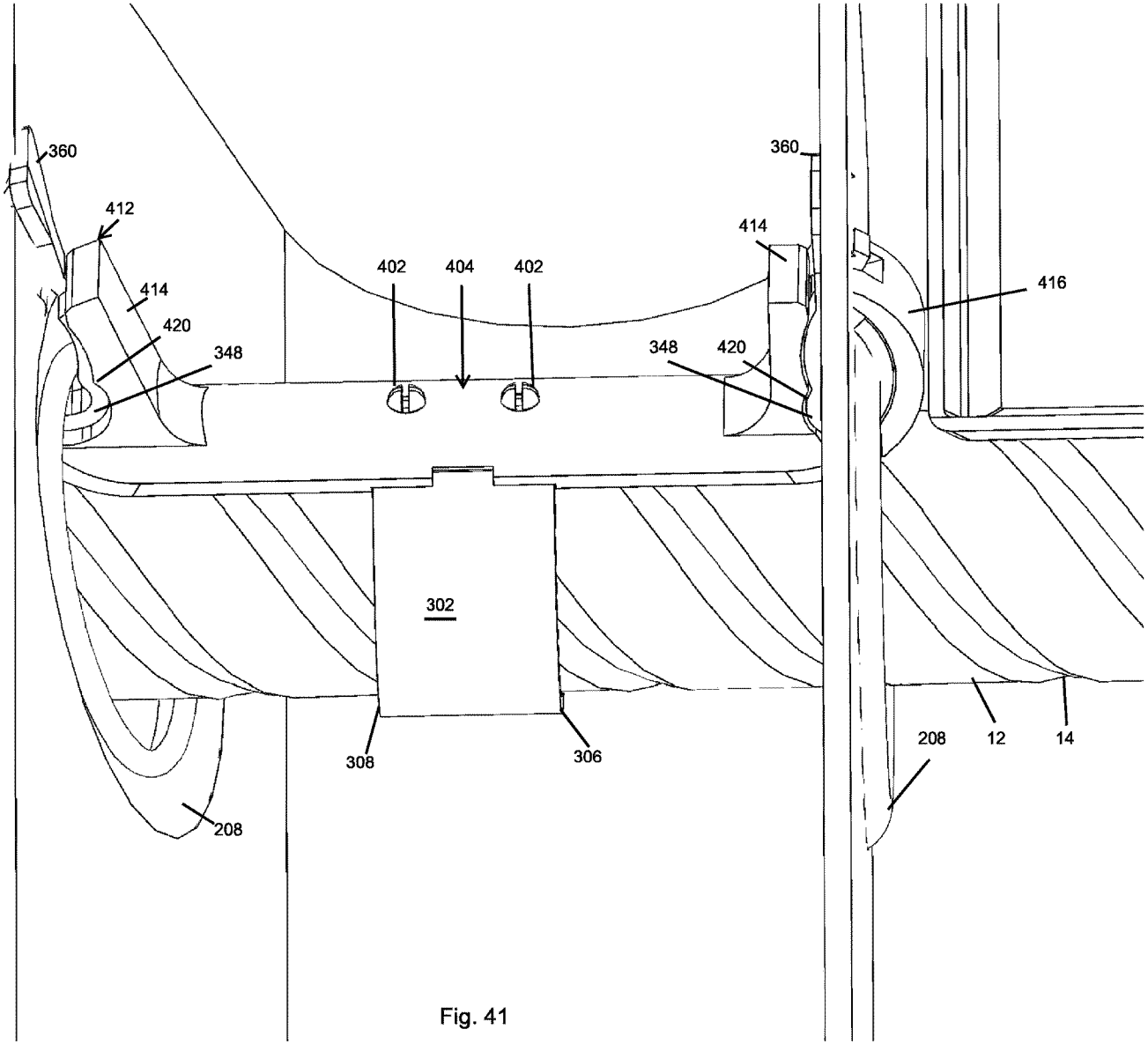
FIG. 41 is a close up rear elevation of the view shown in FIG. 40.
Figure 42:
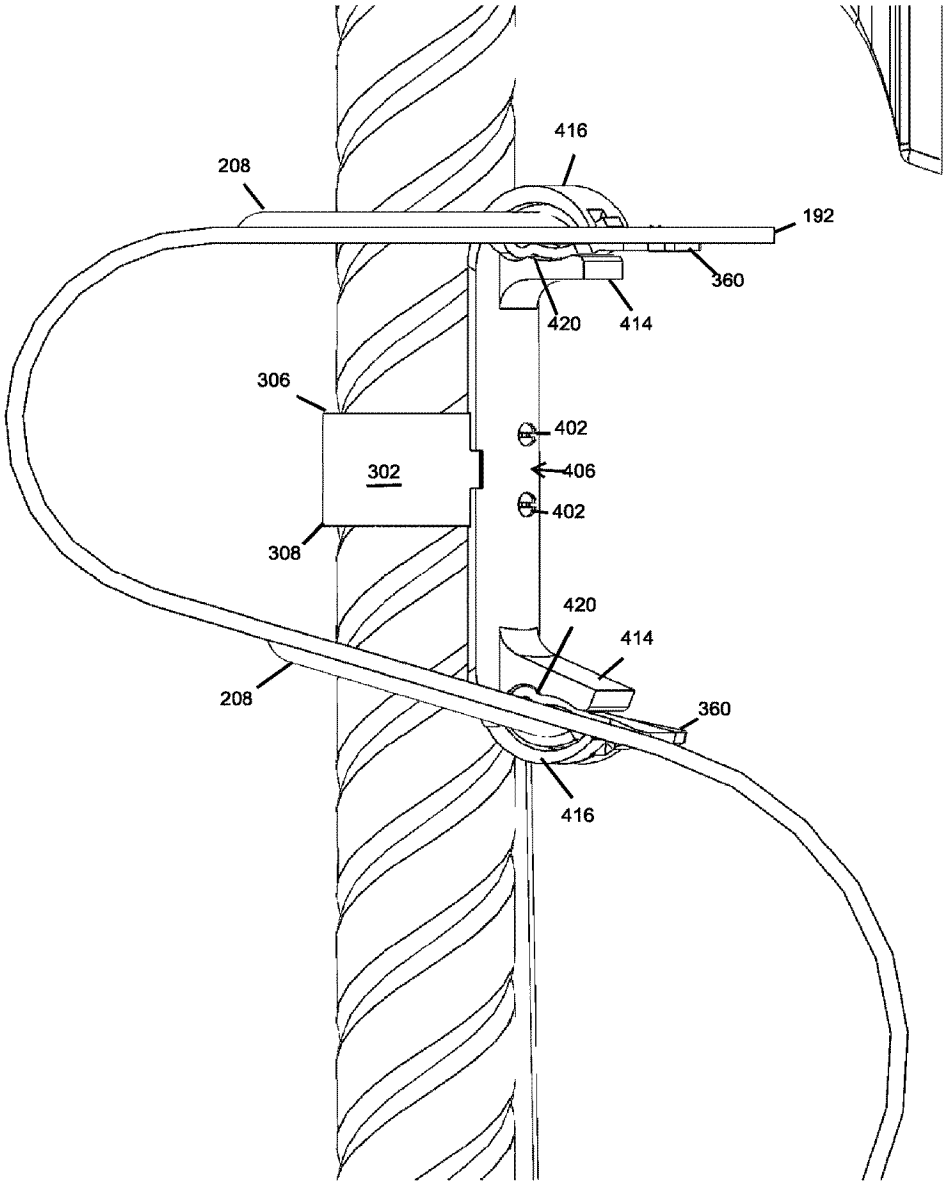
FIG. 42 is a close up top elevation of the view shown in FIG. 41.
Figure 43:
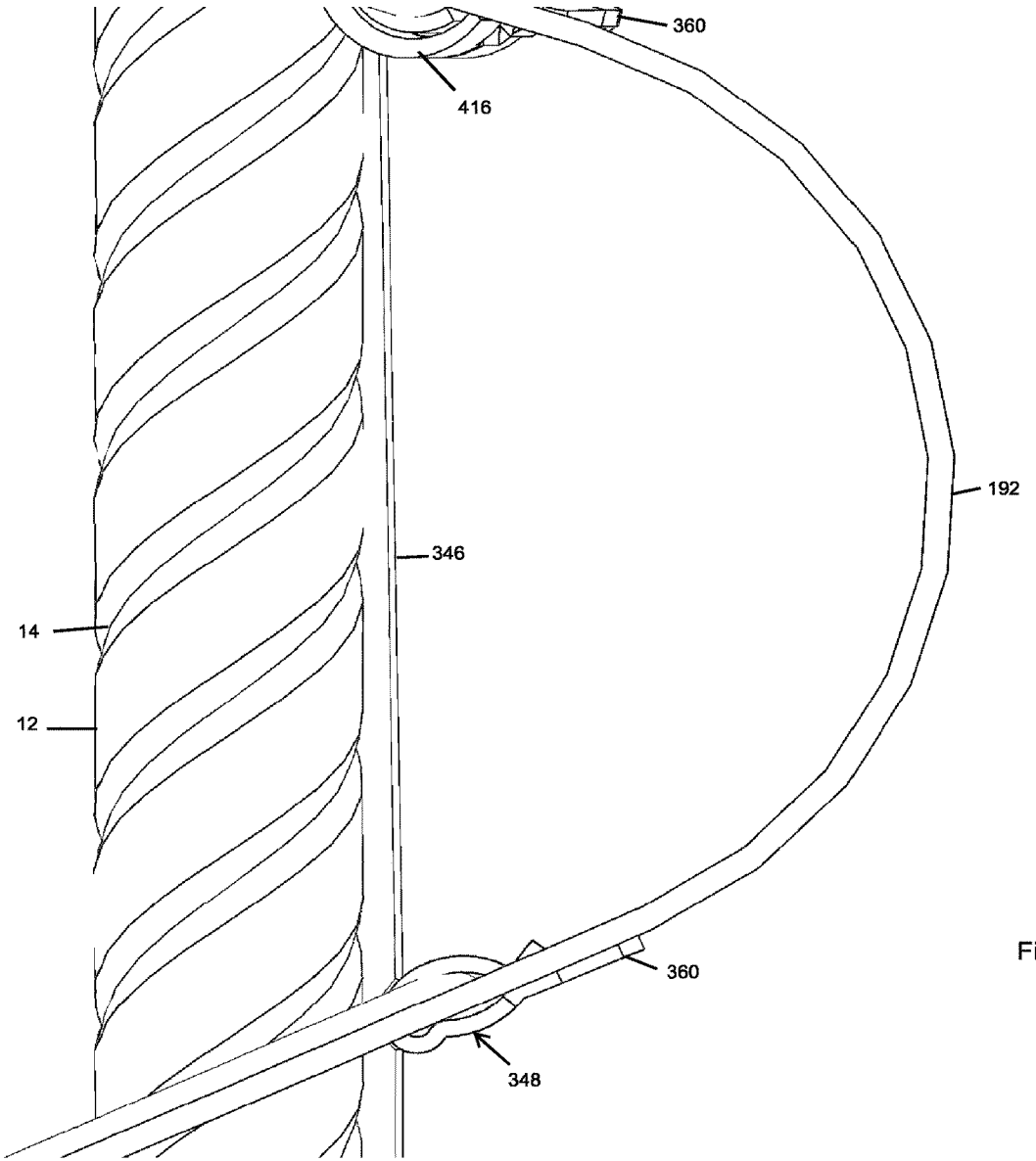
FIG. 43 is a close up top elevation of the view shown in FIG. 42.
Figure 44:
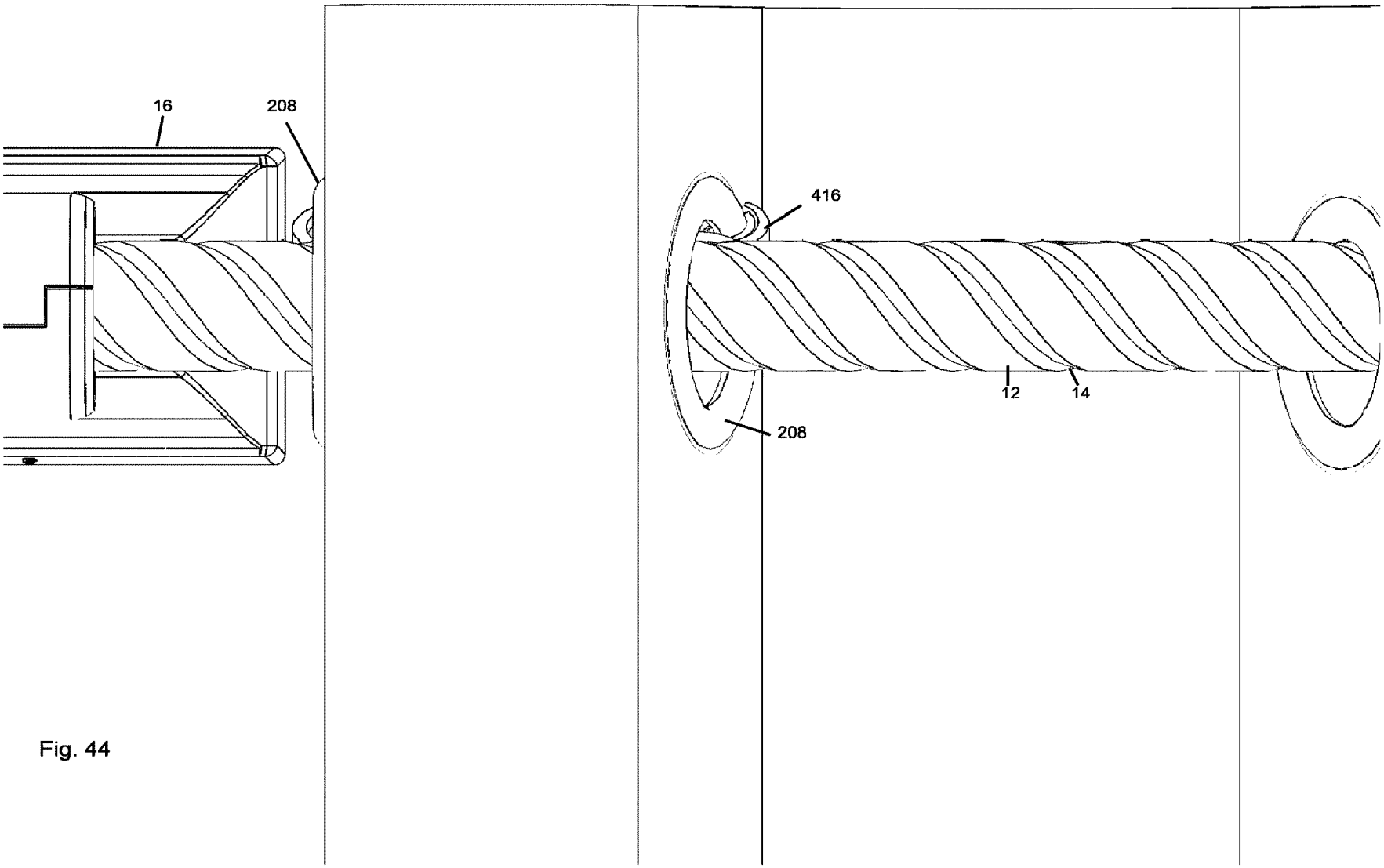
FIG. 44 is a close up front elevation of the view shown in FIG. 38-43.
Figure 45:
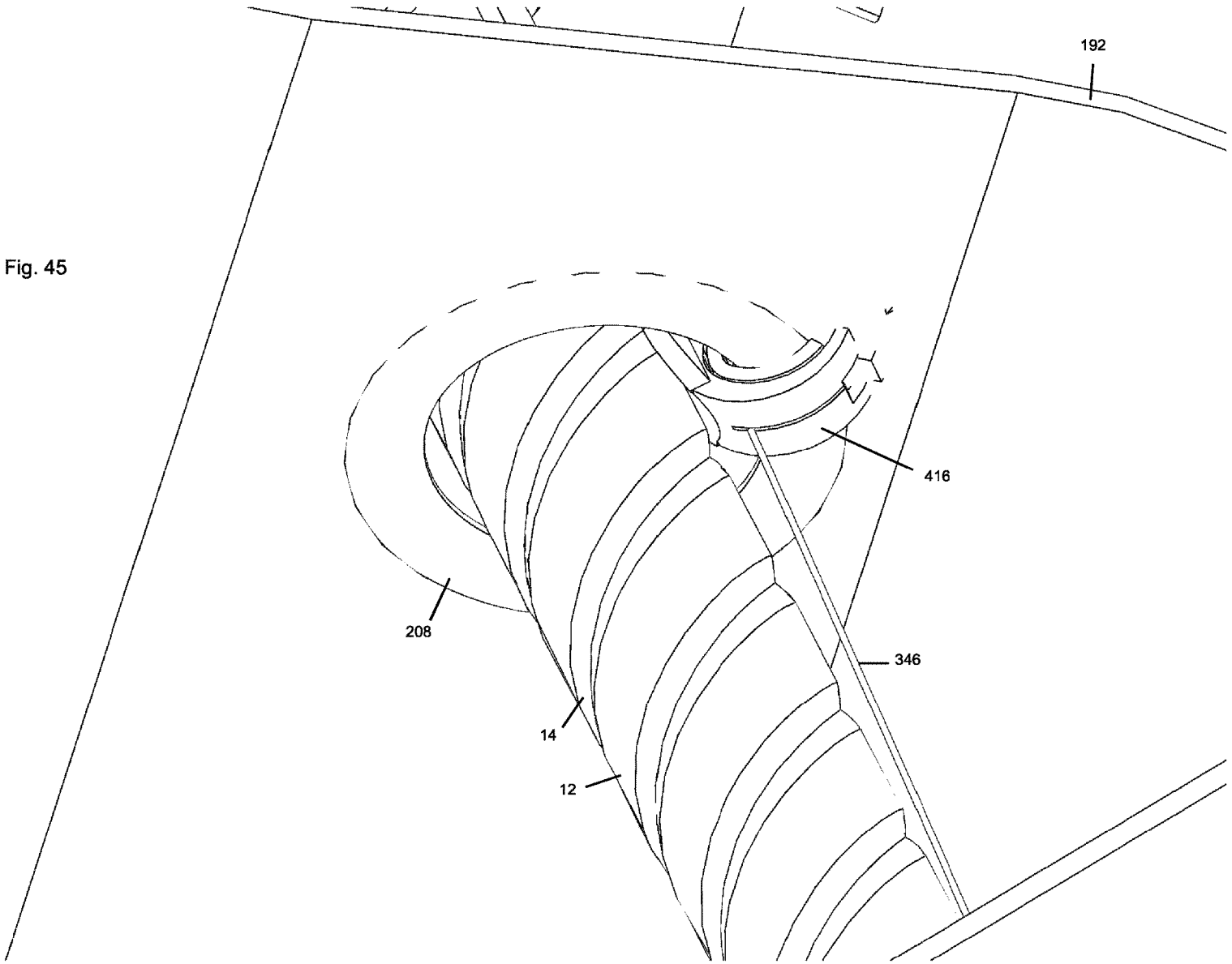
FIG. 45 is a close up perspective view of the view shown in FIG. 38-44.
Figure 46:
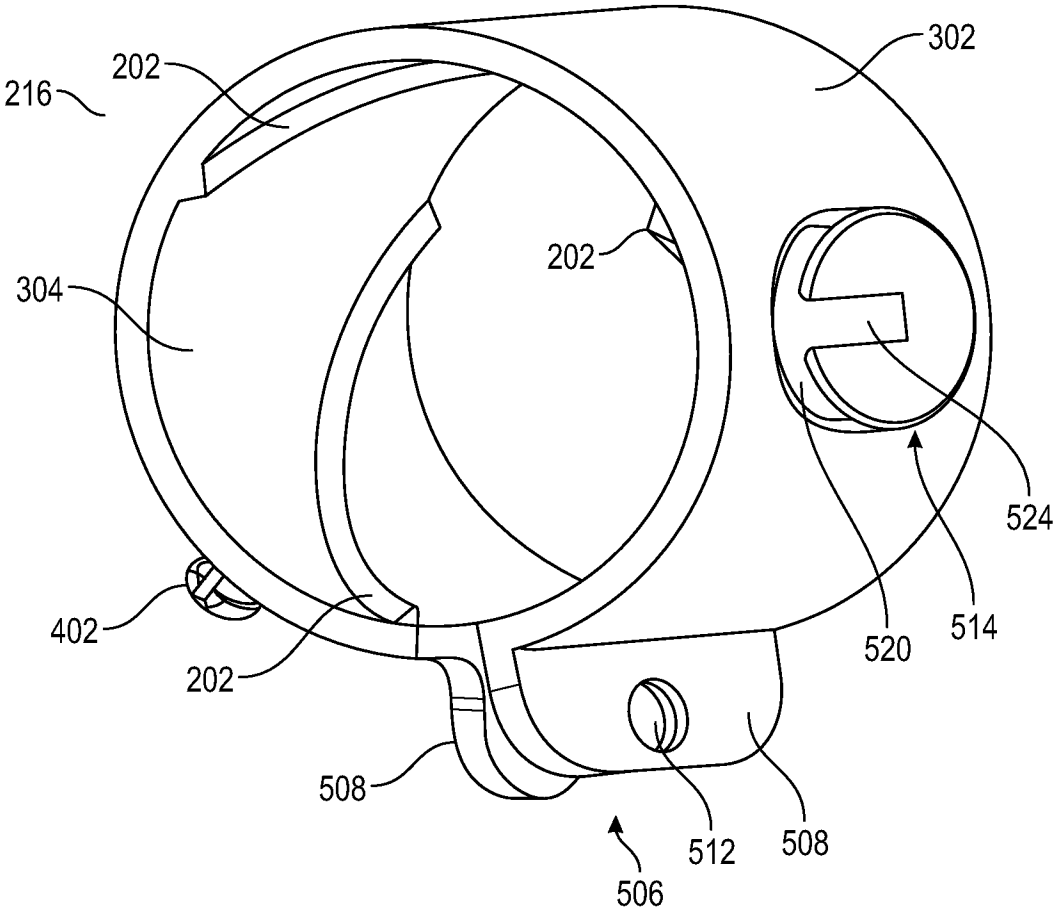
FIG. 46 is a perspective view of a grommet driver that can be used with a tabbed drapery, however this same driver can also be used with a grommet drapery as well; the view showing the tabbed driver having a generally cylindrical body that is configured to fit over a drive element; the view showing three teeth positioned on the interior surface of the tabbed driver, wherein each tooth is configured to be engaged within a groove of the drive element, however in a manual system, these teeth are not present so as to allow the tabbed driver to slide over the drive element; the view showing the grommet driver having a joint that allows the cylindrical body of the grommet driver to open and slide over the drive element allowing the grommet driver to be installed on any portion of the drive element, the joint also allows the grommet driver to be opened slightly so as to allow the teeth to come out of the grooves of the drive element to that it can be moved along the length of the drive element, when the tabs of the joint are connected the teeth of the grommet driver fit within the grooves of the drive element; the view showing a socket that receives a tack that connects the grommet driver to the tabbed drapery shade material; the view showing the grommet driver in a slightly opened position, with the tabs slightly spaced apart.
Figure 47:
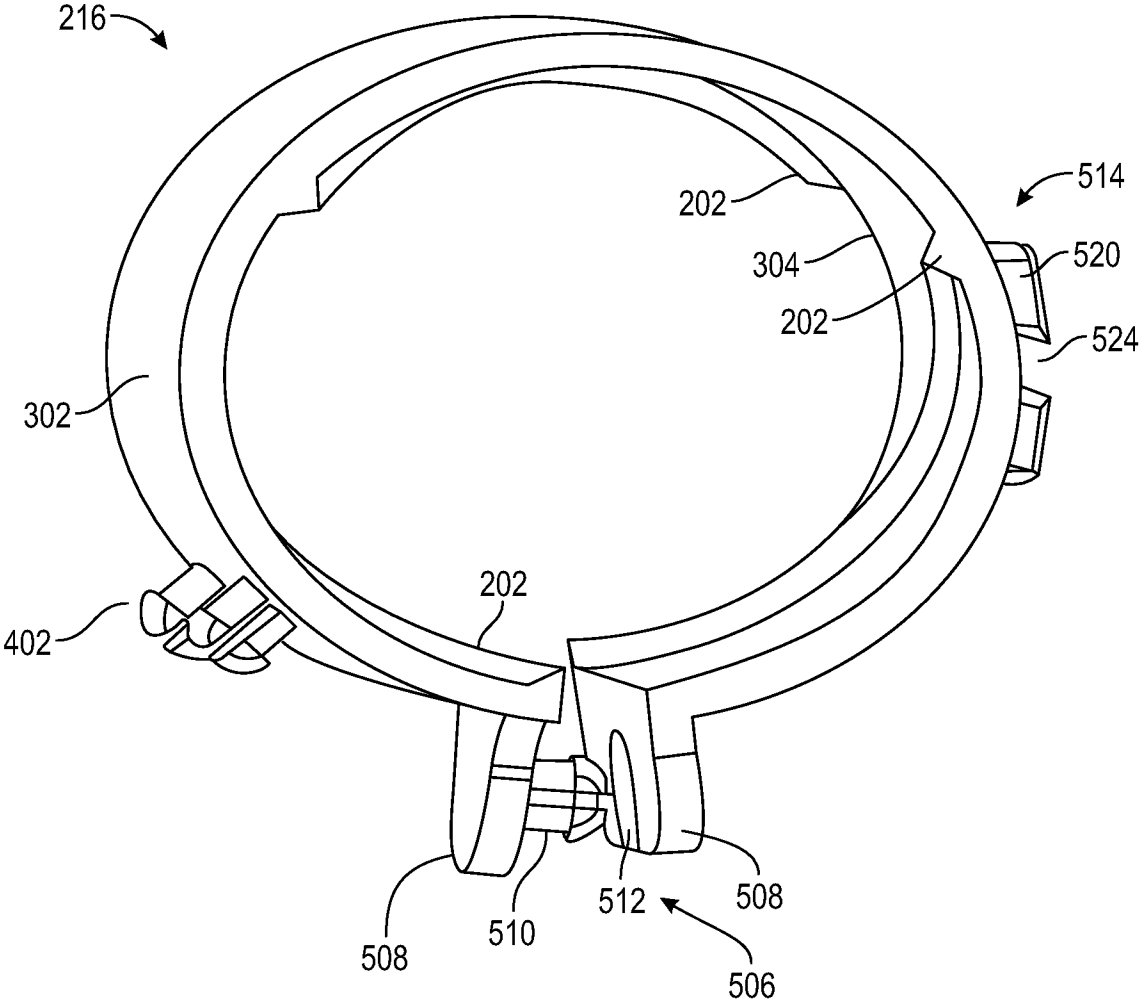
FIG. 47 is a perspective view of the grommet driver shown in FIG. 46, the view from an angle more towards the end of the grommet driver.
Figure 48:
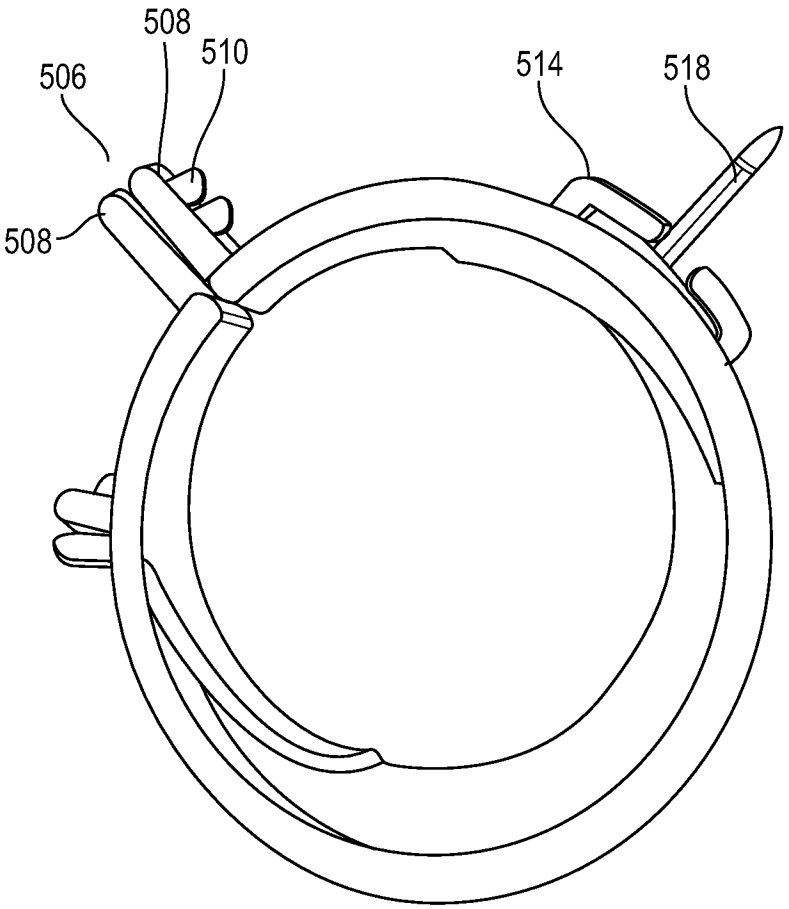
FIG. 48 is an elevation view of an end of the grommet driver shown in FIGS. 46 and 47; the view showing the grommet driver in a closed position; the view showing a tack held within the socket.
Figure 49:
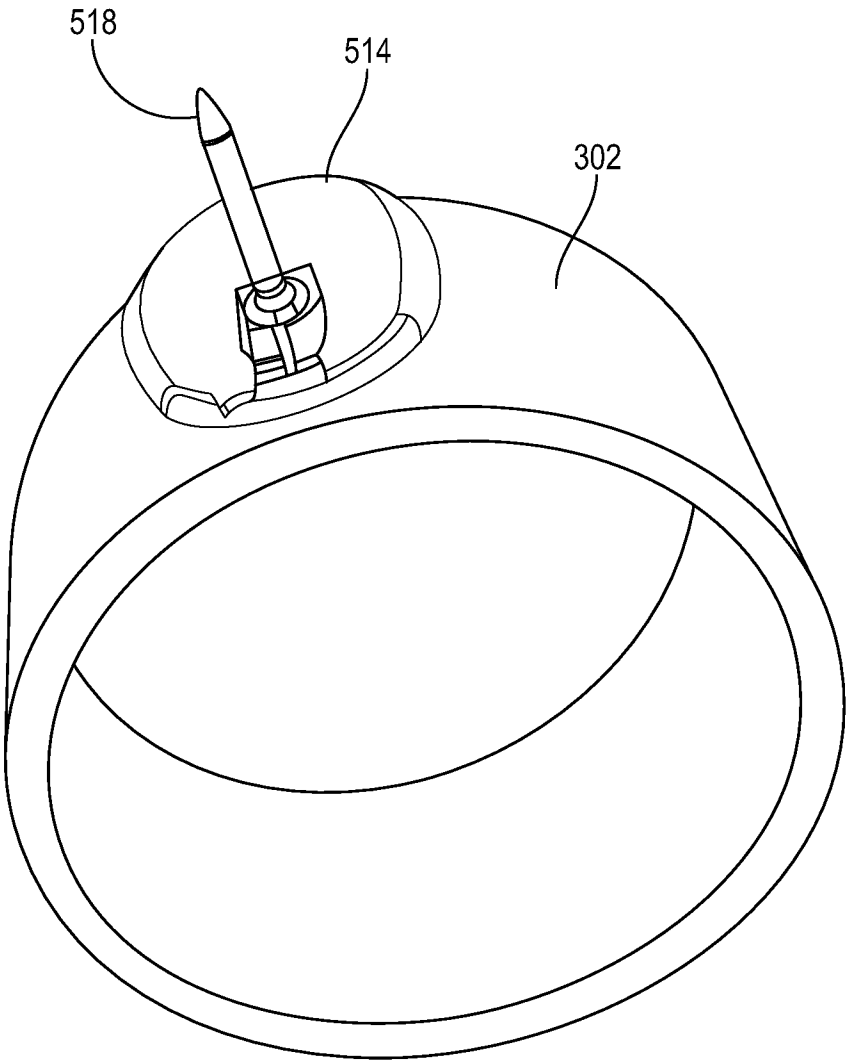
FIG. 49 is another perspective view of the grommet driver shown in FIGS. 46-48.
Figure 50:
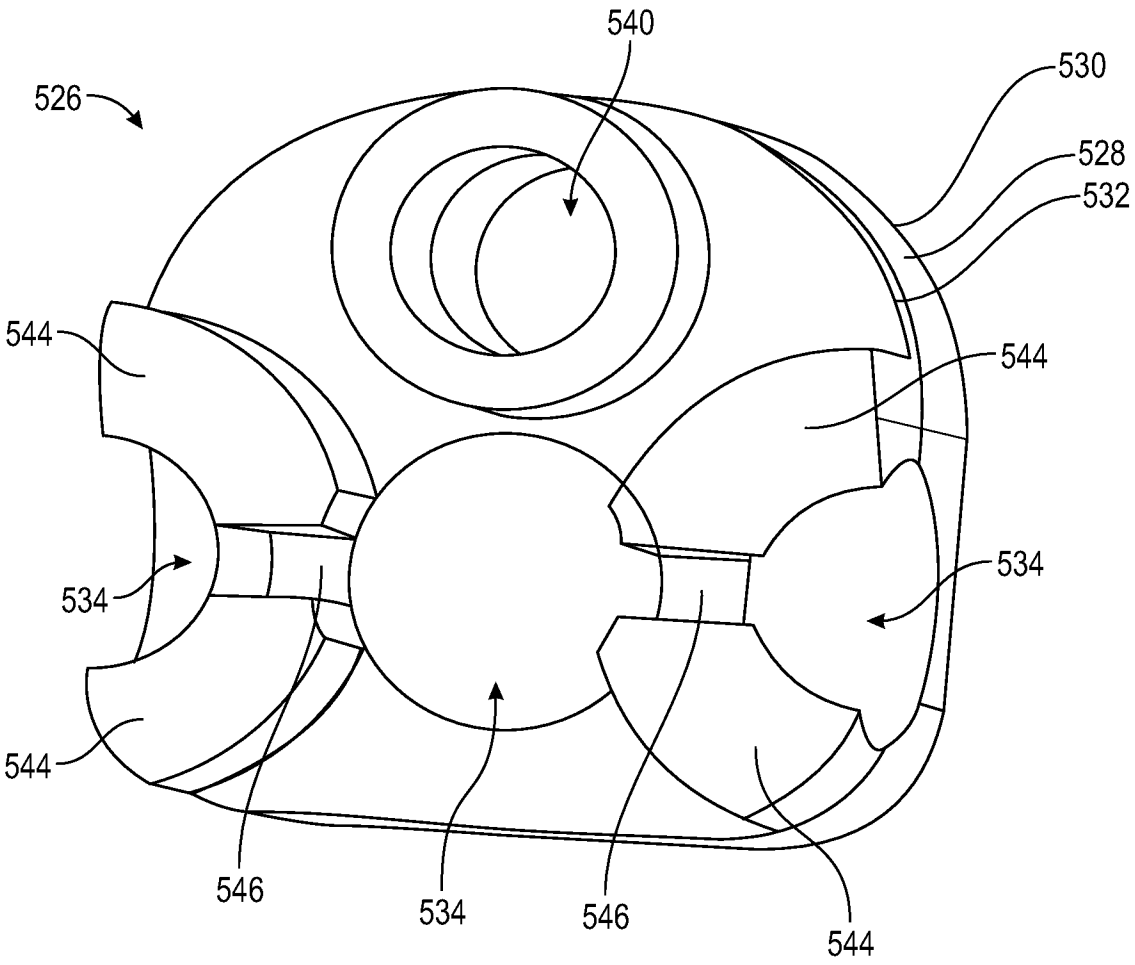
FIG. 50 is a perspective view of a cap used in association with a tabbed drapery, a back tabbed drapery, a pocket drapery, a grommet drapery, a ripple fold drapery, a pinch pleat drapery, or any other drapery; the view showing the back side of the cap having a generally planar body with three features that are configured to receive and engage beads of a beaded cable; the view showing an opening at its upper end that is configured to receive the shaft of a tack held by a socket of a grommet driver; the cap used to set the spacing between the grommet driver and idler rings.
Figure 51:
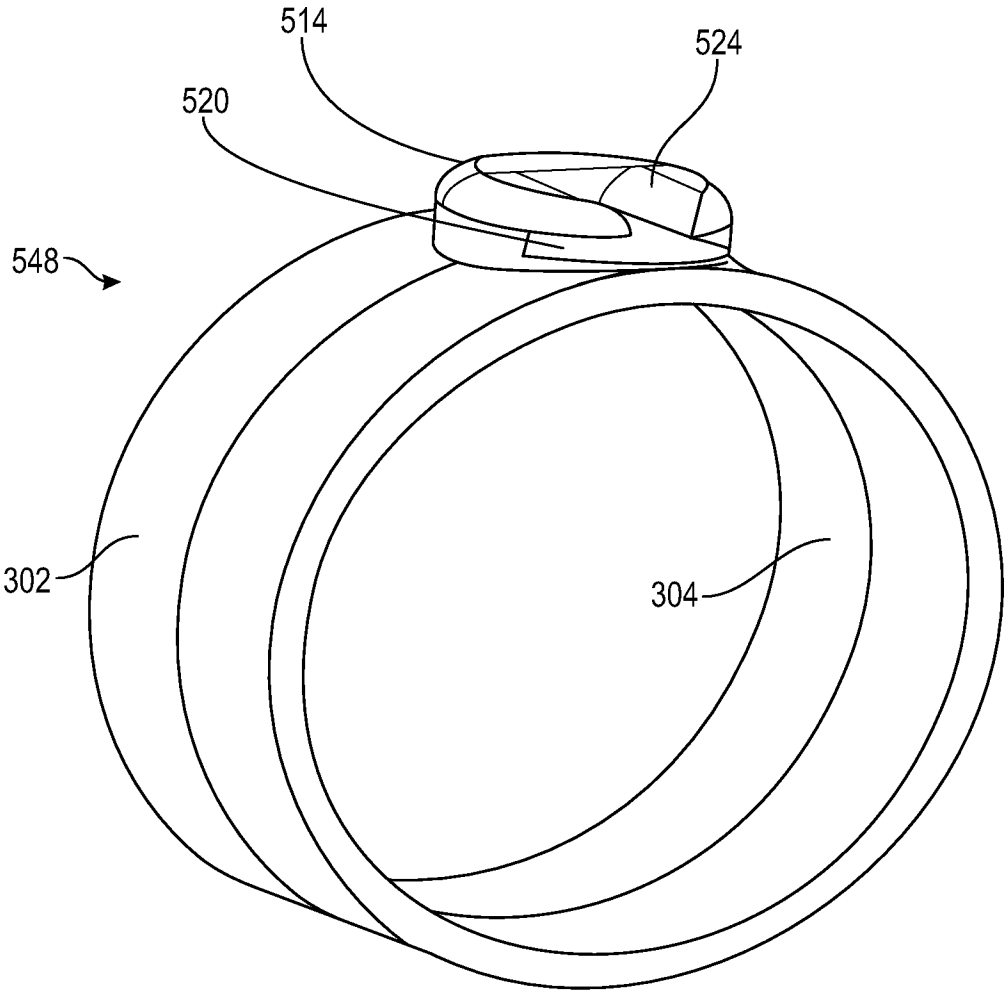
FIG. 51 is a perspective view of an idler ring; the view showing the idler ring having a cylindrical main body having a smooth exterior and a smooth interior so as to allow the idler ring to slide over the drive element; the view showing a socket in the exterior surface of the idler ring that is configured to receive a tack that facilitates connection to the drapery material as well as the cap shown in FIG. 50.
Figure 53:
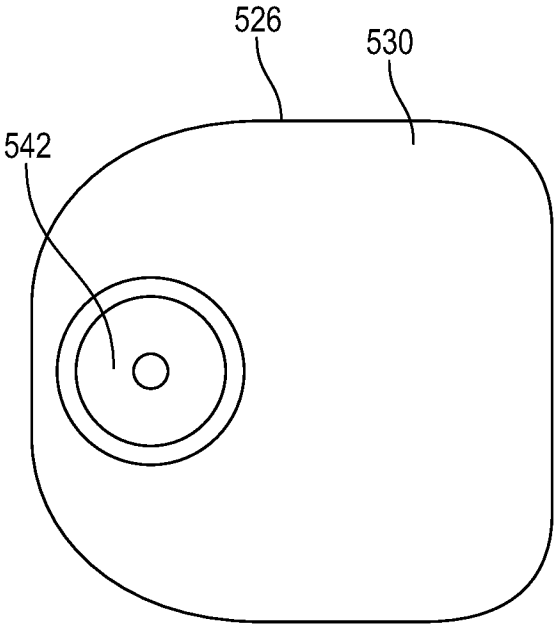
FIG. 53 is an elevation view of the forward side of a cap, or side that faces the drive element; the view showing a collar positioned within the opening in the top side of the cap, the collar configured to receive the shaft of a tack.
Figure 52:
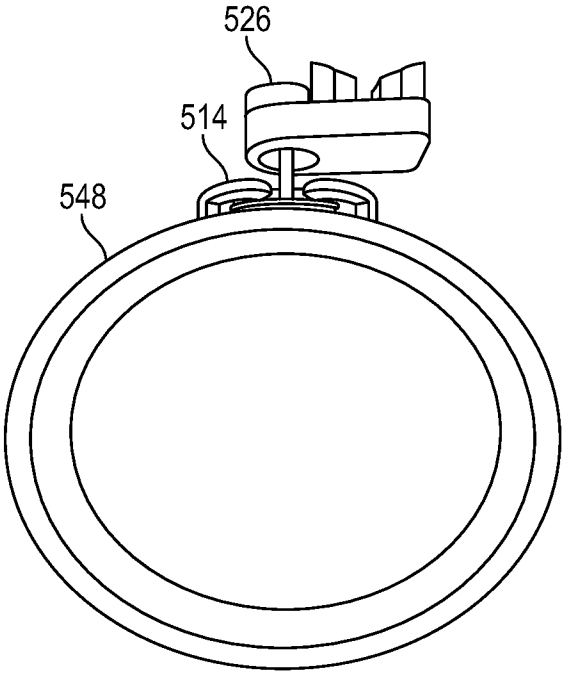
FIG. 52 is an elevation view of the idler ring shown in FIG. 51; the view showing a tack held within the socket; the view showing the cap of FIG. 50 connected to the shaft of the tack.
Figure 54:
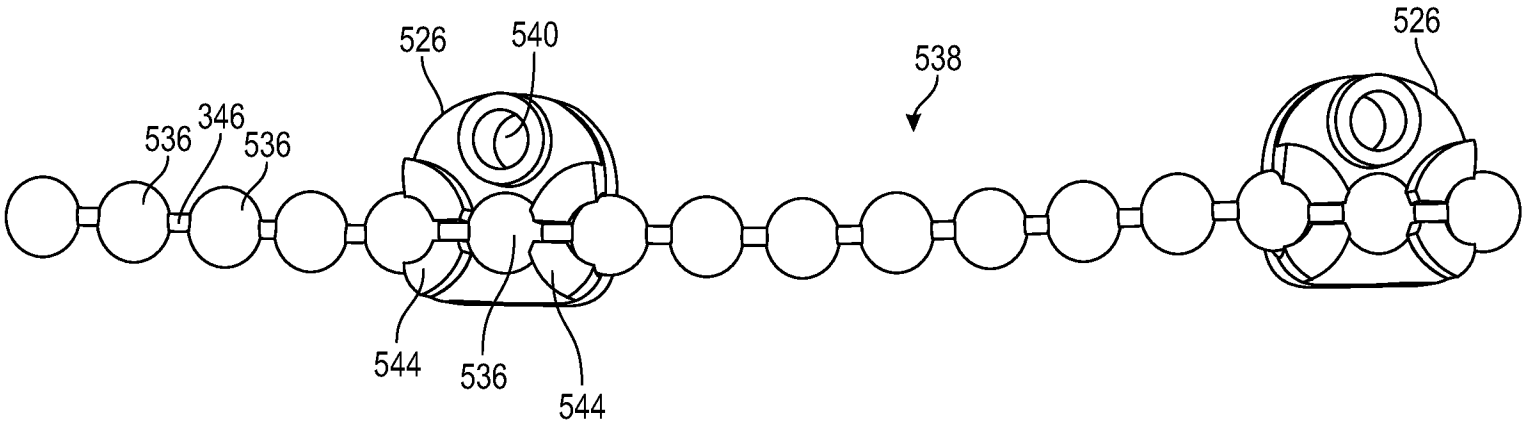
FIG. 54 is an elevation view of a beaded cable connected to a pair of caps; the view showing the beads of the beaded cable held within features in the back side of the caps, in this way, the beaded cable sets the distance between adjacent caps which sets the distance between tabs of the tabbed drapery which sets the distance between folds or ripples in the drapery material.
Figure 55:
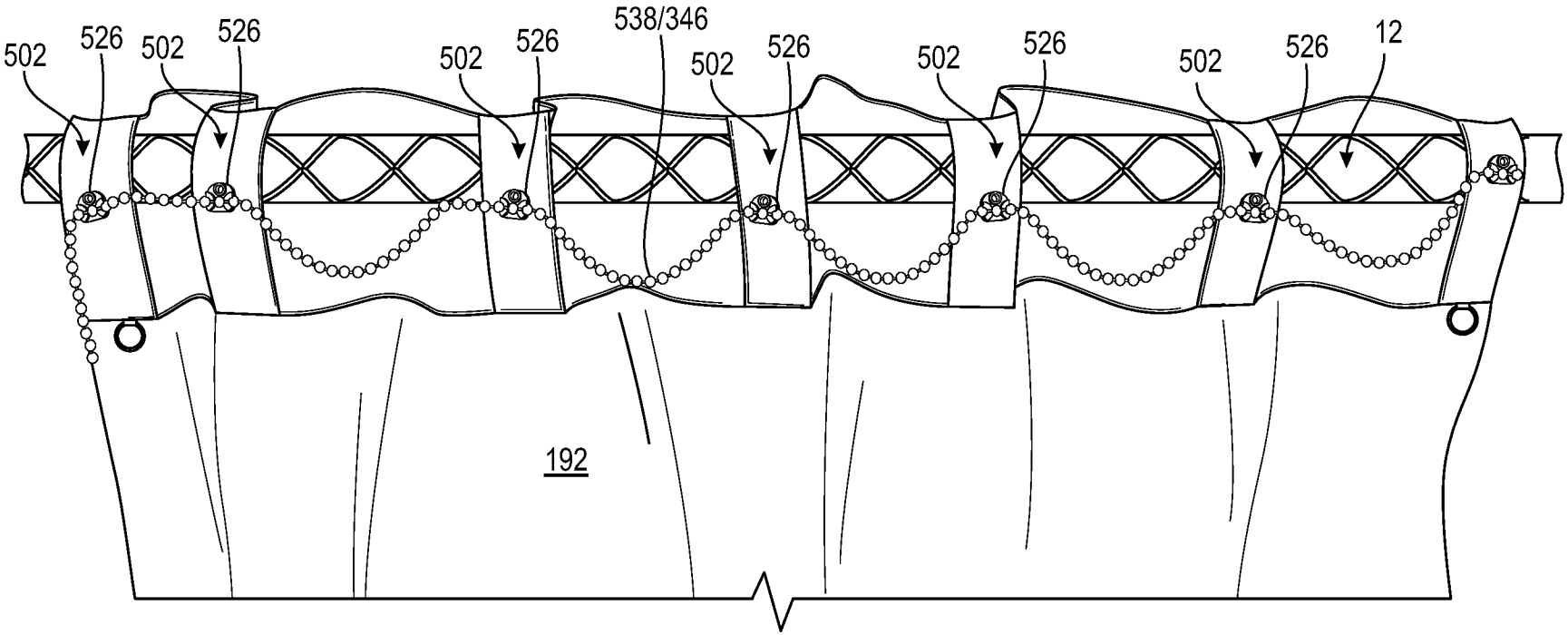
FIG. 55 is an elevation view of the back side of a back-tabbed drapery attached to a drive element having a helical guide structure therein; the view showing a beaded cable connected to a plurality of caps such that the beaded cable sets the maximum allowed distance between adjacent caps; the view showing each cap connected to a tab of the drapery, each cap is connected to an idler ring with one cap connected to a driver ring; the view showing the drapery in a closed position.
Figure 56:
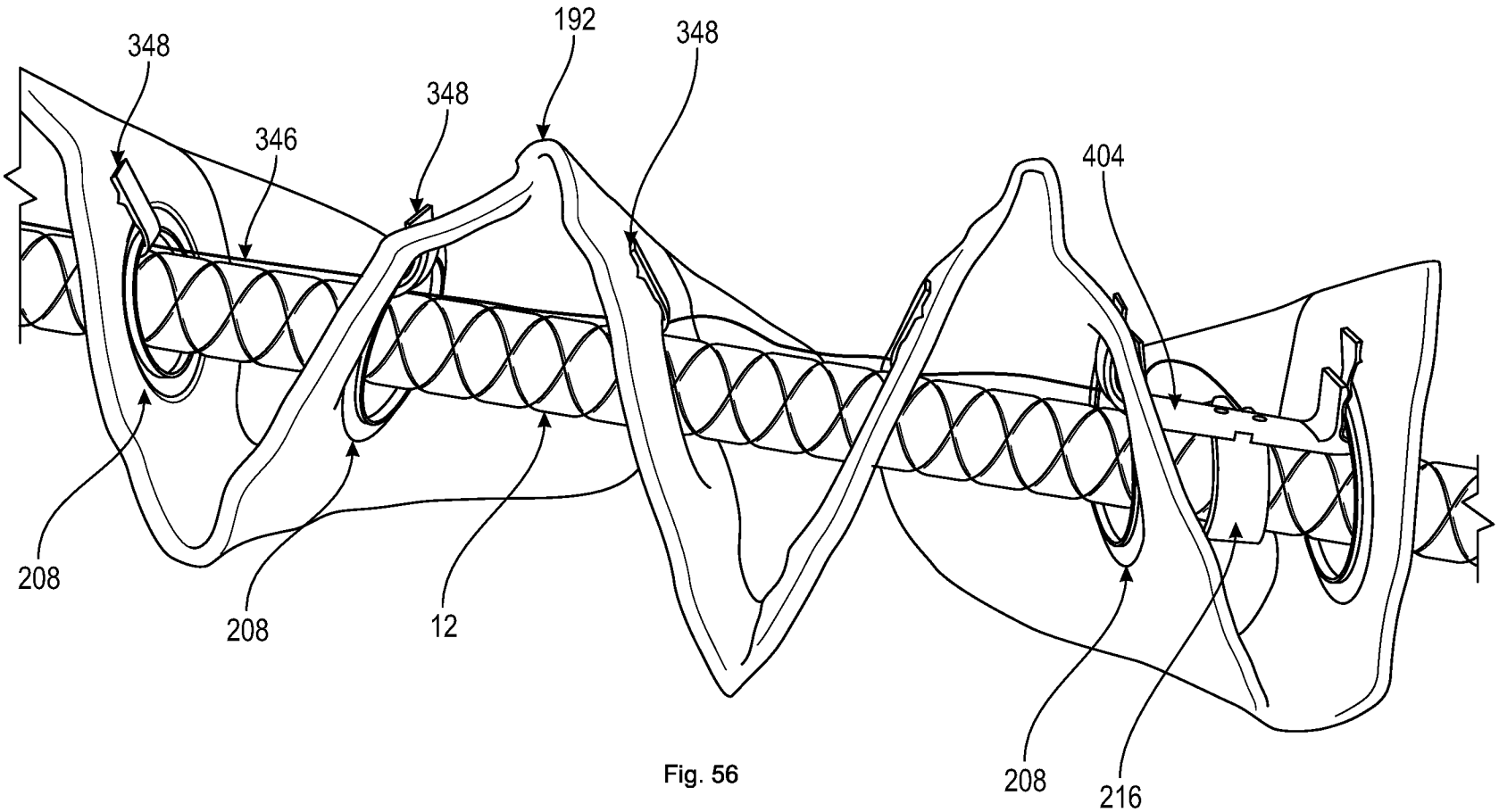
FIG. 56 is an elevation view of the top side of a grommet drapery, the view showing the grommet driver positioned around the drive element and connected to a carrier; the view showing the carrier connected to the inward most and second inward most grommets; the view showing grommet clips connected to each grommet and a lead extending between adjacent grommet clips thereby setting the maximum spacing between adjacent grommets; the view showing the grommet drapery in a closed position.
Figure 57:
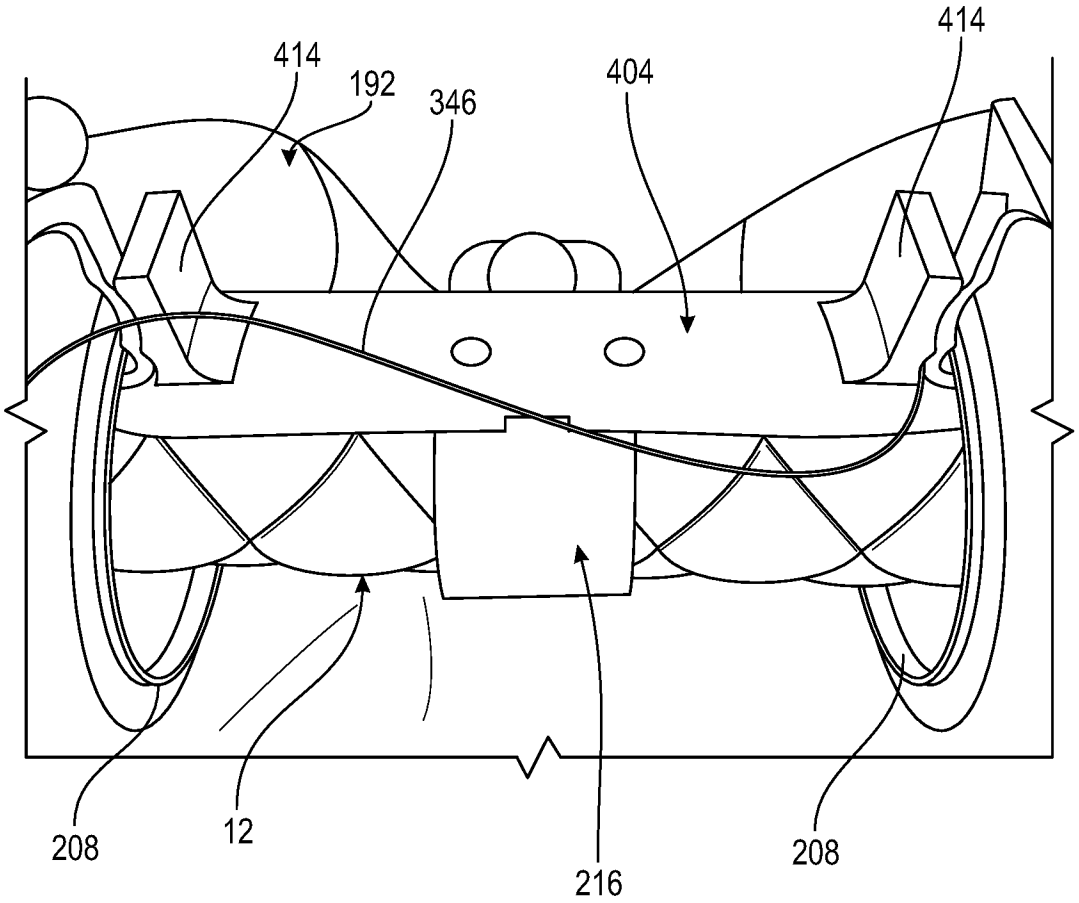
FIG. 57 is a close up perspective view of the grommet driver and carrier of FIG. 57.

In addition, the size and shape of the slot 418 is configured to allow grommet clip 348 to extend into slot 418 in a generally aligned manner, such that the grommet clip 348, as well as the grommet 208 it holds, is perpendicular to the length of drive element 12, as well as at an angle. That is, in one arrangement, as is shown in FIGS. 40 and 42, it is desirable to have the grommet clip 348 and grommet 208 extend through slot 418 at an angle such that the inward most and second inward most grommets 208 extend at an angle to one another causing the shade material 192 between the inward most and second inward most grommets 208 to be formed in a properly spaced V-shaped formation, which many users prefer as an optimal configuration.

More specifically, in one arrangement, as is shown, the outward wall 416 curves from its lower end to its upper end in a generally continuous arcuate manner and the inner surface of inner wall 414 curves from its lower end to its upper end, and includes a point or neck 420 that extends inward into slot 418 which defines a narrower point of the slot 418 which helps to hold grommet clip 348 within slot 418. However any other shape for inner wall 414 and outer wall 416 are hereby contemplated for use.

In one arrangement, as is shown, the connector members 412 may be used to set the angle of grommets 208 by setting the angle of slots 418 relative to the length of carrier 404. As one example, as is seen in FIG. 40, the inward positioned connector member 412 (on the left) aligns the grommet 208 in approximate perpendicular alignment to the length of drive element 12; whereas the second inward most grommet 208 (on the right) is positioned at a slight angle to the length of drive element 12. This angular arrangement of the inward most grommet 208 and the second inward most grommet 208 is set by connector members 412 and establishes the proper spacing and angle between the first pair of grommets 208.

In operation, as the shade material 192 is moved along drive element 12, the carrier 404 holds the position of the inward most grommet 208 and the second inward most grommet 208. As the drive element 12 is rotated, the teeth 202 of the main body of grommet driver 216 mesh with the guide structure 14 of the drive element 12 thereby moving the grommet driver along the length of the drive element 12. As the grommet driver 216 moves toward a closed position, as the slack is taken up in the lead 346, the grommet clips 348 stop at their respective positions as the lead 346 is drawn tight by the movement of grommet driver 216. At a fully closed position, each grommet clip 348 is in place in its respective position. In this way, the addition of lead 346 controls the spacing of the grommets 208 and provides a consistent and desirable appearance to shade material 192 when shade material 192 is in a closed position.

In one arrangement, as is shown, particularly in FIG. 42, the carrier 404 is positioned toward the upper side but also toward the rearward side of drive element 12. Positioning the carrier 404 in this manner tends to hide the carrier 404 to the extent possible as most viewers of the system look at it from in front of the drive element 12 and below the drive element 12.

In the arrangement, wherein carrier 404 is used, lead 346 is connected to the grommet clip 348 connected to the second inward most grommet 208 (as it is unnecessary to connect lead 346 to the inward most grommet 208 as the inward most grommet 208 and second inward most grommet 208 are connected together by carrier 404).

Aesthetic Appearance:

A nice aesthetic appearance is important to satisfy the user's desires for grommet drapery 204, 300, 400. To facilitate a nice aesthetic appearance, in one arrangement, it is important for the mechanical elements and operational elements of grommet drapery 204, 300, 400 to have as low profile as possible and to be as unobtrusive as possible, or said another way, to keep these components as minimally visible as possible.

Clear:

To facilitate this low profile and pleasing visual appearance, in one arrangement, some or all of the elements external to the drive element 12 are formed of a clear or translucent plastic or composite material. This clear or translucent material makes these components less noticeable than opaque or non-clear or non-translucent colored materials. In addition, this clear or translucent material has a tendency to reflect, take on or absorb the colors around the component.

These components may include grommet clips 348, carrier 404, grommet driver 216 and/or any other component of the system 10 that is external to the rotatable drive element 12. This may even include lead 346, which can be formed of a clear or translucent monofilament, such as what is commonly known as monofilament fishing line.

Matching:

In another arrangement, to facilitate this low profile and pleasing visual appearance, some or all of the elements external to the drive element 12 are formed to have the same or a similar or matching appearance as the rotatable drive element 12. These components may include grommet clips 348, carrier 404, grommet driver 216 and/or any other component of the system 10 that is external to the rotatable drive element 12. This may even include lead 346, which can be formed of a material that can be colored to match or take on a similar appearance to the rotatable drive element.

As an example, when the rotatable drive element has a brushed nickel appearance, so do the components exterior to the drive element 12. As another example, when the rotatable drive element has a white appearance, so does the components exterior to the drive element 12. As another example, when the rotatable drive element has a black appearance, so does the components exterior to the drive element 12. As another example, when the rotatable drive element has an antique bronze appearance, so does the components exterior to the drive element 12.

Combination:

In another arrangement, to facilitate this low profile and pleasing visual appearance, some of the elements external to the drive element 12 are formed to have the same or a similar or matching appearance as the rotatable drive element 12 and others are formed of a clear or translucent material and appearance. These components may include grommet clips 348, carrier 404, grommet driver 216 and/or any other component of the system 10 that is external to the rotatable drive element 12. This may even include lead 346, which can be formed of a material that can be colored to match or take on a similar appearance to the rotatable drive element 12.

As an example, when the rotatable drive element 12 has a brushed nickel appearance, so does grommet driver 216 and carrier 404 while the grommet clips 348 and/or lead 346 are formed of a clear or translucent material. Any other combination is hereby contemplated for use.

Low Profile:

In another arrangement, to facilitate this low profile and pleasing visual appearance, the elements external to the drive element 12 are formed to be as small as possible and small enough that they are not visible or largely not visible when system 10 is installed and shade material 192 is attached. As one example, grommet driver 216 and carrier 404 are positioned behind the shade material 192 between two grommets 208, as is shown in FIG. 36, FIG. 39, FIG. 40, FIG. 41 and FIG. 42. As such, only the portion of the carrier 404 and grommet clip 348 that extend through the grommet 208 and are positioned on the opposite side of the grommet 208 as the grommet driver 216 is visible. Note, the grommet driver 216 and the carrier 404 may be positioned between the first and second inward-most grommets 208, or between the second and third inward-most grommets 208, or between the third and fourth inward-most grommets 208, or between any other pair of grommets 208. This positioning may help to reduce light gaps at the side or center of a drapery system 10 as is further described herein.

In one arrangement, as is shown, carrier 404 and grommet clips 348 are as small as possible and as narrow as possible to provide the smallest visual appearance while also being strong and durable enough for years of use and abuse. In one arrangement, as is shown, the carrier 404 is substantially narrower than it is long, and grommet clips 248 are narrower than they are tall. In addition, the most minimal appearance possible, the taller side or taller portion of grommet clips 348 are positioned on the side of grommet 208 behind the shade material 192 thereby hiding the larger portion of grommet clip 348.

Also, in one arrangement, to facilitate this low profile and pleasing visual appearance, some of the elements external to the drive element 12 are positioned at or near the upper rearward side of drive element 12. In the arrangement shown, as one example, as is shown in the top view of FIG. 42, the side-perspective view of FIG. 39 as well as other views, when nine o'clock is the front of the drive element 12, the carrier 404 and grommet clips 348 and lead 346 are positioned between the noon and three o'clock position, or more specifically, in one arrangement, between the one o'clock and two o'clock position. However any other position is hereby contemplated for use. Said another way, these features are hidden behind the drive element 12 in the upper rearward position of the drive element 12.

Positioning these components, carrier 404 and grommet clips 348 and lead 346, behind the upper quadrant of the drive element 12 help to hide these components from view because most drapery systems 10 are installed at or above the upper end of windows and therefore most viewers look up to the drive element 12 from in front of and below the drive element 12. As such, when the carrier 404 and grommet clips 348 and lead 346 are positioned towards the upper rearward quadrant of drive element 12 they are hidden from view by most viewers.

This position, coupled with being formed of a clear and/or matching color, or combination thereof, facilitates a low profile and visually pleasing aesthetic appearance, if not complete invisibility.

Fixed v. Adjustable Spacing:

In one arrangement, grommet clips 348 are affixed to lead 346 at predetermined and non-adjustable spacing. This may be accomplished by gluing, adhering, welding, clipping, frictionally engaging, tying or connecting grommet clip 348 to lead 346 in any other way or combination of ways such that the connection is permanent or semi-permanent or not adjustable. This arrangement provides the benefit that the spacing of grommet clips 348 will not change during use or over time. In addition, this is beneficial in that many commercially available grommet draperies have standard spacing between grommets 208. However, this arrangement is undesirable if the user has a grommet drapery with non-standard spacing, or if the user wants to change the standard spacing between grommets 208 or variable spacing between grommet clips 348 along the length of lead 346.

In another arrangement, grommet clips 348 are affixed to lead 346 in an adjustable manner such that the spacing between grommet clips 348 may be adjusted or varied. This may be accomplished by adjustably connecting grommet clip 348 to lead 346 in any way such as tying, clipping, looping, snapping, frictionally engaging, having a spring loaded member, and/or any combination of ways such that the connection between grommet clip 348 and lead 346 is easily adjustable. This arrangement provides the benefit that the spacing of grommet clips 348 may be adjusted by the user. This arrangement is beneficial if the user wants to change the standard spacing between grommets 208 or variable spacing between grommet clips 348 along the length of lead 346.

In one arrangement, lead 346 is formed of a member that helps facilitate accurate spacing between grommet clips 348. This may be by having features, such as loops, knots, coloring, beads or any other feature positioned at equal spacing along the length of lead 346. In one arrangement, this lead 346 is formed of a beaded cable. In use, the features along lead 346 are used to space grommet clips 348 by allowing the user to count the number of features between grommet clips 348. For equal spacing the user counts an equal number of features between grommet clips 348, and for unequal spacing the user counts an unequal number of features between grommet clips.

Also, in one arrangement, the features can be used to connect to grommet clips 348. That is, one arrangement, when the features are beads, knots or loops in lead 346, the grommet clip 348 engages and/or holds onto and/or mates with these features thereby connecting the two components together in a rigid and durable manner which helps to prevent slippage between the grommet clips 348 and the lead 346.

Crush and Light Gaps:

As stated herein, in one arrangement, grommet driver 216 and/or carrier 404 may be connected to the inward most grommet 208. This arrangement is shown in FIG. 36. This arrangement is effective as the grommet driver 216 moves the inward most grommet 208 along the length of the drive element 12 and ensures the positioning of the inward most grommet 208 at the fully closed position.

However, one continual problem with draperies is what is known as light gaps. In center opening and center closing draperies, this is the slight spacing between adjacent shade materials (192L and 192R) that allows light there through which is undesirable and not aesthetically pleasing. Light gaps can also occur along the sides of side opening and closing draperies.

To alleviate the problem, grommet driver 216 and/or carrier 404 may be connected to the second inward most grommet 208 or the third inward most grommet 208 or any other grommet 208. For example, by connecting grommet driver 216 and/or carrier 404 to the second inward most grommet 208 this allows the grommet driver 216 and/or carrier 404 to "crush" the center of a center opening and closing drapery. That is, when the grommet driver 216 and/or carrier 404 is connected to the second inward most grommet 208, the inward most grommet 208 is essentially freely floating. As such, the grommet driver 216 and/or carrier 404 can drive to a closed position that causes the adjacent shade materials (192L and 192R) to engage one another and essentially over driving to the closed position. This causes the two shade materials (192L and 192R) to stack up, or have a higher density, in the center which causes the shade material (192L and 192R) to overlap at the center thereby reducing the potential for light gaps between the two shade materials (192L and 192R).

Manual System:

In one arrangement, the grommet driver 216, lead 346 and grommet clips 348 are used in a manual arrangement. That is, in this manual arrangement, grommet driver 216 has an opening at its center that is sized and shaped to fit over a conventional drapery rod, such as rotatable drive element 12. Grommet clips 348 are connected to the grommet driver 216 and/or carrier 404 in the manners described herein. A wand, cable, string, rope or other movement device is connected to the grommet driver 216. This movement device is configured to allow the user to apply a force to the grommet driver 216 that causes the grommet driver 216 to slide along the length of the drive element 12.

When grommet driver 216 is placed over the drive element 12 the grommet driver 216, and the grommet clips 348 connected by lead 346, are configured to slide over and along the length of the drive element 12 between a fully opened and fully closed positon. In the arrangement wherein the movement device is a rigid wand that is connected to the grommet driver 216 by a flexible hinge or pivotal hinge or any other movable connection, this allows the user to apply a pulling and/or pushing force to the grommet driver 216 that facilitates smooth and easy opening and closing of the shade material 192. Therefore, this arrangement works substantially better than simply placing the drive element 12 through the grommets 208 of the shade material 192. This is because the connection of grommets 208 to grommet clips 348 and lead 346 maintains the spaced relation of the grommets 208, providing even and desired folds in the shade material 192, and prevents the grommets 208 from canting or angling and binding against the drive element during movement between an opened and closed position, which is often a problem associated with grommet draperies causing iterative movement of the shade material 192 in sections which is undesirable, time consuming and often causes touching the shade material 192 multiple times causing additional wear and tear on the material. The connection of the wand or movement device to the grommet driver 216 facilitates the application of a pulling or pushing force at the grommet driver 216 that is essentially parallel to the length of the drive element 12 which provides these efficiencies and smooth operation.

With traditional grommet drapery arrangements (without the use of the grommet driver 216, lead 346 and grommet clips 348) the user applies the pulling or pushing force by grasping the shade material and pulling or pushing it from where they grasp the shade material 192. This causes the grommets 208 to angle or cant and bind on the drapery rod making it difficult, if not impossible, to move the shade material 192 more than a short distance before the grommets 208 lock up on the drapery rod causing the user to grasp the shade material 192 multiple times and move the shade material 192 in multiple small moves. The manual system described herein eliminates this problem.

In addition, due to the low profile, small and hidden nature of the grommet driver 216, carrier 404, grommet clips 348 and lead 346, this manual arrangement is attractive, as well as effective. To facilitate the universality of this arrangement, the grommet driver 216, grommet clips 348, lead 346 and/or carrier 404 are formed of a clear or translucent material so that these components can be used with any color or style of drapery rod and/or grommet drapery.

Tabbed Drapery System:

With reference to FIGS. 46-59 a tabbed drapery system 500 is presented. Tabbed drapery system 500 is similar to the other arrangements presented here, as such, the teachings associated with the other embodiments and arrangements presented herein apply to the tabbed drapery system 500, unless specifically stated otherwise.

Tabbed drapery system 500 is configured to open and close shade material 192 that includes tabs 502 positioned at its upper end of shade material 192 which form an opening 504 between the shade material 192 and the tabs 502. Drive element 12 extends through openings 504 in shade material 192 thereby connecting to and supporting shade material 192. Tabs 502 are often formed of rectangular pieces of fabric or material that are connected to the rearward side of the shade material 192, often by sewing, adjacent their upper edge to the shade material 192 adjacent its upper edge, as well as adjacent their lower edge to the shade material 192 a distance below its upper edge. Often, a tab 502 is positioned adjacent the inward most edge of shade material 192, and a tab 502 is positioned adjacent the outward most edge of shade material 192, and a plurality of tabs 502 are positioned along the length of shade material 192 in spaced intervals. The spacing of tabs 502 along shade material 192 facilitates the formation of the ripple or wavy pattern of the shade material 192 when in an opened and closed position on drapery rod 12.

Tabbed Driver:

In the arrangement shown, as one example, a tabbed driver 216 is used (which is similar to or identical to grommet driver 216 the difference being that when the element 216 is used with a tabbed drapery element 216 is called a tabbed driver and when element 216 is used with a grommet drapery element 216 is called a tabbed driver, for purposes of simplicity, the term grommet driver will primarily be used). Grommet driver 216 is connected to the inward most tab 504, however it is contemplated that the grommet driver 216 may connect to any other tab 504 such as the second inward most tab 504, the third inward most tab 504 or any other tab 504 of the shade material 192.

In the arrangement shown, as one example, grommet driver 216 may be similar to or identical to the grommet driver 216 used in association with grommet drapery 300 and/or 400. In the arrangement shown, grommet drivers 216 have a main body that is generally cylindrical in shape. The main body of grommet driver 216 has a generally cylindrical shape that has an exterior surface 302 and an interior surface 304 that are both generally smooth and cylindrical in shape when viewed from an end. The main body of grommet driver 216 extends a lateral length from an inward end 306 to an outward end 308 in a generally cylindrical manner.

The interior surface 304 of grommet driver 216 is sized and shaped to fit over the exterior shape of drive element 12 with close tolerances that allow the grommet driver 216 to slide over the drive element 12 while the tooth or teeth 202 remain within the guide structure 14 of the drive element 12.

More specifically, in the arrangement shown, the interior surface 304 of grommet driver 216 includes one or more teeth 202. Each tooth 202 is sized and shaped to receive or be received within guide structure 14 of drive element 12. In the arrangement shown, when grommet driver 216 is viewed from an end 306, 308, tooth 202 is generally triangular in shape, or pointed. However, any other size, shape and design is hereby contemplated for use.

In the arrangement shown, as one example, the exterior surface 302 of main body of grommet driver 216 includes at least one feature, and in the arrangement shown a pair of features 402. Features 402 are formed of any suitable size, shape and design and facilitate connection of the main body of grommet driver 216 to a carrier 404 that is used when grommet driver 216 is used with a grommet drapery 300. In the arrangement shown, as one example features 402 are compressible friction-fit members or snap fit members that are configured to be inserted into and through openings 406 in carrier 404 and lock thereto. However, when using grommet driver 216 in association with a tabbed drapery the features 402 are not used as carrier 404 is not used. However, by having features 402 in grommet driver 216 this allows this single grommet driver 216 to be used both with tabbed drapery as well as grommet drapery.

Joint:

To facilitate easier installation and assembly, grommet driver 216 includes a joint 506. Joint 506 is formed of any suitable size, shape and design and facilitates easier installation of the grommet driver 216 on the drive element 12 and/or easier adjustment of the grommet driver 216 on drive element 12. In the arrangement shown, as one example, joint 506 is formed of a pair of tabs 508 that extend outward from the lower side of the main body of grommet driver 216 in a generally parallel manner to the axis of rotation of drive element 12 when grommet driver 216 is installed thereon. When connected together, opposing tabs 508 are connected in flat and flush mating engagement with one tab 508 having a feature 510 that extends toward the other tab 508 and is received within an opening 512 thereby locking the opposing tabs 508 together and locking the grommet driver 216 around the drive element 12. In the arrangement shown, one feature 510 and one opening 512 are shown as part of joint 506. However, any number of features 510 and openings 512 are hereby contemplated for use such as two, three or more features, or any other way of connecting opposing tabs 508.

In one arrangement, grommet driver 216 is formed of a material that is flexible enough to allow the tabs 508 to be separated far enough to slide the grommet driver 216 over the drive element 12. In another arrangement, where the material of grommet driver 216 is not flexible enough to allow tabs 508 to be separated far enough to slide grommet driver 216 over the drive element 12, joint 506 allows the tabs 508 to separate far enough to provide room enough for the teeth 202 to come out of the guide structure 14 which allows the grommet driver 216 to be moved or slid along the length of the drive element 12 without the need to rotate drive element 12, which eases the installation process. In another arrangement, where the material of grommet driver 216 is not flexible enough to allow tabs 508 to be separated far enough to slide grommet driver 216 over the drive element 12, a living hinge or other hinge is present on grommet driver 216 that allows grommet driver 216 to open when tabs 508 of joint 506 are separated. In one arrangement, this hinge is positioned, approximately, on the opposite of grommet driver 216 from joint 506.

Joint 506 can also provide a failsafe that prevents damage to or the destruction of grommet driver 216 when too much force is applied. That is, in one arrangement, joint 506 is configured to rigidly hold together during normal operations. However, when grommet driver 216 experiences excessive force, joint 506 is configured to open before grommet driver 216 is destroyed. As such, joint 506 not only facilitates easier installation and adjustment of the system 10, it also serves as a failsafe under excessive force.

When joint 506 is closed, and the feature 510 of one tab 508 is engaged with the opening 512 in the other tab 508 the interior surface 304 fits around the exterior surface of the drive element 12 with close tolerances and the teeth 202 are engaged within guide structure 14. When grommet driver 216 is connected to shade material 192, this engagement of teeth 202 with guide structure 14 causes the grommet driver 216 to be driven along a length of the drive element 12 as the drive element 12 rotates.

To facilitate connection to the tabs 502 of shade material 192, grommet driver 216 includes a socket 514 that receives the head 516 of a tack 518 within a first slot 520 and receives the shaft 522 of the tack within a second slot 524. Tack 518 is formed of any suitable size, shape and design and in the arrangement shown includes a head 516 at one end that connects to a shaft 522 that extends outwardly therefrom a distance before terminating in a pointed end that is configured to penetrate the tab 502 of shade material 192. In one arrangement, tack 518 is what is commonly known as a thumb tack, however any other form of a tack-type device is hereby contemplated for use.

Socket 514 is formed of any suitable size, shape and design and corresponds to receive and hold tack 518. In the arrangement shown, as one example, socket 514 is connected to the exterior surface 302 of grommet driver 216 and is positioned at the middle of the rearward side of the grommet driver 216. In the arrangement shown, as one example, socket 514 includes a first slot 520 that receives the head 516 of tack 518 therein. To facilitate the insertion of the head 516 of tack 518 within the first slot 520 of socket 514, a second slot 524 is positioned in socket 514 that receives the shaft 522 of tack 518. In the arrangement shown, as one example, when head 516 of tack 518 is fully inserted within first slot 520 the shaft 522 is at the approximate end of second slot 524 and the tack 518 is frictionally and firmly held therein. To improve the connection between tack 518 and socket 514, locking members, such as one way fingers can be used, as can adhesive or other friction imparting members or systems. In the arrangement shown, as one example, the second slot 524 extends along the axis of rotation of drive element 12 or along the direction of travel of the grommet driver 216.

When grommet driver 216 is installed on drive element 12, and tack 518 is installed within the socket 514, the shaft 522 of tack 518 is inserted through the material of tab 502 of shade material 192 and a cap 526 is connected to shaft 522.

In one arrangement, as is shown, joint 506 allows the grommet driver 216 to open and flex to fit around the drive element 12. In another arrangement, grommet driver 216 has two or more joints 506 and is formed of two or more parts that are assembled around drive element 12. As one example, with reference to FIGS. 46 and 47, a second joint 506 is positioned on the opposite side of grommet driver 216 such that in this example the two-part grommet driver 12 is installed around drive element 12 by inserting the feature of one tab 508 with the opening 512 in the other tab 508 of the other half of grommet driver 216. It is hereby contemplated that any grommet driver may be formed of any number of parts, such as one, two, three, four, five or more. In another arrangement, one or more hinges are positioned in grommet driver 216 so as to facilitate opening and closing of grommet driver 216 in association with joint 506, which can be any form of a hinge such as a barrel hinge, a living hinge or the like.

Cap:

Cap 526 is formed of any suitable size, shape and design and is configured to connect to the shaft 522 of tack 518 after shaft 522 has been inserted through the tab 502 of shade material 192. In one arrangement, as is shown, cap 526 has a generally planar main body 528 that has a generally flat and planar forward wall 530 and a generally flat and planar rearward wall 532 that includes a plurality of features 534 that are configured to receive beads 536 of a beaded cable 538 therein.

Cap 526 includes an opening 540 at its upper end that is sized and shaped to receive a collar 542 therein. Collar 542 is sized, shaped and configured to receive the shaft 522 of tack 518 therein while allowing the selective removal of shaft 522 from collar 542. This arrangement is not unlike the post of an earring connecting to its back, wherein the post is the shaft 522 and the back is a collar 542 or the entirety of cap 526. In one arrangement, collar 542 is formed of a tough but flexible rubber-like material that allows the insertion of shaft 522 therein but provides a great amount of resistance onto shaft 522 that prevents removal of shaft 522 from collar 542. In another arrangement collar 542 is a mechanical member that latches onto shaft 522 using a spring-loaded bias member, such as a spring, lever or the like.

Features 534 are formed of any suitable size, shape and design and are configured to attach cap 526 to lead 346, which in the arrangement shown, in this example, is beaded cable 538. In the arrangement shown, three features 534 are shown in the rearward wall 532 of cap 526, a center feature 534 positioned between opposing side features 534 which are positioned on either side of the center positioned feature 534. The centrally positioned feature 534 takes the shape of a partial spherical depression in the rearward wall 532 of main body 528 that provides egress to receive a bead 536 of beaded cable 538 therein. The features 534 positioned on either side of the centrally positioned feature 534 are formed of a semi-circular shaped collar 544 that connects to a portion of a spherical depression in the rearward wall 532 of main body 528. The collar 544 of the forward positioned feature 534 forms a forward facing semi-circular shape when viewed from behind, and the collar 544 of the rearward positioned feature 534 forms a rearward facing semi-circular shape when viewed from behind. The collars 544 include a slot 546 at their approximate middle that allows passage of the lead 346 between beads 536 of beaded cable 538.

In this way, the centrally positioned feature 534 receives a bead 536 of beaded cable 538 and the forward positioned feature 534 receives a forward positioned bead 536 and the rearward positioned feature 534 receives a rearward positioned bead 536. The collars 544 of the forward and rearward positioned features 534 hold the beaded cable 538 in tension between the two collars 544 which prevents unintended separation of the beaded cable 538 and cap 526, thereby holding the cap 526 and beaded cable 538 together. In one arrangement, the beads 536 are snapped into place in the forward and rearward features 534, which stretches the lead 346 between the opposing collars 544 thereby holding the cap 526 to beaded cable 538 in tension between opposing collars 544.

One benefit of this arrangement is that by using a beaded cable 538 the spacing of caps 526 can be easily set by counting the number of beads 536 between caps 526. In addition, attaching the beaded cable 538 to cap 526 is quick, simple and easy and by counting beads 536 between caps 526 no measuring is required and assembly can be performed without any tools.

While cap 526 is described for use with a beaded cable 538 it is hereby contemplated that cap 526 may be used with a non-beaded cable or lead 346 as well or any other form of a lead 346. Caps 526 are connected along the length of lead 346 or beaded cable 538 and are connected to grommet driver 216 and idler rings 548.

Idler Rings:

In one arrangement, while grommet driver 216 may be connected to the inward most tab 502, or the second inward most tab 502, the other caps 526 are connected to idler rings 548. In one arrangement, as is shown, idler rings 548 are cylindrical rings that fit over drive element 12 and have a smooth interior surface 304 that slides over the exterior surface of the drive element 12. In the arrangement shown, as one example, idler rings 548 include a socket 514 similar, if not identical, to the socket 514 in grommet driver 216 that receives a tack 518 therein. Tack 518 then connects to socket 514 by the head 516 sliding into the first slot 520 and the shaft 522 extending through the second slot 524. Once installed within socket 514, the shaft 522 of tack 518 extends through the shade material 192 of tab 502 and then cap 526 is installed on the shaft 522 in the same or a similar manner described herein with respect to grommet driver 216.

In one arrangement, as is shown, idler rings 548 do not include a joint 506 as is shown with respect to grommet driver 216. This is because idler rings 548 do not include teeth 202 and therefore they can be slid along the entire length of the drive element 12. In contrast, grommet driver 216 includes teeth 202 that engage guide structure 14 in drive element 12 which prevents sliding along the length of drive element 12 without joint 506. In an alternative arrangement, to allow idler rings 548 to be installed on any portion of drive element 12, not just sliding them over the end of drive element 12, idler rings 548 also include a joint 506 that is similar, if not identical, to the joint 506 described with respect to grommet driver 216. Joint 506 allows idler rings 548 to be installed along any portion of drive element 12 by simply opening joint 506 and snapping or forcing the idler ring 548 over the drive element 12. This speeds and eases the installation process.

The addition of an idler ring 548 is not required. When idler rings 548 are not used, a tack 518 is simply inserted through the tab 502 and attached to the cap 526. However, in some applications, the use of idler rings 548 provides smoother opening and closing of shade material 192.

Manual System:

In one arrangement, the system 10 presented herein is applicable for use as a manual tabbed drapery system by removing the teeth 202 from the grommet driver 216 and attaching a wand, string or other movement device to the grommet driver 216 which helps to move the grommet driver 216 along a length of the drive element 12 under manual operating conditions.

In Operation:

In operation, the user sets the spacing between tabs 502 by attaching caps 526 along the length of beaded cable 538 at the desired spacing. Use of a beaded cable 538 that includes beads 536 at spaced intervals along the length of lead 346 allows a user to precisely position, and precisely adjust, the spacing between adjacent caps 526 quickly, easily and accurately without measuring by simply counting beads 536.

Once the location of the cap 536 on beaded cable 538 is determined, a bead 536 is aligned with the centrally located feature 534 of cap 526, and a bead 536 is aligned with the forward positioned feature 534, and a bead 536 is aligned with the rearward positioned feature 534. Once the beads 536 are aligned in this manner, the beads 536 are forced into the aligned features 534. As the beads 536 are forced into the features 534, the collars 544 slightly bend or deflect to facilitate the insertion of beads 536 within features 534. Once enough force is applied to cause the collars 544 to deflect, the beads 536 are held within the semi-circular or semi-spherical recesses in the rearward wall 532 of cap 526. In this positon, the lead 346 that extends between beads 536 also extends through the slot 546 in collars 544.

In one arrangement, the sizing and spacing of opposing collars 544 is such that the beaded cable 538 is held with tension within cap 526. More specifically, in one arrangement, when the beads 536 are inserted, or forced, within the opposed facing collars 544, the beads 536 are forced away from one another. This force causes the centrally positioned bead 536 to be held in tension between the outwardly facing collars. In an alternative arrangement, while the collars 544 may not necessarily hold the beads 536 in tension, the arrangement of features 534 and collars 544 hold enough, or capture enough of the beads 536, that beads 536 are held within the semi-circular or semi-cylindrical recesses of feature 534 and are prevented from escaping under normal operating conditions.

Once cap 526 is installed on beaded cable 538, cap 526 may be easily removed by applying appropriate force by pulling beaded cable 538 away from cap 526. This pulling force causes the collars 544 to deflect thereby allowing the removal of beads 536 from features 544.

Grommet driver 216 is installed onto drive element 12. In one arrangement, grommet driver 216 is positioned over an end of the drive element 12 and teeth 202 are engaged with helical feature 14 and one of the rod 12 or grommet driver 216 is rotated with respect to the other until the grommet driver 216 is positioned at the appropriate position on drive element 12.

In another arrangement, wherein grommet driver 216 includes joint 506, the tabs 508 of joint 506 are separated from one another. This provides the interior surface 304 additional clearance that allows the grommet driver 216 to slide over the drive element 12. The joint 506 separated grommet driver 216 is slid over an end of the drive element 12 until it reaches its desired position. Once in its desired position, the joint 506 is closed by applying pressure to the opposing tabs 508 thereby causing the feature 510 of one tab 508 to lock within the opening 512 of the opposing tab 508. Once joint 506 is locked in place, teeth 202 are engaged within helical feature 14.

In another arrangement, wherein grommet driver 216 includes joint 506, the tabs 508 of joint 506 are separated from one another thereby opening the hollow interior of grommet driver 216. Next, the grommet driver 216 is moved to the desired position on the drive element 12 and the grommet driver 216 is forced over the drive element 12. Once the grommet driver 216 is in place on the drive element 12, at its desired position, the joint 506 is closed by applying pressure to the opposing tabs 508 thereby causing the feature 510 of one tab 508 to lock within the opening 512 of the opposing tab 508. Once joint 506 is locked in place, teeth 202 are engaged within helical feature 14.

Idler rings 548 are installed in a similar, if not identical, manner to grommet driver 216. In one arrangement, grommet driver 216 is installed as the inward most ring, whereas, in other arrangements, one, two or more idler rings 548 are positioned inward of grommet driver 216.

Once the grommet driver 216 and idler rings 548 are installed, tacks 518 are installed within sockets 514. Once tacks 518 are installed, the shaft 522 of tacks 518 are inserted through the material of tabs 502 and a cap 526 is installed on the shaft 522 of tack 518 on a side opposite tab 502 by inserting shaft 522 into the collar 542 of cap 526 which frictionally holds cap 526 to tack 518. In this way, the installation of cap 526, onto the tack 518, locks the respective grommet driver 216 or idler ring 548 onto the tab 502.

Once grommet driver 216 and all of the idler rings 548 are installed, the shade material 192 is opened and closed by rotation of the drive element 12. As the drive element 12 is rotated, grommet driver 216 moves along the length of the drive element 12. When closing the shade material 192, the beaded cable 538 sets the spacing between adjacent tabs 502, thereby facilitating smoother operation of the system 10 as well as setting the desired aesthetic appearance of the shade material 192 by providing consistent and desirable ripples or folds in the shade material 12.

The spacing between tabs 502 can be quickly and easily adjusted by simply removing the cap 526 from the tack 518, pulling the beaded cable 538 from the features 534 of the cap 526, and reinstalling the cap 526 on the desired beads 536 and reinstalling the cap 526 on the tack 518.

Figure 60:
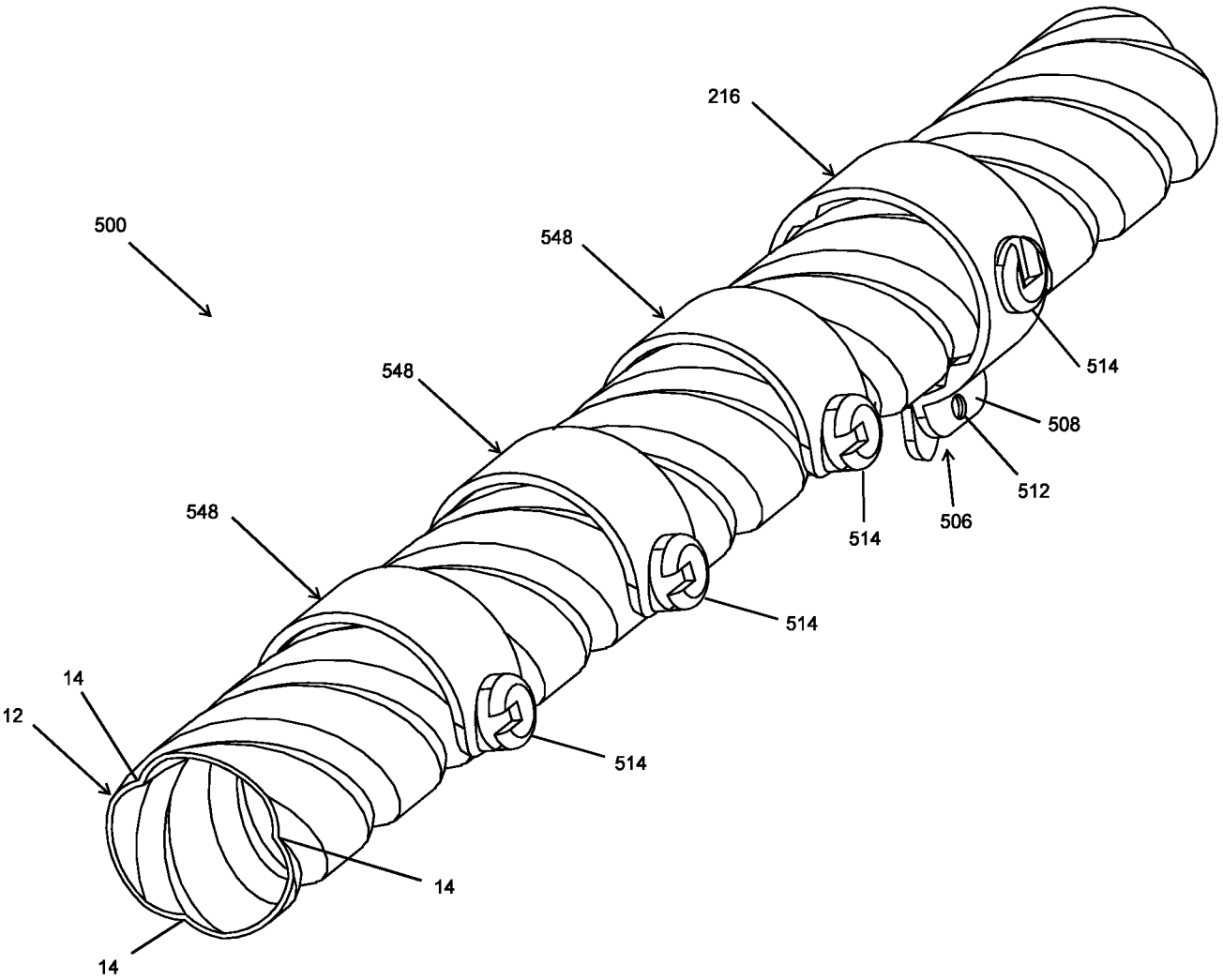
FIG. 60 is a perspective view of a driver ring and a plurality of idler rings attached to a drive element; the view showing the drive element having a hollow interior and having a guide structure formed of three grooves or three starts that all rotate in the same direction; the view showing the driver ring having a hinge that allows the driver ring to be installed over the drive element as well as allows the drive element to be adjusted along the length of the drive element; the view showing a plurality of idler rings that have an open lower end that allow the idler rings to snap over the drive element; the view showing the driver ring and the idler rings having sockets that receive tacks therein that facilitate connection to a tab of a tabbed drapery; the view showing the back side of the drive element, idler rings and driver ring such that the socket is hidden from view behind the drive element.
Figure 61:
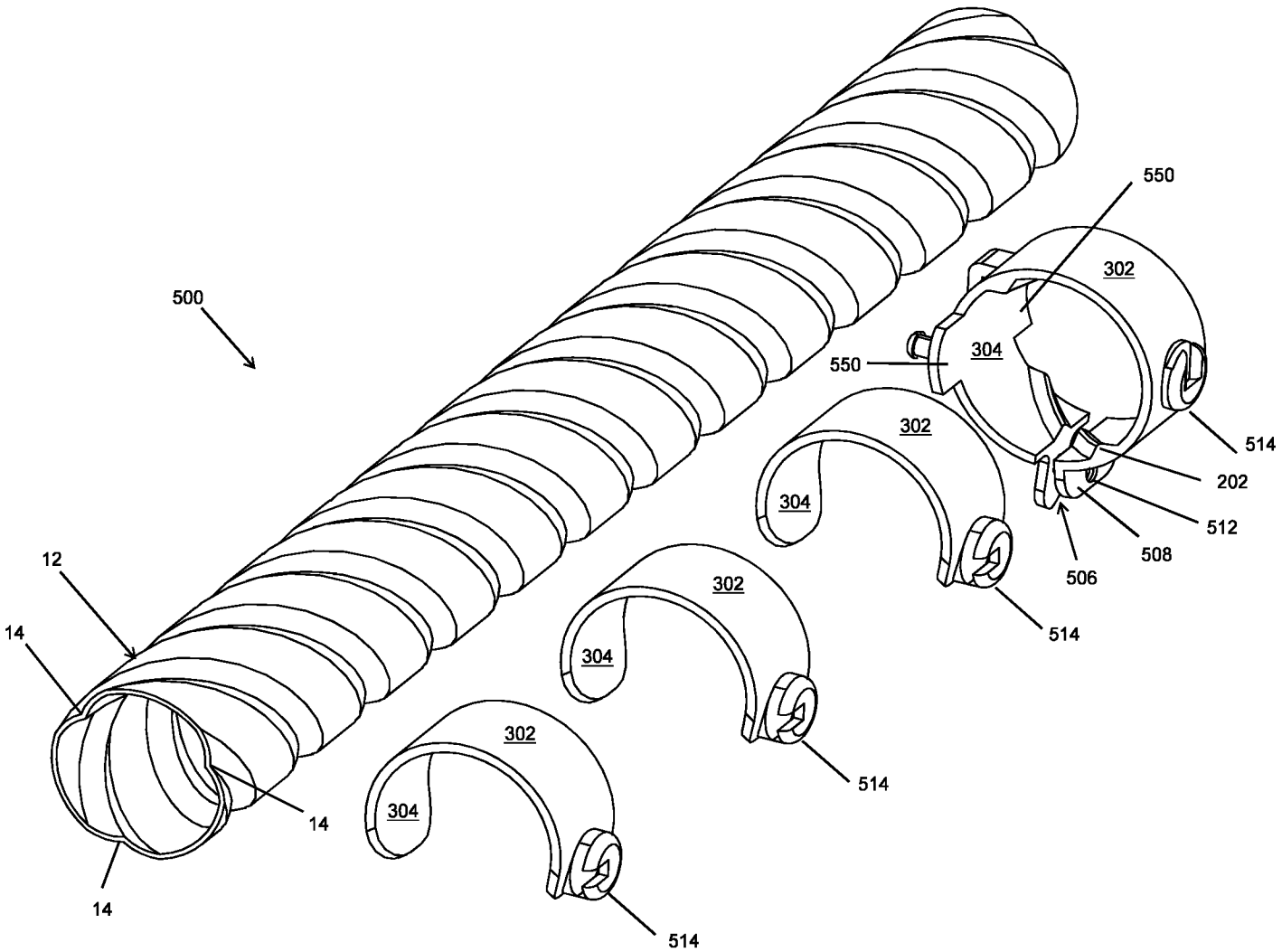
FIG. 61 is an exploded perspective view of the driver ring, idler rings and drive element shown in FIG. 60, the view showing the driver ring and idler rings removed from the drive element.

Snap Over Features:

With reference to FIGS. 60 and 61, a drive element 12 having a hollow interior is shown that includes a guide structure 14 formed of three starts, or three grooves, that rotate in the same direction along the along the length of the drive element 12. The view shows three idler rings 548 that have a socket 514 positioned in the back portion of the idler ring 548. These idler rings 548 have a smooth exterior surface 302, such that they fit under the tab 502 of shade material 192 in a low-profile manner. These idler rings 548 also have a smooth interior surface 304 that allow the idler rings 548 to easily slide over the exterior surface of the drive element 12 with minimal resistance. The view shows these idler rings 548 having an open lower end. That is, the circular shape of the main body of the idler rings 548 terminates in an open lower end. This allows the idler ring 548 to be slid over or snapped over the drive element 12 at any point on the drive element 12. This allows for easier assembly and installation.

Figure 58:
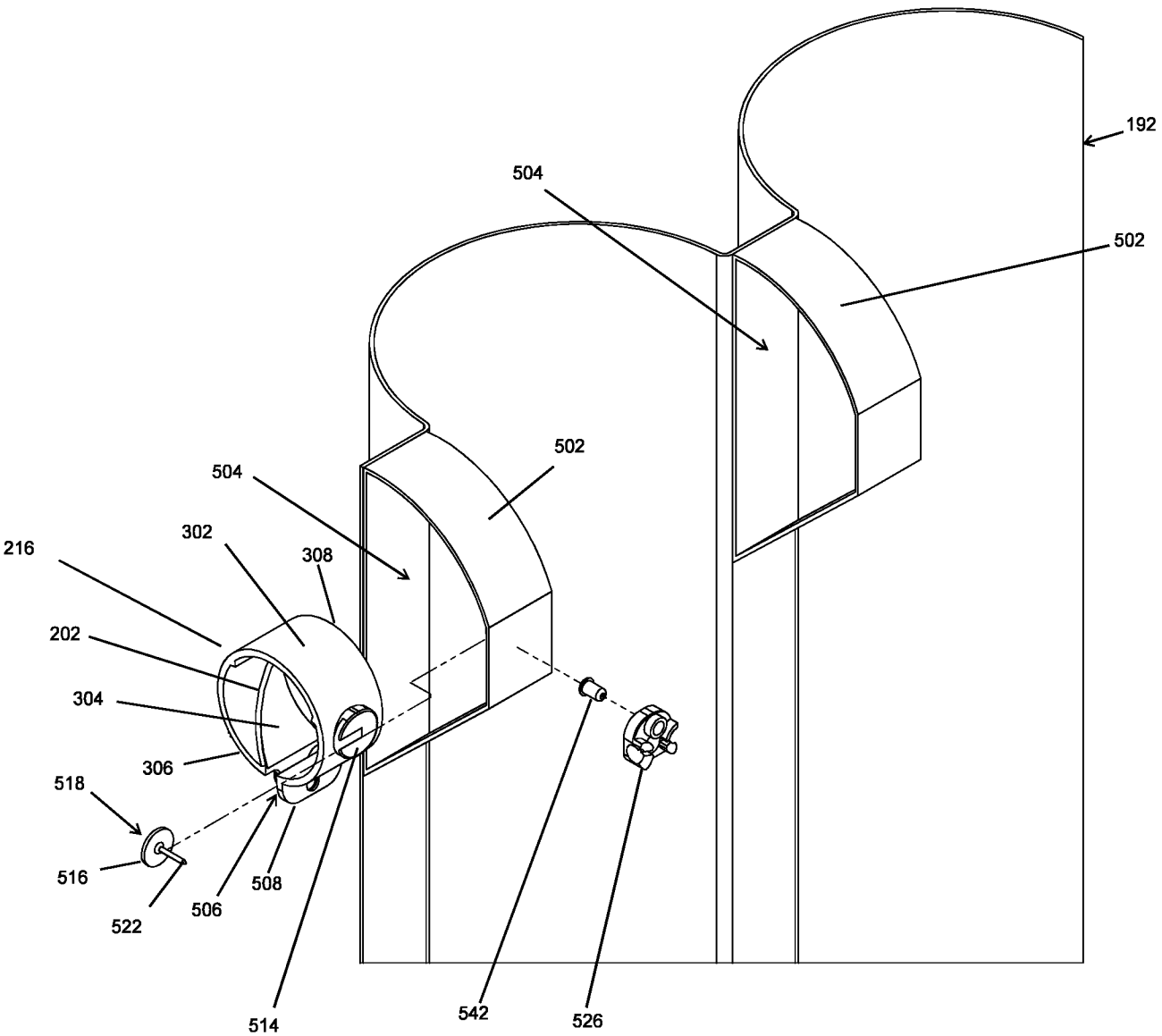
FIG. 58 is an exploded perspective view of a jointed tabbed driver and tabbed drapery; the view showing the back side of the tabbed driver and the tabbed drapery; the view showing the gabbed driver, the tack, the carrier, the collar and the tabbed drapery in an exploded manner; the view showing the tabbed driver having a joint that facilitates clipping the tabbed driver over the side of the drive element as well as facilitates adjustment of the tabbed driver along the length of the drive element.
Figure 59:
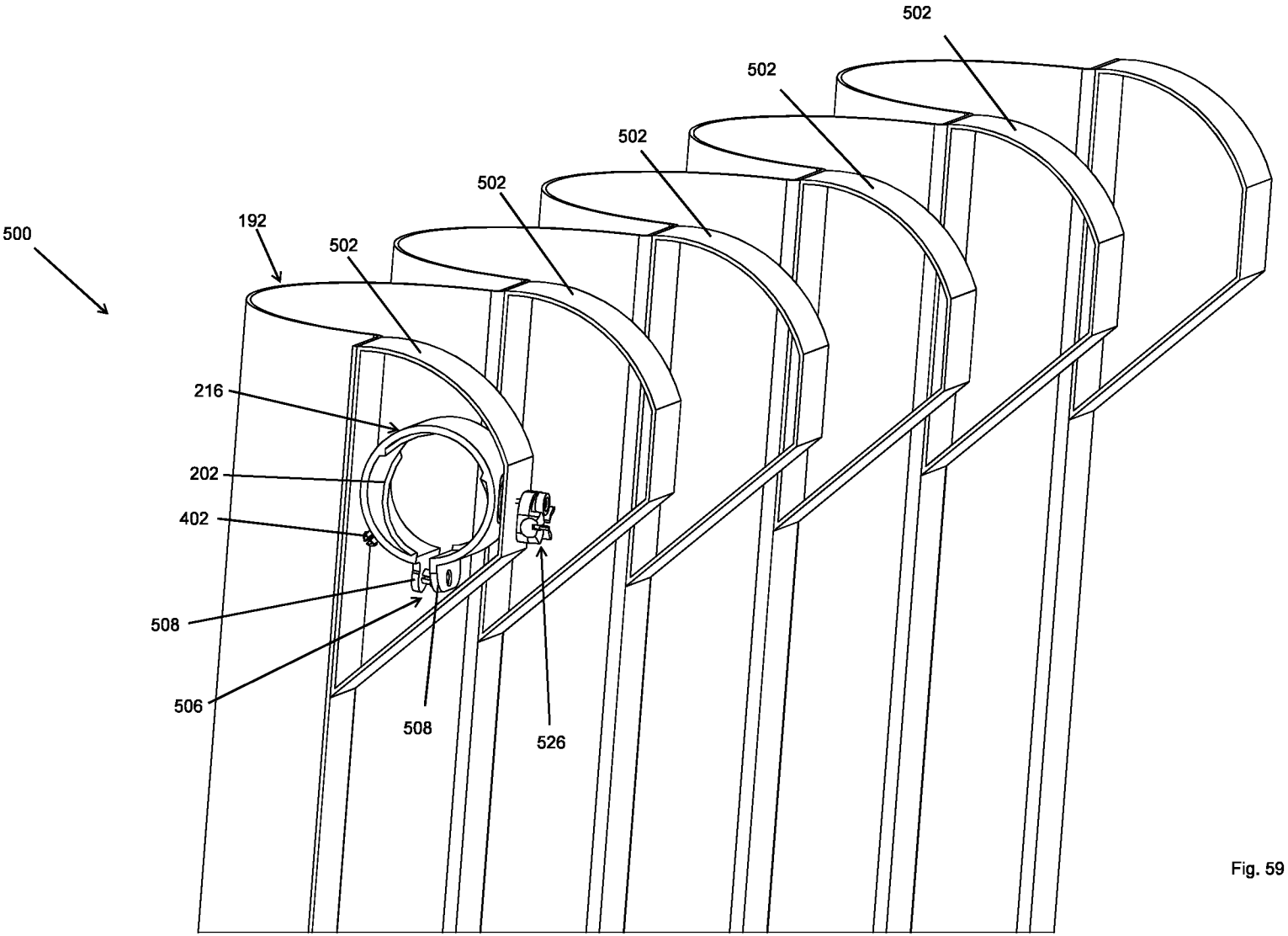
FIG. 59 is a perspective view of the tabbed driver and tabbed drapery shown in FIG. 58, the view showing the tack installed on the tabbed driver, the shaft of the tack inserted through a tab of the tabbed drapery, and the cap installed onto the shaft of the tack.

Also shown, is a grommet driver 216, as is shown in FIGS. 58 and 59, having a joint 506 that similarly allows the grommet driver 216 to fit over the drive element 12, as well as, be adjustable along the length of the drive element 12. In one arrangement, grommet driver 216 has teeth 202 therein, that are configured to fit within a groove of the guide structure 14, in an arrangement wherein the shade material is opened and closed by rotating the drive element 12. In another arrangement, grommet driver 216 is smooth and does not have teeth 202 therein, and as such grommet driver 216 is able to slide along the length of drive element 12 (which simply serves as a drapery rod in this case) in an arrangement wherein the shade material 192 is opened and closed manually. This may be accomplished by connecting a rod or string or other movement device to the grommet driver 216.

Also shown in this arrangement is a pair of wings 550 that extend outward from the sides of the grommet driver 216. Wings 550 continue the contour of the interior surface 304 of the grommet driver 216. That is, wings 550 extend outward, from the forward and/or back side of the grommet driver 216 and curve in a manner that conforms to the curvature of the drive element 12. Adding a wing 550 on the forward side and/or the backward side of the grommet driver 216 helps to stabilize the grommet driver 216 as the grommet driver 216 travels along the length of the drive element 12. The addition of wings 550 on the forward side and/or backward side of the grommet driver 216 helps to prevent the grommet driver 216 from tilting or canting as the grommet driver 216 opens and/or closes the shade material. The addition of wings 550 on the forward side and/or backward side of the grommet driver 216 increases the surface area of contact between the grommet driver 216 and the drive element 12, while not greatly increasing the amount of resistance or friction between the grommet driver 216 and the drive element 12. Wings 550 may extend any length forward or backward from grommet driver 216. Wings 550 extend any portion of the curvature of the drive element 12 and by conforming to the curvature of the drive element 12, this helps to maintain the alignment of the grommet driver 12 as the wings 550 maintain a later alignment with the length of the drive element.

This arrangement wherein the grommet driver 216 and idler rings 548 fit over the drive element 12 at any point along the drive element 12 allows for easier installation and assembly of the grommet driver 216 and idler rings 548 as the grommet driver 216 and idler rings 548 do not have to be fit over the end of the drive element 12 and moved laterally along the length of the drive element 12 to their respective positions, which can be difficult, especially when using some pocket or tabbed draperies.

In this way, a wirelessly controllable, motorized, and battery powered drapery rod system is presented that allows for use of a grommet drapery.

From the above discussion it will be appreciated that the drapery apparatus, system and method of use presented improves upon the state of the art.

Specifically, the motorized grommet drapery apparatus presented is easy to use, is efficient, is simple in design, is inexpensive, has a minimum number of parts, has an intuitive design, is motorized, eliminates binding of grommets as they are slid along the support rod, and is wirelessly controllable.

It will be appreciated by those skilled in the art that other various modifications could be made to the device without parting from the spirit and scope of this disclosure. All such modifications and changes fall within the scope of the claims and are intended to be covered thereby.

What is claimed:

1. A drapery system comprising:

a drive element;

the drive element extending a length between a first end and a second end;

the drive element connected to a structure by a first bracket positioned adjacent the first end and a second bracket positioned adjacent the second end;

a grommet driver connected to the drive element;

shade material having a plurality of grommets therein;

wherein the drive element extends through the plurality of grommets thereby supporting the shade material; and a first connector member connected to the grommet driver;

wherein the first connector member is configured to receive and hold a grommet;

wherein the grommet driver drives the shade material along the length of the drive element as the drive element rotates.

2. The drapery system of claim 1, wherein the grommet driver has at least one tooth in communication with a groove in a surface of the drive element.

3. The drapery system of claim 1, wherein when the drive element is rotated in a first direction the shade material is opened; and wherein when the drive element is rotated in a second direction the shade material is closed.

4. The drapery system of claim 1, further comprising a motor operatively connected to the drive element such that when the motor is actuated the motor rotates the drive element.

5. The drapery system of claim 1, wherein the grommet driver is connected to a second inward most grommet.

6. The drapery system of claim 1, further comprising a remote wirelessly connected to the drapery system such that when the remote is actuated the remote is configured to remotely open or close the shade material.

7. The drapery system of claim 1, wherein the drapery system is powered by at least one battery electrically connected to the drapery system.

8. The system of claim 1, wherein the first connector member is configured to hold the grommet at an angle relative to the grommet driver and drive element.

9. A drapery system comprising:

a drive element;

the drive element extending a length between a first end and a second end;

the drive element connected to a structure by a first bracket positioned adjacent the first end and a second bracket positioned adjacent the second end;

a grommet driver connected to the drive element;

shade material having a plurality of grommets therein;

wherein the drive element extends through the plurality of grommets thereby supporting the shade material; and a first connector member connected to the grommet driver;

wherein the first connector member is connected to a grommet;

wherein the grommet driver drives the shade material along the length of the drive element as the drive element rotates;

wherein the first connector member is configured to receive and hold a first grommet clip;

wherein the first grommet clip is connected to the grommet.

10. The system of claim 1, wherein the first connector member includes a slot configured to receive the grommet;

wherein the first connector member includes a lock screw configured to hold the grommet in an angled position within the slot of the first connector member.

11. The system of claim 1, wherein the first connector member is configured to hold the grommet at a first angle relative to the grommet driver and drive element;

further comprising a second connector member connected to the grommet driver;

wherein the second connector member is connected to a second grommet;

wherein the second connector member is configured to hold the second grommet at a second angle relative to the grommet driver and drive element;

wherein the first angle is different from the second angle.

12. A motorized grommet drapery system comprising:

a drive element;

the drive element extending a length between a first end and a second end;

a guide structure positioned in an exterior surface of the drive element;

a grommet driver connected to the drive element;

a motor connected to the drive element;

at least one battery electrically connected to the motor;

shade material having a plurality of grommets;

wherein the drive element extends through the plurality of grommets such that the shade material is supported by and hangs down from the drive element;

wherein the grommet driver is connected to at least one of the plurality of grommets and is in communication with the guide structure;

wherein the at least one of the plurality of grommets is held at an acute or obtuse angle relative to the guide structure; and wherein when the drive element is rotated the grommet driver moves the shade material along the length of the drive element.

13. The drapery system of claim 12, wherein when the drive element is rotated in a first direction the shade material is opened; and wherein the grommet driver is connected to multiple ones of the plurality of the grommets.

14. The drapery system of claim 12, wherein when the drive element is rotated in a second direction the shade material is closed.

15. The drapery system of claim 12, wherein the grommet driver is connected to a second inward most grommet.

16. The drapery system of claim 12, further comprising a remote wirelessly connected to the drapery system which when actuated opens or closes the shade material.

17. A motorized grommet drapery system comprising:

a drive element;

the drive element extending a length between a first end and a second end;

a guide structure positioned in an exterior surface of the drive element;

a first grommet driver and a second grommet driver connected to the drive element;

a first shade material having a first plurality of grommets therein and a second shade material having a second plurality of grommets therein;

wherein the drive element extends through the grommets of the first shade material and the second shade material;

a first connector member connected to the first grommet driver;

the first connector member configured to receive and hold a first one of the first plurality of grommets;

a second connector member connected to the second grommet driver;

the second connector member configured to receive and hold a first one of the second plurality of grommets;

wherein the first connector member is connected to the first one of the first plurality of grommets and the second connector member is connected to the first one of the second plurality of grommets; and wherein when the drive element is rotated the first shade material and the second shade material is opened or closed.

18. The drapery system of claim 17, wherein the first grommet driver and the second grommet driver have at least one tooth in communication with the guide structure.

19. The drapery system of claim 17, further comprising a remote wirelessly connected to the drive element, which when actuated opens or closes the shade material.

20. A drapery system comprising:

a drive element;

the drive element extending a length between a first end and a second end;

the drive element having a generally cylindrical exterior surface;

a guide structure positioned in the exterior surface of the drive element;

the guide structure having at least one helical groove;

a shade material having a plurality of grommets therein;

wherein the drive element extends through the plurality of grommets; and a grommet driver connected to the drive element;

a first connector member connected to the grommet driver;

the first connector member configured to receive and hold a first one of the plurality of grommets;

wherein the first connector member is connected to the first one of the plurality of grommets;

a second connector member connected to the grommet driver;

the second connector member configured to receive and hold a second one of the plurality of grommets;

wherein the second connector member is connected to the second one of the plurality of grommets;

wherein when the drive element is rotated the grommet driver interacts with the at least one helical groove which drives the shade material along the length of the drive element as the drive element rotates.

21. A drapery system comprising:

a drive element;

the drive element extending a length between a first end and a second end; the drive element having a generally cylindrical exterior surface;

shade material having a plurality of grommets therein;

wherein the drive element extends through the plurality of grommets; and wherein the plurality of grommets move along a length of the drive element between an opened position and a closed position;

a lead having a length;

a plurality grommet clips connected to the lead in spaced relation to one another;

wherein a grommet clip is connected to each grommet;

a grommet driver operatively connected to the lead and the grommet clips;

wherein the grommet clips are positioned at an upper rearward side of the drive element so as to hide or reduce the visual appearance of the grommet clips behind the drive element.

22. The drapery system of claim 21, wherein the spacing between the grommet clips on the lead sets the maximum spacing between adjacent grommets of the shade material when the shade material is in a closed position.

23. The drapery system of claim 21, wherein the spacing between grommet clips on the lead is fixed.

24. The drapery system of claim 21, wherein the spacing between grommet clips on the lead is adjustable.

25. The drapery system of claim 21, wherein the spacing between grommet clips on the lead varies along the length of the lead.

26. The drapery system of claim 21, wherein the spacing between grommet clips on the lead is consistent along the length of the lead.

27. The drapery system of claim 21, wherein the grommet clips are formed of a clear or translucent material.

28. The drapery system of claim 21, wherein when the drive element is rotated the shade material is driven along a length of the drive element.

29. The drapery system of claim 21, further comprising at least one guide structure positioned in the exterior surface of the drive element and wherein the grommet driver is configured to interact with the at least one guide structure and cause the shade material to move along a length of the drive element when the drive element is rotated.

30. The drapery system of claim 21, further comprising at least one guide structure positioned in the exterior surface of the drive element, wherein when the drive element is rotated the plurality of grommets are configured to interact with the at least one guide structure which urges the grommets in an opening direction or a closing direction.

31. The drapery system of claim 21, wherein the grommet driver is connected to an inward most grommet of the shade material.

32. The drapery system of claim 21, wherein the grommet driver is connected to a second inward most grommet of the shade material.

33. The drapery system of claim 21, wherein the grommet driver is positioned behind the shade material between two adjacent grommets.

34. The drapery system of claim 21, further comprising a carrier connected to the grommet driver wherein the carrier operably connects to two adjacent grommets of the shade material.

35. A drapery system comprising:

a drapery rod;

the drapery rod extending a length between a first end and a second end;

shade material having a plurality of grommets therein;

wherein the drapery rod extends through the plurality of grommets; and wherein the plurality of grommets move along the length of the drapery rod between an opened position and a closed position;

a carrier connected to a grommet driver;

the carrier including a pair of connector members, each configured to receive and hold ones of the plurality of grommets;

wherein the grommet driver fits around the drapery rod;

wherein the pair of connector members of the carrier connects to two adjacent grommets of the shade material.

36. The drapery system of claim 35, further comprising wherein the drapery rod has a guide structure, and the grommet driver includes a feature that communicates with the guide structure such that when the drapery rod is rotated the grommet driver is driven along the drapery rod.

37. The drapery system of claim 35, further comprising a lead having a length; a plurality grommet clips connected to the lead in spaced relation to one another; wherein the plurality of grommet clips are connected to the plurality of grommets.

38. The drapery system of claim 35, wherein the carrier is connected to an inward most positioned grommet and a second inward most positioned grommet.

39. The drapery system of claim 35, wherein the carrier is connected to a second inward most positioned grommet and a third inward most positioned grommet.

40. The drapery system of claim 35, wherein the carrier is positioned behind the shade material between two adjacent grommets.

* * * * *